US009017541B2

(12) United States Patent
Seddon et al.

(10) Patent No.: US 9,017,541 B2
(45) Date of Patent: Apr. 28, 2015

(54) ELECTRODEPOSITION OF ELEMENTAL ZIRCONIUM

(75) Inventors: Kenneth Seddon, Belfast (GB); Geetha Srinivasen, Belfast (GB); Anthony Wilson, Broadstone (GB)

(73) Assignee: Astron Advanced Materials Limited (GB)

( * ) Notice: Subject to any disclaimer, the term of this patent is extended or adjusted under 35 U.S.C. 154(b) by 297 days.

(21) Appl. No.: 13/322,584

(22) PCT Filed: May 28, 2010

(86) PCT No.: PCT/GB2010/050903

§ 371 (c)(1),
(2), (4) Date: Feb. 14, 2012

(87) PCT Pub. No.: WO2010/136814

PCT Pub. Date: Dec. 2, 2010

(65) Prior Publication Data

US 2012/0128968 A1 May 24, 2012

(30) Foreign Application Priority Data

May 29, 2009 (GB) ..... 0909195.0

(51) Int. Cl.

| | |
|---|---|
| ***C25C 3/26*** | (2006.01) |
| ***C25D 3/66*** | (2006.01) |
| ***C25D 3/54*** | (2006.01) |

(52) U.S. Cl.

CPC . *C25D 3/665* (2013.01); *C25C 3/26* (2013.01); *C25D 3/54* (2013.01)

(58) Field of Classification Search

CPC ..... C25D 3/665

See application file for complete search history.

(56) References Cited

U.S. PATENT DOCUMENTS

| | | | | |
|---|---|---|---|---|
| 2,510,128 | A | 6/1950 | Miner et al. | 204/14 |
| 2,796,392 | A | 6/1957 | Lietzke | 204/1.5 |
| 4,883,567 | A * | 11/1989 | Verbrugge et al. | 205/232 |
| 6,368,486 | B1 * | 4/2002 | Thompson et al. | 205/406 |
| 6,800,150 | B2 | 10/2004 | Totino et al. | 148/528 |
| 2004/0105999 | A1 | 6/2004 | Abkowitz et al. | 428/660 |
| 2007/0251826 | A1 * | 11/2007 | Fath | 205/158 |
| 2008/0027230 | A1 | 1/2008 | Ignatyev et al. | 546/348 |
| 2009/0101514 | A1 * | 4/2009 | Nohira et al. | 205/232 |
| 2009/0136778 | A1 | 5/2009 | Totino et al. | 428/660 |

FOREIGN PATENT DOCUMENTS

| | | | | |
|---|---|---|---|---|
| EP | 2 130 949 | A1 | 12/2009 | C25D 3/66 |
| JP | 2009197318 | A | 9/2009 | C25D 3/66 |
| WO | WO 2006/053362 | A3 | 5/2006 | C25D 3/66 |
| WO | WO 2007/029663 | A1 * | 3/2007 | |
| WO | WO 2008/096855 | A1 | 8/2008 | C25D 3/66 |
| WO | WO 2010/136814 | A2 | 12/2010 | C25D 3/66 |

OTHER PUBLICATIONS

Simka et al, Electrodeposition of metals from non-aqueous solutions, Electrochimica Acta, vol. 54, Issue 23, Sep. 2009, pp. 5307-5319.*

International Search Report mailed Feb. 3, 2011 in PCT Application Serial No. PCT/GB2010/050903.

Zhang et al. "Effects of [HMIM]HS04 and [OMIM]HS04 on the electrodeposition of zinc from sulfate electrolytes", *J Appl Electrochem*, (2009) 39:1185-1192.

Endres et al. "Air and water stable ionic liquids in physical chemistry", *Phys. Chem. Phys.*, (2006) 8 2101-2116.

Tsuda et al. "Electrodeposition of Al—Zr Alloys from Lewis Acidic Aluminum Chloride-1-Ethyl-3-methylimidazolium Chloride Melt", *Journal of the Electrochemical Society*, (2004) 151 (7) C447-C454.

Smith et al. "March's Advanced Organic Chemistry, Lewis Acids and Bases", *March's Advanced Organic Chemistry: Reactions, Mechanisms, and Structure, John Wiley & Sons, Inc.*, (2006) 375-378.

Pearson, "Hard and Soft Acids and Bases, HSAB, Part I", *Journal of Chemical Education, American Chemical Society*, (1968) 581-587.

Vaughan et al., "Electrodeposition of Aluminum from Aluminum Chloride-Trihexyl(tetradecyl) Phosphonium Chloride", *Journal of the Electrochemical Society, American Chemical Society*, (2007) 155 (1) D68-D72.

Abbott et al., "Electrodeposition of aluminum and aluminum/platinum alloys from $AlCl_3$/benzyltrimethylammonium chloride room temperature ionic liquids", *Journal of Applied Electrochemistry*, (2001) 31: 1345-1350.

Zhong et al., "Syntheses, Structures, and Properties of a Series of Metal Ion-Containing Dialkylimidazolium Ionic Liquids", *Bulletin of the Chemical Society of Japan*, (2007) vol. 80, No. 12, 2365-2374.

Simka et al., "Electrodeposition of metals from non-aqueous solutions", *Electrochemica Act* (2009) 54 5307-5319.

Sakamura, "Zirconium Behavior in Molten LiC1—KC1 Eutectic", (Journal of the Electrochemical Society, vol. 151, 2004, C187-C193).

Endres F. et al., "Ionic Liquids: Solvents for the Electrodeposition of Metals and Semiconductors", Chemphyschem, 2002, 3(2) 145.

Sun et al., "Electrochemistry of Centered Hexanuclear Zirconium Halide Clusters in Ambient-Temperature Chloroaluminate Molten Salts", (Inorg. Chem., 38, 1999, 992).

Hussey et al., "Electrodeposition of Al—Zr Allows from Lewis Acidic Aluminum Chloride-1-Ethy1-3-methylimidazolium Chloride Melt", J. Electrochem. Soc., 151, 2004, C447-C454.

Carpenter et al., "Electrochemical Codeposition of Gallium and Arsenic from a Room Temperature Chlorogallate Melt", J. Electrochem. Soc., 137, 1990, 123.

Pearson, "Hard and Soft Acids and Bases", J. Am. Chem. Soc., 85, 1963, 3533-3539.

Ghosh et al., "Electrochemical studies on the redox behavior of zirconium in molten LiC1—KC1 eutectic", J. Electroanalytical Che., 2009, 627(1-2)15.

* cited by examiner

*Primary Examiner* — Harry D Wilkins, III

(74) *Attorney, Agent, or Firm* — Ryan T. Grace; Advent, LLP

(57) ABSTRACT

The present invention relates to the electrodeposition of elemental zirconium at a temperature of less than 100° C. from a mixture of a Lewis acid, a zirconium salt and an ionic liquid.

41 Claims, 57 Drawing Sheets

ELECTRODEPOSITION OF ELEMENTAL ZIRCONIUM

The present invention relates to the electrodeposition of elemental zirconium and more specifically the electrodeposition of elemental zirconium from an electrodeposition mixture comprising a Lewis acid, a zirconium salt and an ionic liquid, and to products obtained from such processes.

Zirconium and zirconium alloys are widely used in industry, due to their resistance to corrosion and tolerance of high temperatures. For instance, zirconium alloys are used in the aviation industry, particularly in jet engines. When included in magnesium alloys, zirconium acts as a potent grain refiner, which has led to rapid development of the use of these alloys. Metallic zirconium is also used in nuclear reactors due its small neutron cross section, which increases the efficiency of atomic energy generation. Zirconium has further applications in other fields, such as the chemical industry.

Known methods for preparing zirconium metal and zirconium alloys include thermal reduction and molten salt electrolysis. Thermal reduction methods have many disadvantages, including discontinuous production and waste by-products formed in the smelting process. Of the thermal reduction methods, the most successful is the Kroll process, in which zirconium is displaced from zirconium (IV) chloride by magnesium.

Molten salt electrolysis is an effective method for the preparation of metals and their alloys, and one which allows the composition of the alloys to be controlled. The electrochemical behaviour of zirconium in different molten systems and techniques to produce zirconium metal through molten salt electrolysis have been extensively studied. Sakamura (*Journal of The Electrochemical Society*, vol. 151, 2004, C187-C193) has co-deposited zirconium metal and zirconium(I) chloride from a LiCl—KCl eutectic mixture at a temperature of 500° C. The metal was deposited as a fine black powder and had poor adhesion to the cathode, and therefore this method was unsuitable for electroplating with zirconium. It was also determined that at between 450° C. and 550° C. zirconium exists in oxidation states 0, +1, +2 and +4 and that the presence of these species is strongly dependent on temperature. Accordingly, the use of an elevated temperature may generate a more complex electrochemical system.

The electrodeposition of zirconium and zirconium alloys from ionic liquids has also been studied to a limited extent.

Ionic liquids are a novel class of compounds which have been developed over the last few years. The term "ionic liquid" as used herein refers to a liquid that is capable of being produced by melting a solid below 100° C., and when so produced consists solely of ions. Ionic liquids may be derived from organic salts.

One method for the electrodeposition of zirconium from a molten salt onto a uranium substrate is disclosed in U.S. Pat. No. 2,796,392. In this process, zirconium (IV) chloride (30 mol % to 40 mol %) is said to be deposited from an alkylpyridinium halide at 160° C. to 170° C. However, this method is only reported to produce a layer of 120 nm in thickness. The method also requires a concentration of zirconium (IV) chloride that is "as high as possible without resulting in inhomogeneity of the bath at the plating temperature", indicating that the authors of U.S. Pat. No. 2,796,392 believed that deposition of zirconium would be prevented at lower temperatures by an insufficient concentration of zirconium (IV) chloride dissolved in the ionic liquid. In addition, there is evidence to suggest that this method does not work (see Comparative Example 1, in which electrolysis of a 30 mol % to 40 mol % solution of zirconium (IV) chloride does not result in deposition of zirconium).

Halometallate ionic liquids are a class of ionic liquids that comprise an organic halide, usually with an organic cation such as imidazolium or pyridinium, and a Lewis acidic metal halide. Most commonly, an organic chloride and $AlCl_3$ are combined to form a chloroaluminate ionic liquid. In halometallate ionic liquids, the Lewis acids tends associate with the anion of the ionic liquid to form a Lewis acidic anion. A higher molar ratio of Lewis acid to organic halide gives a Lewis acidic system, and a lower molar ratio of Lewis acid to organic halide gives a Lewis basic system. Salts and oxides of other metals can be dissolved in halometallate ionic liquids and it has been found that variations in Lewis acidity change the electrochemical properties of the systems. This feature allows the proportions of co-deposited metals to be controlled (see Electrodeposition from Ionic Liquids, F. Endres, *Chemphyschem,* 2002, 3(2) 145).

In a study by Sun et al. (*Inorg. Chem.,* 38, 1999, 992) of the electrochemistry of hexanuclear zirconium halide clusters in chloroaluminate ionic liquids, there was no evidence for the deposition of zirconium or of a Zr—Al alloy in either acidic (60 mol % $AlCl_3$) or basic (40 mol % $AlCl_3$) chloroaluminate ionic liquids.

Hussey et al. (*J. Electrochem. Soc.,* 151, 2004, C447-C454), reportedly deposited a Zr—Al alloy from an acidic chloroaluminate ionic liquid at 80° C. The zirconium source was $ZrCl_4$ and the chloroaluminate ionic liquid comprised 67 mol % $AlCl_3$ and 33% 1-ethyl-3-methylimidazolium chloride. Whilst promising in some respects, a deposited Zr—Al alloy with less than 20 atom % zirconium is obtained, and a temperature significantly higher than room temperature is required. In addition, the 10 μm thickness of the deposited alloy is wasteful if a thin layer coating of the substrate is all that is required. Furthermore, it is well known in the art that chloroaluminate ionic liquids are highly hygroscopic, making them difficult to use on an industrial scale.

Chlorogallate ionic liquids, which comprise gallium (III) chloride as the Lewis acidic metal halide, are another class of halometallate ionic liquids. Although Carpenter et al. (*J. Electrochem. Soc.,* 137, 1990, 123), have successfully co-deposited gallium and arsenic from a chlorogallate ionic liquid under mild conditions, zirconium itself has not been deposited from a chlorogallate ionic liquid.

It has now been found that the use of a halometallate ionic liquid, in particular those comprising a "soft" Lewis acid, such as $GaCl_3$, rather than a "hard" Lewis acid, such as $AlCl_3$, surprisingly allows the electrodeposition of elemental zirconium under mild conditions. In particular, the present invention provides an elemental zirconium deposition process, comprising the step of electrolysing an electrodeposition mixture of an ionic liquid, with a Lewis acid, and a zirconium salt, at a temperature of less than 100° C.

The principle of "hard" and "soft" Lewis acids is well-known to those skilled in the art (see Inorganic Chemistry by D. F. Shriver, P. W. Atkins, C. H. Langford, Oxford University Press (Feb. 28, 1990)). As outlined by Pearson (*J. Am. Chem. Soc.,* 85, 1963, 3533-3539), hard and soft acids can be distinguished by the relative stability of their complexes with the ligands of a particular group. Hard acids tend to be smaller, more highly charged and less polarisable, and they form their most stable complex with the first atom of a group. Soft acids tend to be larger, less highly charged and less polarisable, and form their most stable complex with the second or a subsequent atom of a group. The classification is most consistent when applied to the halides, where a hard acid tends to form halide complexes with stability F>>Cl>Br>I, and a soft acid tends to form halide complexes with stability I>>Br>Cl>F. For the purposes of the present invention, the term soft Lewis acids is intended to include Lewis acids such as $ZnCl_2$, in addition to well-known soft Lewis acids such as $GaCl_3$ and $InCl_3$.

As used herein, elemental zirconium deposits are defined as deposits comprising greater than 50% by weight of zirconium. For example, the term "elemental zirconium" may refer to a deposit comprising greater than 60% by weight of zirconium, preferably greater than 70%, more preferably greater than 80%, and still more preferably greater than 90%. Most preferably, the deposit of elemental zirconium will comprise greater than 95% by weight of zirconium, more preferably greater than 96%, even more preferably greater than 97%, still more preferably greater than 98%, still more preferably greater than 99% and most preferably 100% by weight of zirconium.

In a first aspect, the present invention provides an elemental zirconium deposition process, comprising the step of electrolysing an electrodeposition mixture at a temperature of less than 100° C., wherein the electrodeposition mixture comprises:

i. an ionic liquid;

ii. a Lewis acid; and iii. a zirconium salt.

In accordance with the present invention, the ionic liquid is preferably liquid at a temperature of 80° C. or less, more preferably 60° C. or less, and even more preferably 40° C. or less. Most preferably, the ionic liquid is liquid at room temperature, where room temperature is between 20° C. and 25° C.

In one embodiment, the ionic liquid has the formula:

$$[Cat^+][X^-];$$

wherein: $[Cat^+]$ represents one or more cationic species; and $[X^-]$ represents one or more anionic species.

$[Cat^+]$ may comprise a cation selected from the group consisting of: ammonium, azaannulenium, azathiazolium, benzimidazolium, benzofuranium, benzothiophenium, benzotriazolium, borolium, cinnolinium, diazabicyclodecenium, diazabicyclononenium, 1,4-diazabicylco[2.2.2]octanium, diazabicycloundecenium, dibenzofuranium, dibenzothiphenium, dithiazolium, furanium, guanidinium, imidazolium, indazolium, indolinium, indolium, morpholinium, oxaborolium, oxaphospholium, oxathiazolium, oxazinium, oxazolium, iso-oxazolium, oxazolinium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, sulfonium, tetrazolium, thiadiazolium, iso-thiadiazolium, thiazinium, thiazolium, isothiazolium, thiophenium, thiuronium, triazadecenium, triazinium, triazolium, iso-triazolium, and uronium.

Preferably $[Cat^+]$ comprises a cation selected from the group consisting of:

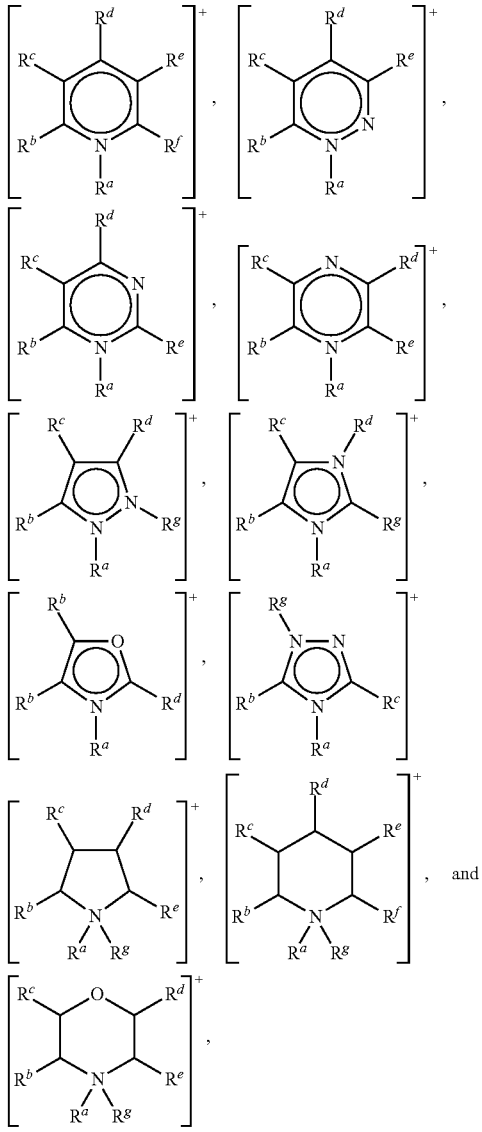

wherein: $R^a$, $R^b$, $R^c$, $R^d$, $R^e$, $R^f$ and $R^g$ are each independently selected from hydrogen, a $C_1$ to $C_{30}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain $—(CH_2)_q—$ wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, $—NO_2$, $—CO_2R^x$, $—OC(O)R^x$, $—C(O)R^x$, $—C(S)R^x$, $—CS_2R^x$, $—SC(S)R^x$, —S(O)($C_1$ to $C_6$)alkyl, —S(O)O($C_1$ to $C_6$)alkyl, —OS(O)($C_1$ to $C_6$)alkyl, —S($C_1$ to $C_6$)alkyl, —S—S($C_1$ to $C_6$ alkyl), $—NR^xC(O)NR^yR^z$, $—NR^xC(O)OR^y$, $—OC(O)NR^yR^z$, $—NR^xC(S)OR^y$, $—OC(S)NR^yR^z$, $—NR^xC(S)SR^y$, $—SC(S)NR^yR^z$, $—NR^1C(S)NR^yR^z$, $—C(O)NR^yR^z$, $—C(S)NR^yR^z$, $—NR^yR^z$, or a heterocyclic group, wherein $R^x$, $R^y$ and $R^z$ are independently selected from hydrogen or $C_1$ to $C_6$ alkyl.

More preferably, $R^a$, $R^b$, $R^c$, $R^d$, $R^e$, $R^f$ and $R^g$ are each independently selected from hydrogen, a $C_1$ to $C_{30}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6, wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, —CN, —OH, —SH, —$NO_2$, —$CO_2$($C_1$ to $C_6$)alkyl, —OC(O)($C_1$ to $C_6$)alkyl.

Still more preferably, $R^a$, $R^b$, $R^c$, $R^d$, $R^e$, $R^f$ and $R^g$ are each independently selected from hydrogen, $C_1$ to $C_{20}$ straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, —CN, —OH, —SH, —$NO_2$, —$CO_2$($C_1$ to $C_6$)alkyl, —OC(O)($C_1$ to $C_6$)alkyl, $C_6$ to $C_{10}$ aryl and $C_7$ to $C_{10}$ alkaryl.

$R^a$ is preferably selected from $C_1$ to $C_{30}$, linear or branched, alkyl, more preferably $C_2$ to $C_{20}$ linear or branched alkyl, and most preferably, $C_1$ to $C_{10}$ linear or branched alkyl. Further examples include wherein $R^a$ is selected from methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl and n-octadecyl.

In the cations comprising an $R^g$ group, $R^g$ is preferably selected from $C_1$ to $C_{10}$ linear or branched alkyl, more preferably, $C_1$ to $C_5$ linear or branched alkyl, and most preferably $R^g$ is a methyl group.

In the cations comprising both an $R^a$ and an $R^g$ group, $R^a$ and $R^g$ are each preferably independently selected from $C_1$ to $C_{30}$, linear or branched, alkyl, and one of $R^a$ and $R^g$ may also be hydrogen. More preferably, one of $R^a$ and $R^g$ may be selected from $C_1$ to $C_{10}$ linear or branched alkyl, and the other one of $R^a$ and $R^g$ may be selected from $C_1$ to $C_{10}$ linear or branched alkyl, more preferably, $C_1$ to $C_5$ linear or branched alkyl, and most preferably a methyl group.

In a further preferred embodiment, $R^a$ and $R^g$ may each be independently selected, where present, from $C_1$ to $C_{30}$ linear or branched alkyl and $C_1$ to $C_{15}$ alkoxyalkyl.

In further preferred embodiments, $R^b$, $R^c$, $R^d$, $R^e$, and $R^f$ are independently selected from hydrogen and $C_1$ to $C_5$ linear or branched alkyl, and more preferably $R^b$, $R^c$, $R^d$, $R^e$, and $R^f$ are hydrogen.

In a preferred embodiment of the invention, [Cat$^+$] comprises the cation:

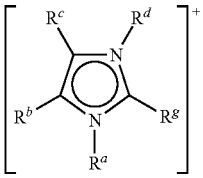

wherein: $R^a$, $R^b$, $R^c$, $R^d$ and $R^g$ are as defined above.

More preferably, [Cat$^+$] comprises a cationic species selected from:

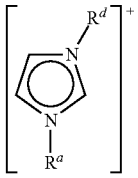

wherein: $R^a$ and $R^g$ are as defined above.

For example, [Cat$^+$] may comprise a cation selected from the group consisting of: methylimidazolium, 1,3-dimethylimidazolium, 1-ethyl-3-methylimidazolium, 1-butyl-3-methylimidazolium, 1-octyl-3-methylimidazolium, 1-decyl-3-methylimidazolium, 1-dodecyl-3-methylimidazolium, 1-tetradecyl-3-methylimidazolium, 1-hexadecyl-3-methylimidazolium and 1-methyl-3-octadecylimidazolium.

In the present invention, [Cat$^+$] is most preferably 1-octyl-3-methylimidazolium.

In another embodiment, [Cat$^+$] may comprise a cation selected from the group consisting of:

$$[N(R^a)(R^b)(R^c)(R^d)]^+,\ [P(R^a)(R^b)(R^c)(R^d)]^+,\ \text{and}\ [S(R^a)(R^b)(R^c)]^+,$$

wherein: $R^a$, $R^b$, $R^c$, and $R^d$ are each independently selected from a $C_1$ to $C_{30}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(S)$R^x$, —$CS_2R^x$, —SC(S)$R^x$, —S(O)($C_1$ to $C_6$)alkyl, —S(O)O($C_1$ to $C_6$)alkyl, —OS(O)($C_1$ to $C_6$)alkyl, —S($C_1$ to $C_6$)alkyl, —S—S($C_1$ to $C_6$ alkyl), —$NR^xC(O)NR^yR^z$, —$NR^xC(O)OR^y$, —OC(O)$NR^yR^z$, —$NR^xC(S)OR^y$, —OC(S)$NR^yR^z$, —$NR^xC(S)SR^y$, —SC(S)$NR^yR^z$, —$NR^xC(S)NR^yR^z$, —C(O)$NR^yR^z$, —C(S)$NR^yR^z$, —$NR^yR^z$, or a heterocyclic group, wherein $R^x$, $R^y$ and $R^z$ are independently selected from hydrogen or $C_1$ to $C_6$ alkyl, and wherein one of $R^a$, $R^b$, $R^c$, and $R^d$ may also be hydrogen.

More preferably, [Cat$^+$] may comprise a cation selected from:

$$[N(R^a)(R^b)(R^c)(R^d)]^+ \text{ and } [P(R^a)(R^b)(R^c)(R^d)]^+,$$

wherein: $R^a$, $R^b$, $R^c$, and $R^d$ are each independently selected from a $C_1$ to $C_{15}$ straight chain or branched alkyl group, a $C_3$ to $C_6$ cycloalkyl group, or a $C_6$ aryl group, wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, —CN, —OH, —SH, —$NO_2$, —$CO_2$($C_1$ to $C_6$)alkyl, —OC(O)($C_1$ to $C_6$)alkyl, $C_6$ to $C_{10}$ aryl and $C_7$ to $C_{10}$ alkaryl, and wherein one of $R^a$, $R^b$, $R^c$, and $R^d$ may also be hydrogen.

Preferably $R^a$, $R^b$, $R^c$ and $R^d$ are independently selected from methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl and n-octadecyl. More preferably two or more, and most preferably three or more, of $R^a$, $R^b$, $R^c$ and $R^d$ are independently selected from methyl, ethyl, propyl and butyl.

Still more preferably, $R^b$, $R^c$, and $R^d$ are each the same alkyl group selected from methyl, ethyl n-butyl, and n-octyl, and $R^a$ is selected from hydrogen, methyl, n-butyl, n-octyl, n-tetradecyl, 2-hydroxyethyl, or 4-hydroxy-n-butyl.

For example [$Cat^+$] may comprise a cationic species selected from: tetramethylammonium, tetraethylammonium, tetrapropylammonium, tetrabutylammonium, tetrapentylammonium, tetrahexylammonium, 2-hydroxyethyl-trimethylammonium, 2-($C_1$-$C_6$)alkoxyethyl-trimethylammonium, tetraethylphosphonium, tetrapropylphosphonium, tetrabutylphosphonium, tetrapentylphosphonium, tetrahexylphosphonium and trihexyltetradecylphosphonium.

In a further embodiment [$Cat^+$] may comprise a cationic species represented by the formula:

$$[Cat^+\text{-}(Z\text{-}Bas)_n]$$

wherein: $Cat^+$ is a cationic species:

Bas is a basic moiety

Z is a covalent bond joining $Cat^+$ and Bas or 1, 2 or 3 aliphatic divalent linking groups each containing 1 to 10 carbon atoms and each optionally one, two or three oxygen atoms; and n is an integer from 1 to 3, most preferably n is 1.

Bas may comprise at least one nitrogen, phosphorus, sulphur or oxygen atom. Preferably Bas is selected from the group consisting of:

$$—N(R^1)(R^2),\ —P(R^1)(R^2),\ —SR^3 \text{ or } —OR^3,$$

wherein: $R^1$ and $R^2$ are independently selected from hydrogen, linear or branched alkyl, cycloalkyl, aryl and substituted aryl or, in the case of an $—N(R^1)(R^2)$ group, $R^1$ and $R^2$ together with the interjacent nitrogen atom form part of a heterocyclic ring; and $R^3$ is selected from linear or branched alkyl, cycloalkyl, aryl and substituted aryl.

Preferably, $R^1$, $R^2$ and $R^3$ are each selected from methyl, ethyl, isopropyl, propyl, butyl, sec-butyl, isobutyl, pentyl, hexyl, cyclohexyl, benzyl, phenyl, or, in the case of an $—N(R^1)(R^2)$ group, $R^1$ and $R^2$ together represent a tetramethylene or pentamethylene group optionally substituted by one of more $C_1$ to $C_4$ alkyl groups.

Preferably, the basic moiety is a "hindered basic group" i.e. is a functional group that acts as a base and, owing to steric hindrance, does not chemically bond to any of the components of the oil (other of course than by accepting a proton in the usual reaction of a Brønsted acid with a Brønsted base). Suitable hindered basic groups include $—N(CH(CH_3)_2)_2$ and $—N(C(CH_3)_3)_2$. Preferably, the hindered basic group has a lower nucleophilicity (or greater steric hindrance) than $—N(C_2H_5)_3$.

In the context of the present invention, the group —OH is not considered basic due to difficulties with protonation. Accordingly, Bas as defined herein does not include —OH, and in a preferred embodiment, does not include $—OR^3$.

Z may be selected from linear or branched $C_1$ to $C_{18}$ alkanediyl, substituted alkanediyl, dialkanylether or dialkanylketone, preferably $C_1$ to $C_8$ and more preferably $C_2$ to $C_6$.

For example, Z may be selected from:

a) $(CH_2—CH_2)—$, $(CH_2—CH_2—CH_2)—$, $—(CH_2—CH_2—CH_2—CH_2)—$, $—(CH_2—CH_2—CH_2—CH_2—CH_2)—$, $—(CH_2—CH_2—CH_2—CH_2—CH_2—CH_2)—$, $—(CH_2—CH(CH_3))—$, and $—(CH_2—CH(CH_3)—CH_2—CH(CH_3))—$;

b) a divalent alkyleneoxyalkylene radical selected from: $—(CH_2—CH_2—O—CH_2—CH_2)—$, $—(CH_2—CH_2—O—CH_2—CH_2—CH_2)—$, and $—(CH_2—CH(CH_3)—OCH_2—CH(CH_3))—$;

c) a divalent polyoxyethylene radical selected from: $—(CH_2CH_2O)_n—$ where n is an integer in the range 1 to 9 or $—(CH_2CH(CH_3)O)_m—$ where m is an integer in the range 1 to 6; or d) a divalent alkylenearylene or an alkylenearylenealkylene radical selected from: $—(CH_2—C_6H_4)—$, and $—(CH_2—C_6H_4—CH_2)—$.

In accordance with this embodiment of the invention, $Cat^+$ may be selected from the group consisting of: ammonium, azaannulenium, azathiazolium, benzimidazolium, benzofuranium, benzothiophenium, benzotriazolium, borolium, cinnolinium, diazabicyclodecenium, diazabicyclononenium, 1,4-diazabicylco[2.2.2]octanium, diazabicycloundecenium, dibenzofuranium, dibenzothiphenium, dithiazolium, furanium, guanidinium, imidazolium, indazolium, indolinium, indolium, morpholinium, oxaborolium, oxaphospholium, oxathiazolium, oxazinium, oxazolium, iso-oxazolium, oxazolinium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, sulfonium, tetrazolium, thiadiazolium, iso-thiadiazolium, thiazinium, thiazolium, iso-thiazolium, thiophenium, thiuronium, triazadecenium, triazinium, triazolium, iso-triazolium, and uronium.

Preferably [$Cat^+$-Z-Bas] is selected from the group consisting of:

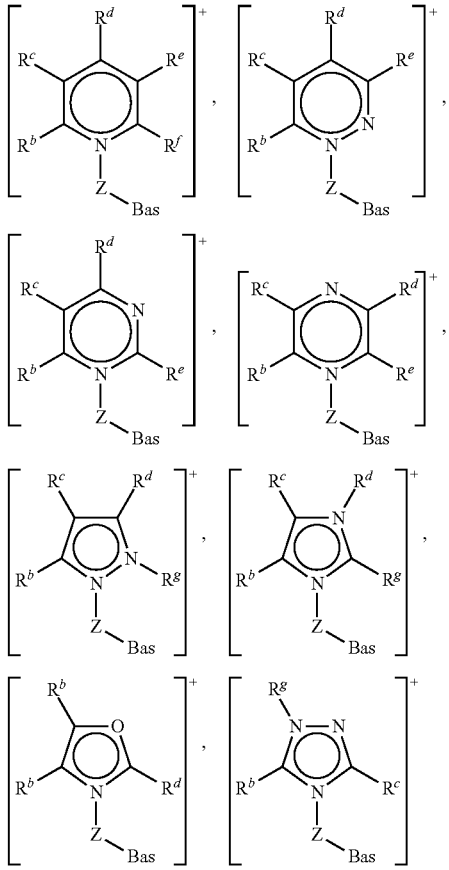

-continued

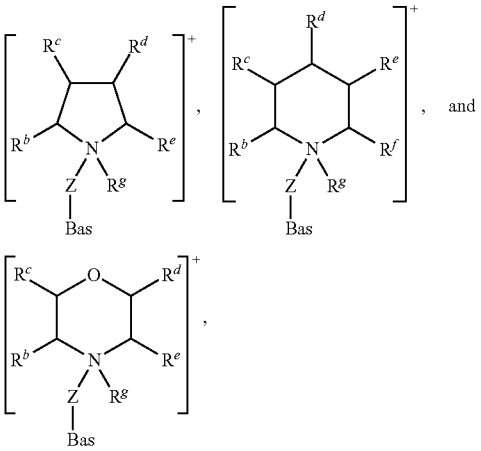

wherein: Bas, Z and $R^b$, $R^c$, $R^d$, $R^e$, $R^f$ and $R^g$ are defined as above.

Alternatively, [Cat$^+$-Z-Bas] may be selected from:

$$[N(Z\text{-}Bas)(R^b)(R^c)(R^d)]^+ \text{ and } [P(Z\text{-}Bas)(R^b)(R^c)(R^d)]^+$$

wherein: Bas, Z, $R^b$, $R^c$, and $R^d$ are as defined above.

Preferred [Cat$^+$-Z-Bas], where Cat$^+$ is a heterocyclic ring structure, include:

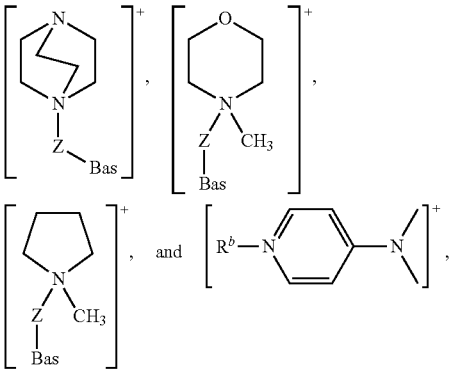

wherein: Bas, Z and $R^b$ are as defined above.

Still more preferably, Cat$^+$ is a heterocyclic ring structure and Bas is a sterically hindered amino group, for example:

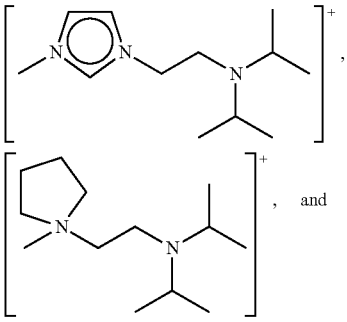

-continued

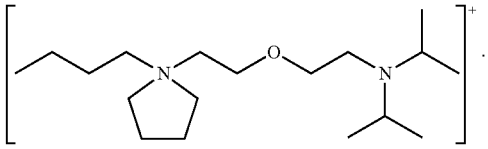

The Cat$^+$ moiety in [Cat$^+$-Z-Bas] may also be an acyclic cationic moiety. Preferably, the acyclic cationic moiety comprises a group selected from amino, amidino, imino, guanidino, phosphino, arsino, stibino, alkoxyalkyl, alkylthio, alkylseleno and phosphinimino.

Where the Cat$^+$ moiety is an acyclic cationic moiety, [Cat$^+$-Z-Bas] is preferably selected from:

$$[N(Z\text{-}Bas)(R^b)(R^c)(R^d)]^+ \text{ and } [P(Z\text{-}Bas)(R^b)(R^c)(R^d)]^+$$

wherein: Bas, Z, $R^b$, $R^c$, and $R^d$ are as defined above.

Examples of preferred [Cat$^+$-Z-Bas] of this class include:

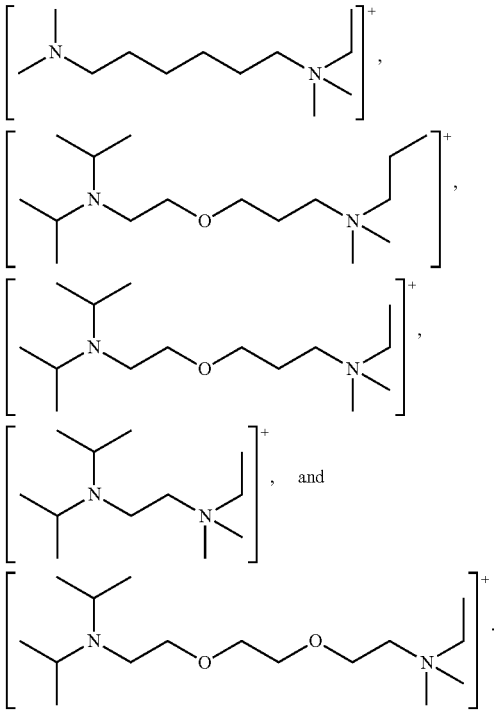

where Bas is the sterically hindered amino group, —N(CH$(CH_3)_2)_2$.

[Cat$^+$-Z-Bas] may also be:

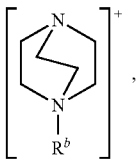

wherein: $R^b$ is as defined above.

In a further embodiment, [Cat$^+$] may comprise an acidic cation represented by the formula:

$$[Cat^+\text{-}(Z\text{-}Acid)_n]$$

wherein: $Cat^+$ is a cationic species:

Acid is an acidic moiety; and

Z is as defined above, n is defined as above, and is preferably 1.

Acid may be selected from —$SO_3H$, —$CO_2H$, —$PO(OH)_2$ and —PO(OH)R; wherein R is, for example, $C_1$ to $C_6$ alkyl.

In accordance with this embodiment of the invention, $Cat^+$ may be selected from the group consisting of: ammonium, azaannulenium, azathiazolium, benzimidazolium, benzofuranium, benzothiophenium, benzotriazolium, borolium, cinnolinium, diazabicyclodecenium, diazabicyclononenium, 1,4-diazabicylco[2.2.2]octanium, diazabicycloundecenium, dibenzofuranium, dibenzothiphenium, dithiazolium, furanium, guanidinium, imidazolium, indazolium, indolinium, indolium, morpholinium, oxaborolium, oxaphospholium, oxathiazolium, oxazinium, oxazolium, iso-oxazolium, oxazolinium, pentazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, selenazolium, sulfonium, tetrazolium, thiadiazolium, iso-thiadiazolium, thiazinium, thiazolium, iso-thiazolium, thiophenium, thiuronium, triazadecenium, triazinium, triazolium, iso-triazolium, and uronium.

Preferably [$Cat^+$-Z-Acid] is selected from the group consisting of:

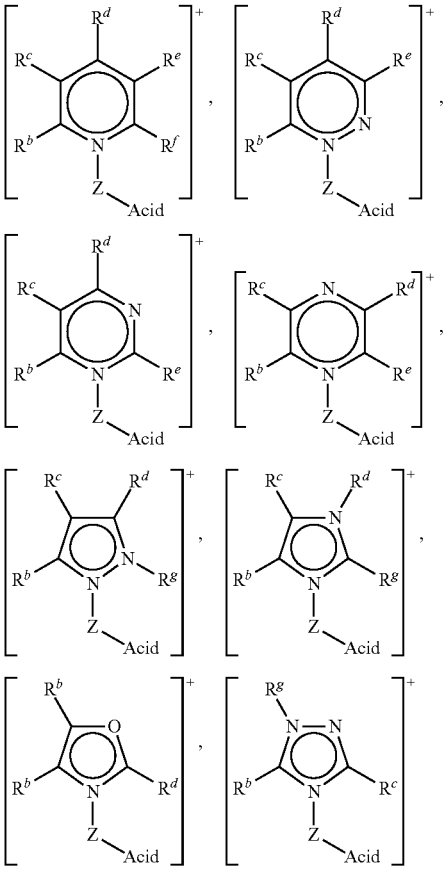

-continued

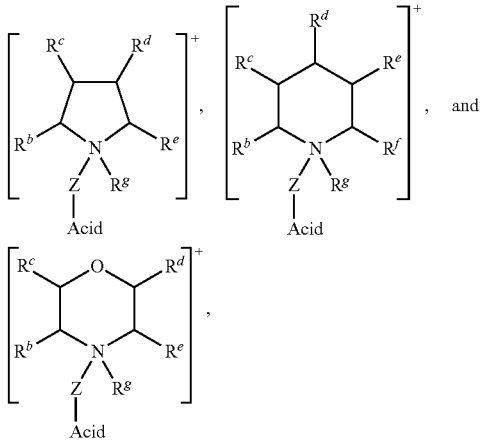

wherein: Acid, Z and $R^b$, $R^c$, $R^d$, $R^e$, $R^f$ and $R^g$ are defined as above.

More preferably [$Cat^+$-Z-Acid] is selected from:

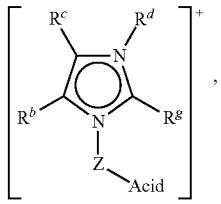

wherein: $R^b$, $R^c$, $R^d$, $R^g$, Acid and Z are as defined above.

Most preferably, [$Cat^+$-Z-Acid] is:

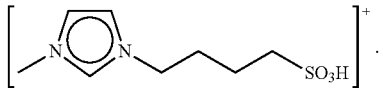

The $Cat^+$ moiety in [$Cat^+$-Z-Acid] may also be an acyclic cationic moiety. Preferably, the acyclic cationic moiety comprises a group selected from amino, amidino, imino, guanidino, phosphino, arsino, stibino, alkoxyalkyl, alkylthio, alkylseleno and phosphinimino.

Alternatively, [$Cat^+$-Z-Acid] may be selected from:

$[N(Z\text{-}Acid)(R^b)(R^c)(R^d)]^+$ and $[P(Z\text{-}Acid)(R^b)(R^c)(R^d)]^+$ wherein: Acid, Z, $R^b$, $R^c$, and $R^d$ are as defined above.

[$X^-$] may be selected from: $[F]^-$, $[Cl]^-$, $[Br]^-$, $[I]^-$, $[OH]^-$, $[HSO_4]^-$, $[SO_4]^{2-}$, $[EtSO_4]^-$, $[H_2PO_4]^-$, $[HPO_4]^{2-}$, $[PO_4]^{3-}$, $[BF_4]^-$, $[PF_6]^-$, $[SbF_6]^-$, $[CuCl_2]^-$, $[AsF_6]^-$, $[CH_3SO_3]^-$[$CH_3(C_6H_4)SO_3]^-$, $[CH_3OSO_3]^-$, $[C_2H_5OSO_3]^-$, $[CF_3SO_3]^-$, $[CF_3COO]^-$, $[CF_3CH_2CH_2COO]^-$, $[(CF_3SO_2)_3C]^-$, $[CF_3(CF_2)_3SO_3]^-$, $[(CF_3SO_2)_2N]^-$, $[NO_3]^-$, $[NO_2]^-$, [BBDB]$^-$, [BOB]$^-$, $[Co(CO_4)]^-$, $[(CN)_2N]^-$, $[(CF_3)_2N]^-$, $[(C_2F_5)_3PF_3]^-$, $[(C_3F_7)_3PF_3]^-$, $[(C_2F_5)_2P(O)O]^-$, $[SCN]^-$, $[C_8H_{17}OSO_3]^-$, $[TO]_5^-$, $[H_3CO(CH_2)_2O(CH_2)OSO_3]^-$, and $[H_3C(OCH_2CH_2)_nOSO_3]^-$, $[OR]^-$, $[RCO_2]^-$, $[HF_2]^-$, $[HCl_2]^-$, $[HBr_2]^-$, $[HI_2]^-$ and an inorganic metal ion, wherein R is $C_1$ to $C_6$ alkyl.

Preferably, [$X^-$] is selected from the group consisting of: $[F]^-$, $[Cl]^-$, $[Br]^-$, $[I]^-$, $[EtSO_4]^-$, $[CH_3SO_3]^-$, $[(CF_3SO_2)_2N]^-$ and $[CF_3SO_3]^-$, more preferably a halide, and most preferably $[Cl]^-$.

In an alternative embodiment, $[X^-]$ may comprise a basic anion selected from: $[F]^-$, $[Cl]^-$, $[OH]^-$, $[OR]^-$, $[RCO_2]^-$, $[PO_4]^{3-}$ and $[SO_4]^{2-}$, wherein R is $C_1$ to $C_6$ alkyl.

In another alternative embodiment, $[X^-]$ may comprise an acidic anion selected from: $[HSO_4]^-$, $[H_2PO_4]^-$, $[HPO_4]^{2-}$, $[HF_2]^-$, $[HCl_2]^-$, $[HBr_2]^-$ and $[HI_2]^-$.

In the present invention, the ionic liquid is most preferably 1-octyl-3-methylimidazolium chloride.

Preferably, the Lewis acid is a soft Lewis acid.

Without wishing to be bound by any theory, it is believed that a soft Lewis acid does not co-deposit with the zirconium to the extent that a hard Lewis acid, such as aluminium (III) chloride, has been found to. Furthermore, soft Lewis acids are advantageously less hygroscopic than hard Lewis acids, making their corresponding ionic liquids easier to handle.

In accordance with the present invention, the Lewis acid is preferably a metal halide.

Preferably, the metal of the Lewis acid is selected from gallium, indium and zinc (i.e. soft metals). More preferably, the metal is gallium. Preferably, the halide of the metal halide that is a Lewis acid is chloride. Preferably, the metal halide (i.e. the Lewis acid) is selected from gallium (III) chloride, indium (III) chloride and zinc (II) chloride. Most preferably, the metal halide is gallium (III) chloride.

When the Lewis acid is in the electrodeposition mixture of the present invention, it is likely to associate with anions in the mixture, such as the anion of the ionic liquid, and exist as a Lewis acidic anion.

A zirconium salt is used as the source of metallic zirconium. The zirconium salt may be a zirconium halide (Cl, Br or I) and is preferably a zirconium chloride, most preferably zirconium (IV) chloride. The zirconium salt may also be a zirconium complex salt.

In a further preferred embodiment, the electrodeposition mixture contains a buffer. The purpose of the buffer is to help maintain the neutrality of the electrodeposition mixture, which encourages the deposition of elemental zirconium metal.

The buffer may be any known suitable buffer in the art, and can be readily selected by a person of skill in the art. Preferably the buffer is a zirconium salt and more preferably the zirconium buffer is the same as the zirconium salt of the electrodeposition mixture. In a more preferred embodiment of the present invention, both the buffer and the zirconium salt are zirconium tetrachloride.

In a particular embodiment, the zirconium salt may be premixed with an ionic liquid to form a zirconium complex salt. This zirconium complex salt can then be used as the zirconium source, as the buffer, or preferably as both. The zirconium complex salt preferably comprises zirconium (IV) chloride (preferably 33 mol %) and 1-octyl-3-methylimidazolium chloride (preferably 67 mol %).

In the process of the present invention, elemental zirconium may be deposited on a substrate.

The substrate may be any suitable solid material, and, for example, may be glass, resin, plastic, metal, ceramic, a semiconductor or glassy carbon.

The substrate may further comprise a layer of a second material between the substrate and the outer layer of elemental zirconium. The second material may be a semiconductor or a metal. Preferably the second material is platinum, gold or tungsten. Most preferably the second material is platinum.

In order to minimise costs, it will be appreciated that it is desirable for the platinum coating to be of limited thickness. For example, the layer of platinum may have a thickness of less than 10 μm. Preferably the layer of platinum has a thickness of less than 1 μm. Most preferably the layer of platinum has a uniform thickness of less than 100 nm.

It is also possible that the first material and the second material are both platinum. In this case, the substrate is most preferably a platinum sheet.

In undertaking the electrodeposition process of the present invention, it will be understood that it is necessary to have a working electrode (the substrate described above) and a counter electrode.

Preferably, the counter electrode may be made from a metal, a semiconductor or glassy carbon. Preferably, the counter electrode is made of platinum. In a preferred embodiment, the platinum electrode is a platinum coil.

The process may further comprise a third electrode as a reference electrode. Preferably the third electrode is made of silver. Where the third electrode is silver, it preferably has a deposition potential of −2 V vs. $Ag/Ag^+$.

As noted above, the process of the present invention is operated at a temperature of less than 100° C. An advantage of using a temperature of less than 100° C. is that it results in a simpler electrochemical system by minimising the occurrence of zirconium in oxidation states +3, +2 and +1. In addition, processes conducted at lower temperatures are safer and cheaper to operate.

The process of the present invention is preferably operated at a temperature of less than 80° C. More preferably it is operated at a temperature of less than 60° C. and more preferably at a temperature of less than 40° C.

The process of the present invention is preferably operated at a temperature of more than 5° C. More preferably it is operated at a temperature of more than 15° C.

In a most preferred embodiment of the present invention, the process takes place at room temperature, wherein room temperature is between 20° C. and 25° C.

It is desirable for the electrochemical deposition to continue for a period of time that is long enough to deposit a layer of elemental zirconium, but not too long such that unwanted metals are deposited on the outermost surface of the deposited layer. Suitable timings may be readily selected by a person of skill in the art, depending on the electrodeposition mixture used. Accordingly, the deposition may continue, for example, for a period of between 60 s and 3600 s. Preferably the deposition continues for a period of between 60 s and 1800 s. Most preferably, the deposition is run for a period of 500 s to 900 s.

It has surprisingly been found that the elemental zirconium deposition process of the present invention is self-limiting in the thickness of zirconium metal deposited. Above a certain thickness, zirconium metal stops being deposited and the metal of the Lewis acid in the ionic liquid begins to be deposited on the zirconium. Such a self-limiting property of zirconium in the methods of the present invention is advantageous as it prevents excess zirconium being deposited. Evidence for the self-limiting nature of the zirconium deposition process is provided in the Examples.

A possible explanation of this behaviour can be found in a paper by Ghosh et al., *J. Electroanalytical Che,* 2009, 627(1-2) 15. The reaction of Zr(IV) with Zr(0) forms Zr(II), and the presence of Zr(II) in the electrolyte shifts the deposition potential of Zr(0) to a more negative value. It is believed that, for example, gallium interferes with the deposition of zirconium to a greater extent at more negative potentials. Therefore, in a chlorogallate system, on approaching a certain level of zirconium deposition, gallium will become deposited to an increasing extent.

In the process of the present invention, the thickness of the layer of elemental zirconium deposited on a substrate is therefore preferably self limiting. The elemental zirconium layer may have a thickness of between 150 nm and 10,000 nm, more preferably between 1,000 nm and 7,500 nm, even more preferably between 2,000 nm and 5,000 nm.

The rate of deposition in the process of the present invention may be from 40 to 80 $nms^{1}$, and more particularly from 55 to 65 $nms^{-1}$.

In a preferred embodiment of the invention, the electrodeposition mixture contains less than 30 mol % of the zirconium salt. More preferably the electrodeposition mixture comprises less than 20 mol % of the zirconium salt. Even more preferably the electrodeposition mixture comprises less than 10 mol % of the zirconium salt. Most preferably the electrodeposition mixture comprises less than 5 mol % of the zirconium salt.

In one embodiment, the electrodeposition mixture for use in the present invention may be made by combining:

i. a Lewis acid premixed with a first amount of ionic liquid; and ii. a zirconium salt premixed with a second amount of ionic liquid;

wherein the Lewis acid, ionic liquid and zirconium salt are preferably defined as above.

In accordance with this embodiment of the invention, the Lewis acid is preferably premixed with a first amount of ionic liquid in a molar ratio from 2:1 to 1:2, more preferably 2:1 to 1:1 and most preferably 1:1. It has been observed that deposits from a neutral system contain a high proportion of zirconium, with a molar ratio of 1:1 giving a neutral chlorogallate ionic liquid when gallium (III) chloride is used as the Lewis acid. Embodiments in which a slightly acidic ionic liquid comprises a neutralising buffer also deposit a high proportion of zirconium.

In accordance with this embodiment of the invention, the zirconium salt is preferably premixed with a second amount of ionic liquid in a molar ratio from 1:1 to 1:10, and most preferably 1:2. In premixing the zirconium salt and a second amount of ionic liquid, it is necessary to use a sufficiently large quantity of ionic liquid for homogeneity, but not an amount that would dilute the system too much.

In a further preferred embodiment of the present invention, the electrodeposition mixture is made by combining:

i. ten parts by weight of: gallium (III) chloride premixed with a first amount of 1-octyl-3-methylimidazolium chloride in a molar ratio of 1:1; and ii. one part by weight of: zirconium (IV) chloride premixed with a second amount of 1-octyl-3-methylimidazolium chloride in a molar ratio of 1:2.

In this embodiment, the premixing of zirconium (IV) chloride with 1-octyl-3-methylimidazolium chloride forms a zirconium complex salt, which can be used both as the zirconium source and as the buffer.

In another aspect, the present invention provides a substrate comprising a layer of elemental zirconium produced in accordance with the process of the present invention, as defined above.

In a further aspect, the present invention provides a substrate comprising an outer layer of elemental zirconium.

The substrate may be comprised of any suitable solid first material, and is preferably defined as above.

The substrate may further comprise a layer of a second material between the substrate and the outer layer of elemental zirconium. The second layer is preferably defined as above.

The outer layer of elemental zirconium is preferably defined as above.

In a further aspect, the present invention provides a kit of parts for preparing an electrodeposition mixture for the deposition of elemental zirconium in a process as defined above, wherein the kit comprises:

i. an ionic liquid;

ii. a Lewis acid; and iii. a zirconium salt.

The ionic liquid and Lewis acid may be premixed in the kit, and/or the ionic liquid and zirconium salt may be premixed.

The invention further comprises the use of:

i. an ionic liquid;

ii. a Lewis acid; and iii. a zirconium salt in an elemental zirconium deposition process.

In another aspect, the invention provides a novel ionic liquid for use as a zirconium precursor. This novel ionic liquid is the complex $([omim]^{+})_2[ZrCl_6]^{2-}$, where $[omim]^{+}$ is the 1-octyl-3-methylimidazolium cation. This zirconium complex salt may be formed by the combination of zirconium (IV) chloride and 1-octyl-3-methylimidazolium chloride in a molar ratio of 1:2. Advantageously, the complex is very stable to air.

In a preferred embodiment, the complex $([omim]^{+})_2[ZrCl_6]^{2}$ may be used as the zirconium salt and/or as the zirconium buffer.

The invention further comprises the use of said complex in any one of the above methods.

The present invention will now be described by way of example, and with reference to the accompanying Figures in which.

Figure 3:
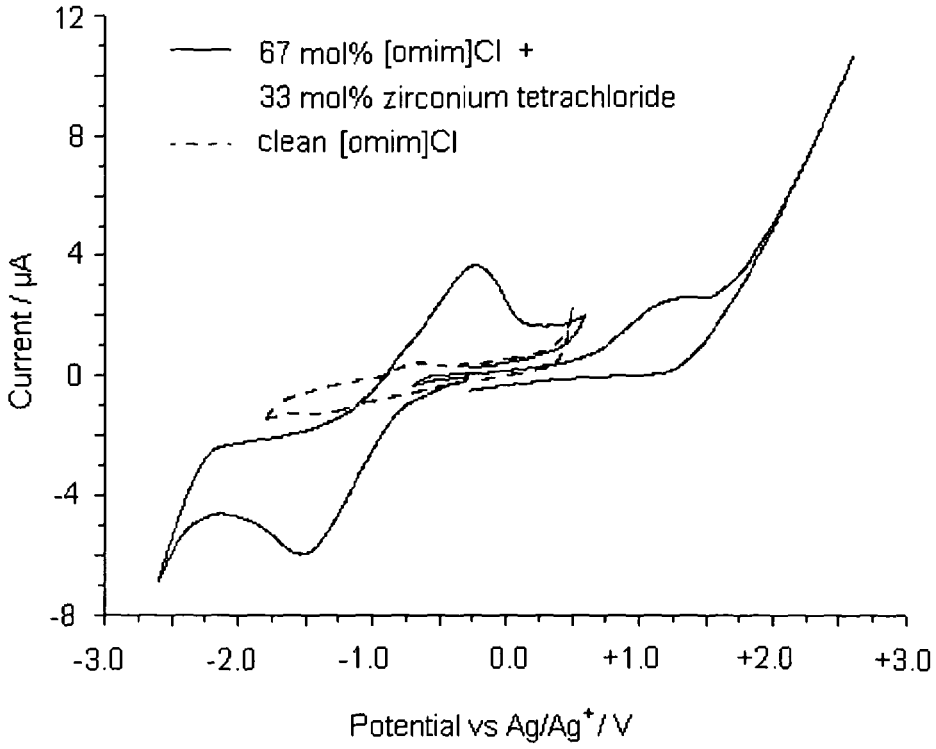
Figure 4:
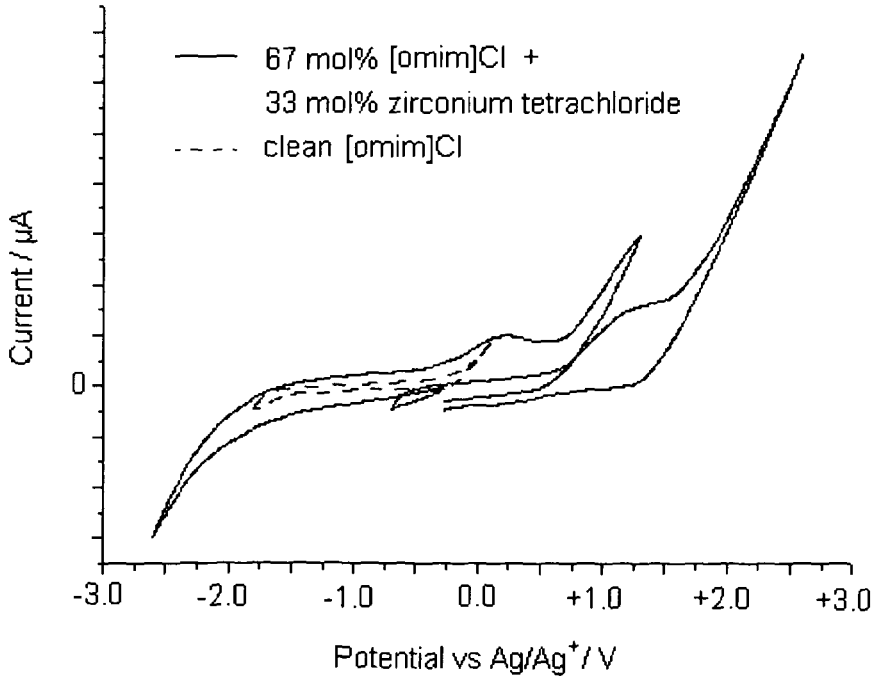
Figure 5:
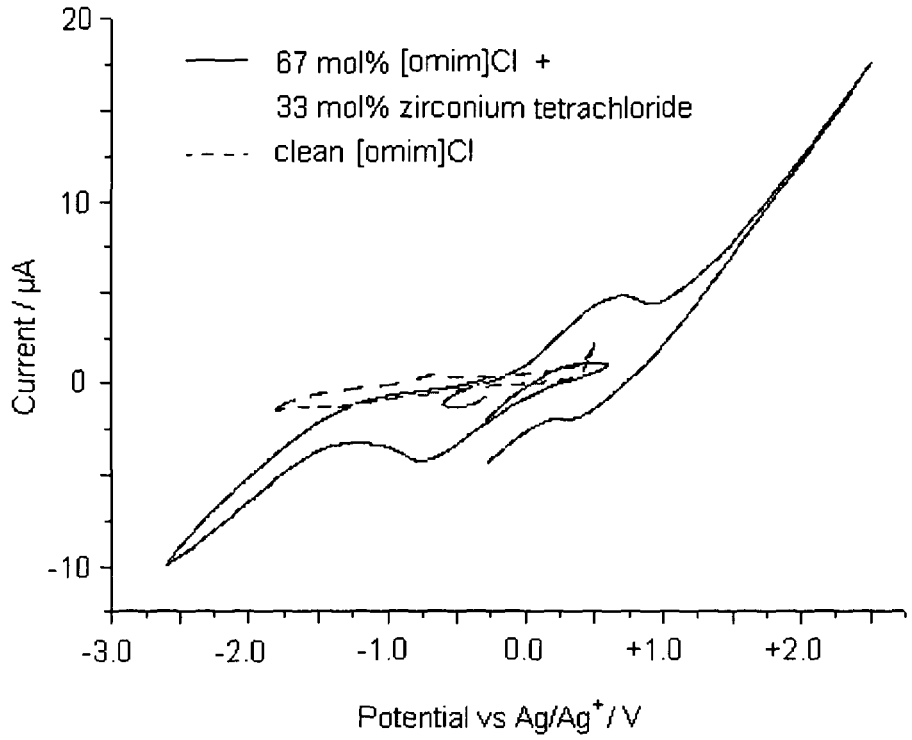
Figure 6:
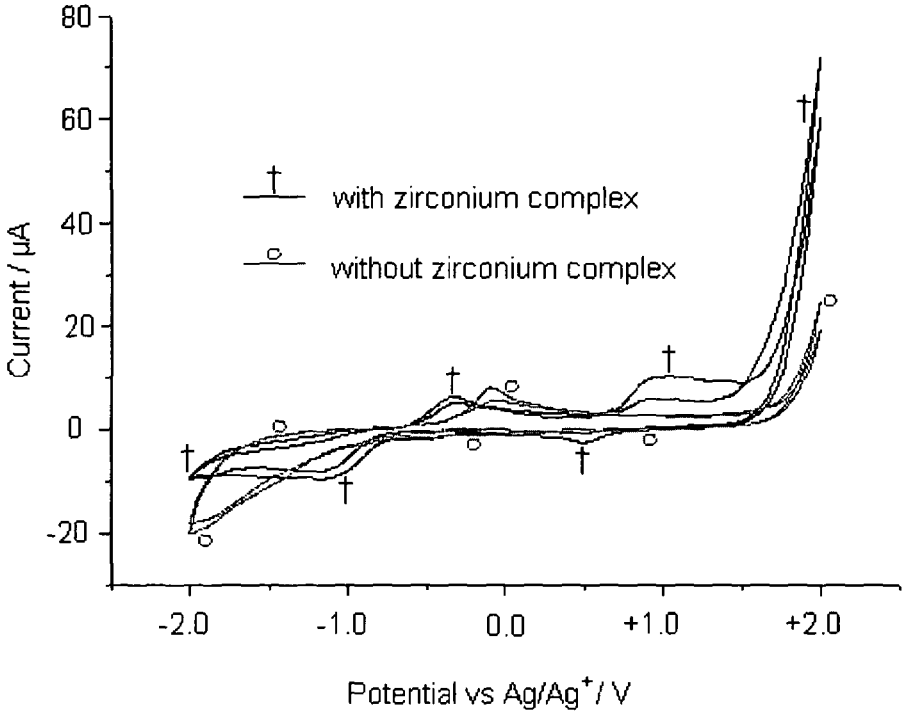
Figure 7:
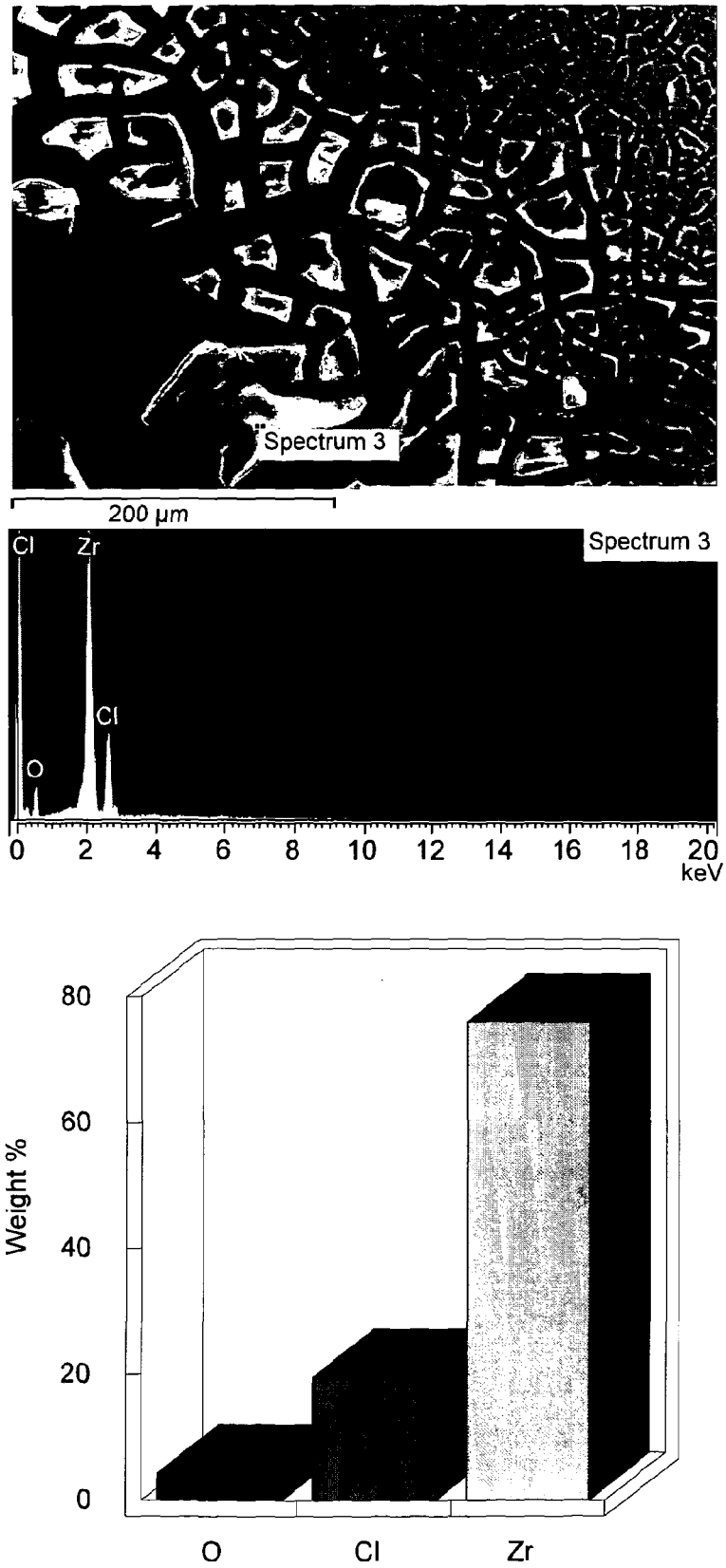
Figure 8:
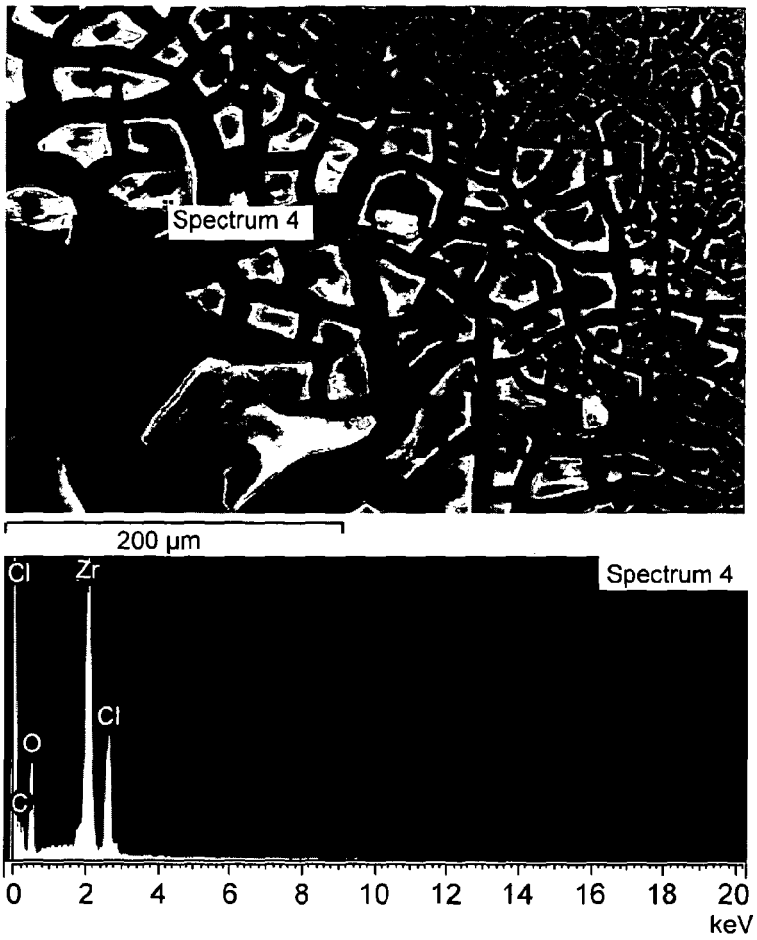
Figure 8:
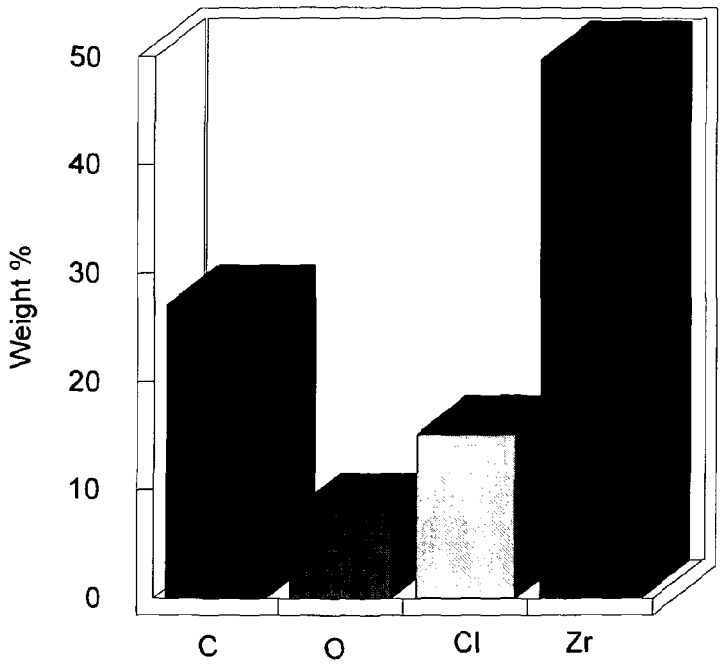
Figure 9:
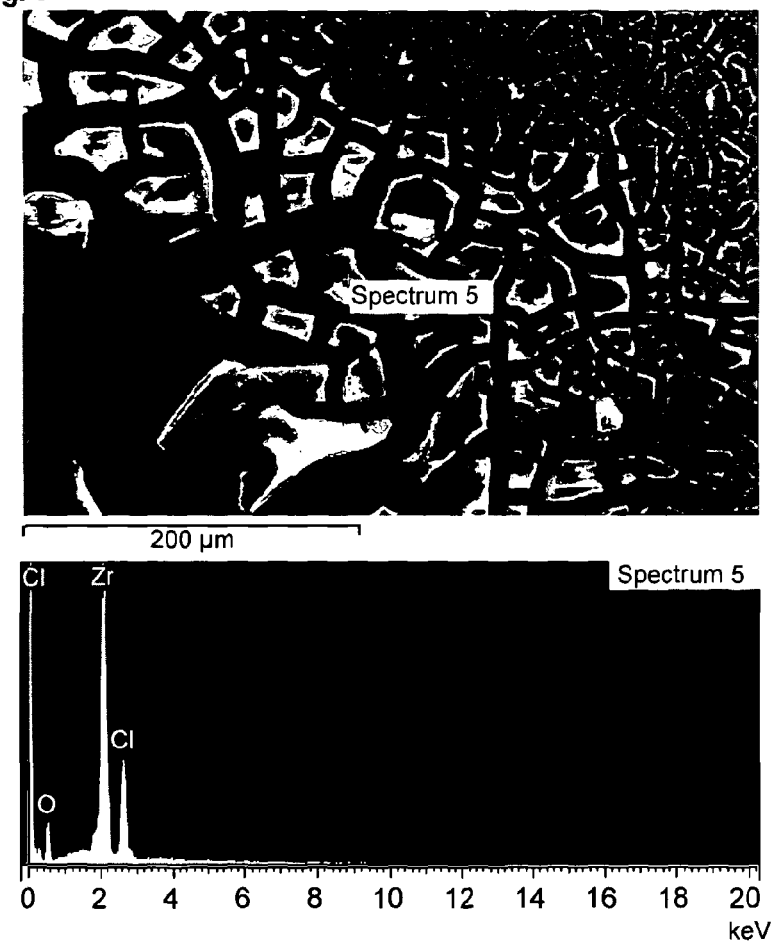
Figure 9:
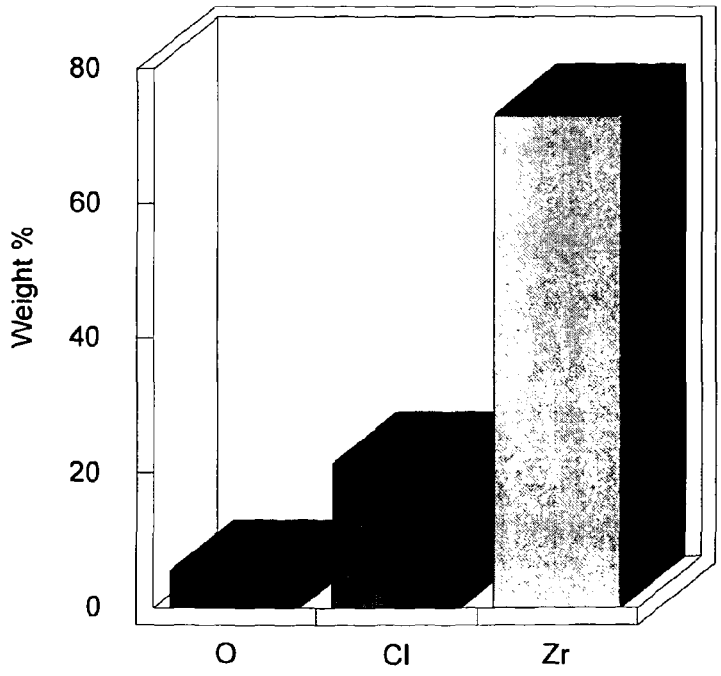
Figure 10:
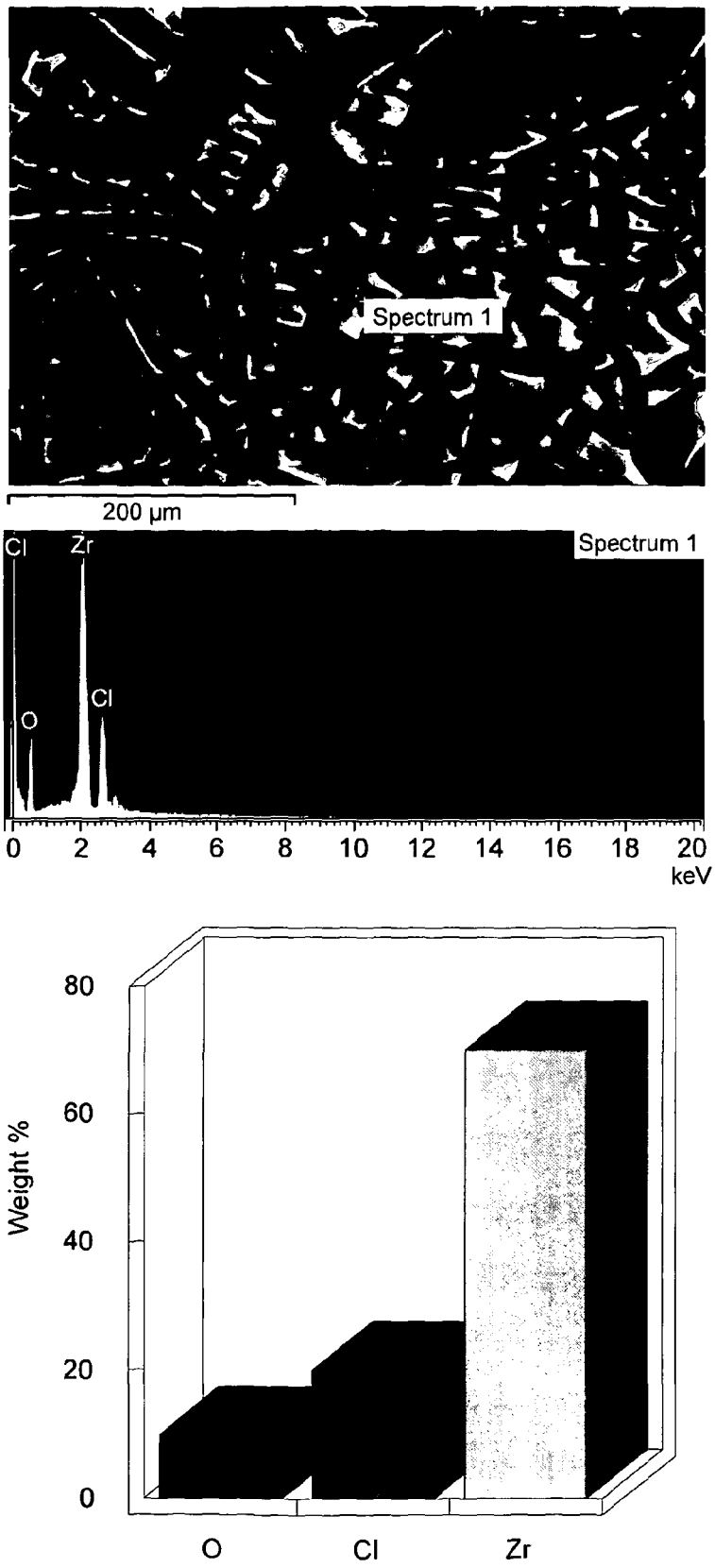
Figure 11:
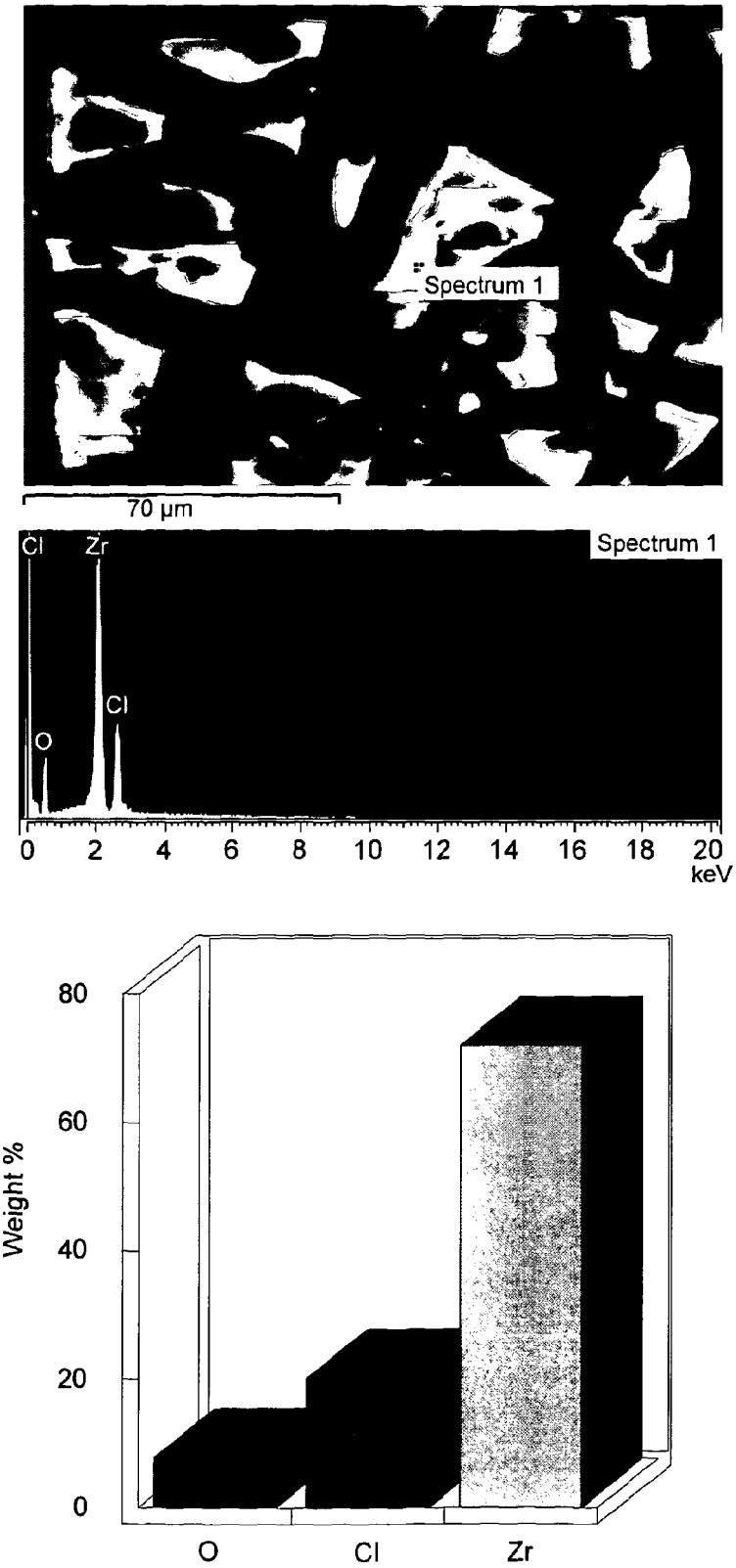
Figure 12:
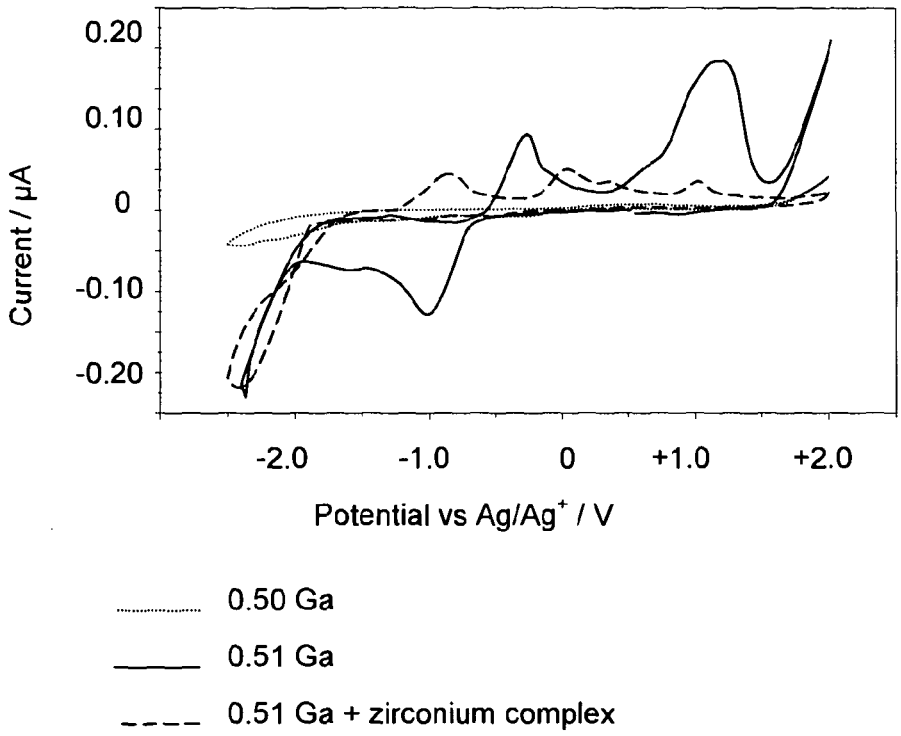
Figure 13:
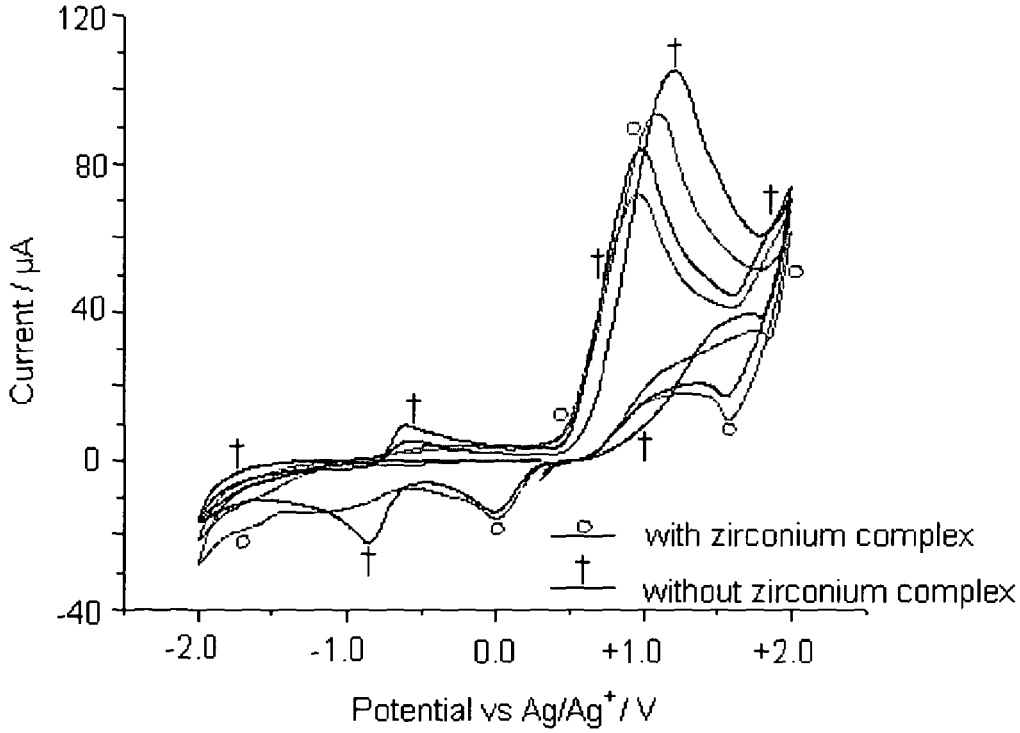
Figure 14:
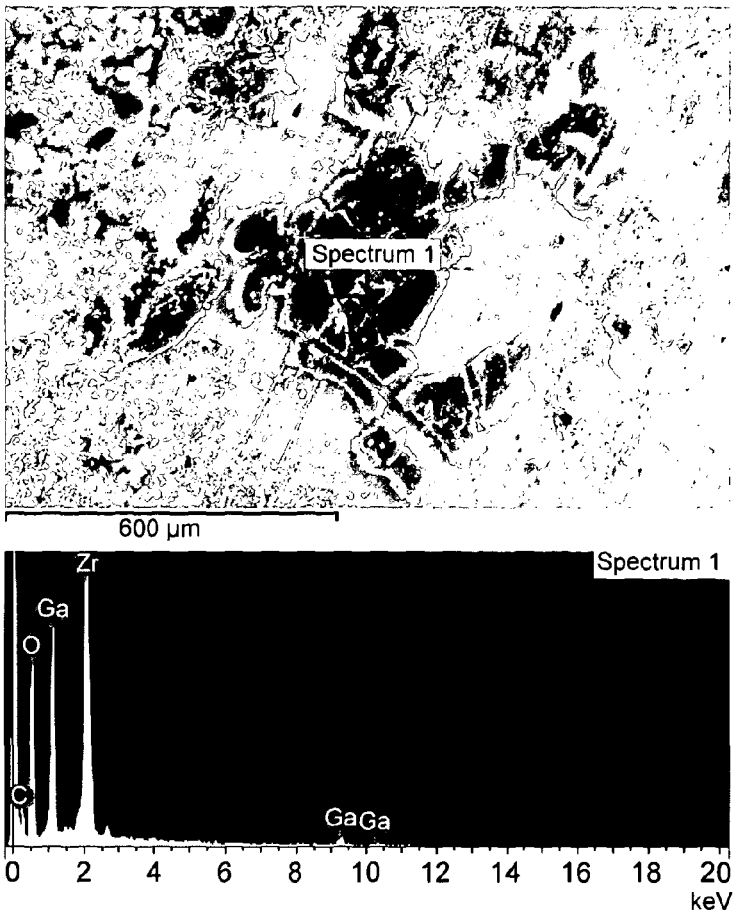
Figure 14:
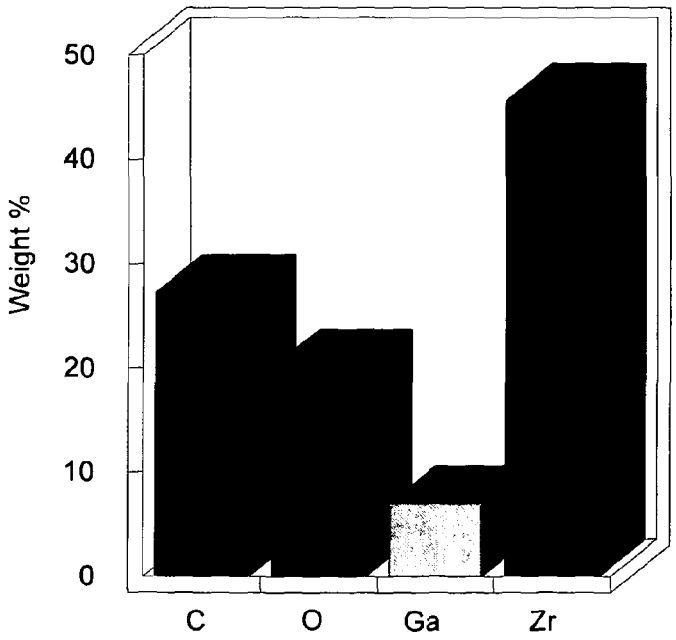
Figure 15:
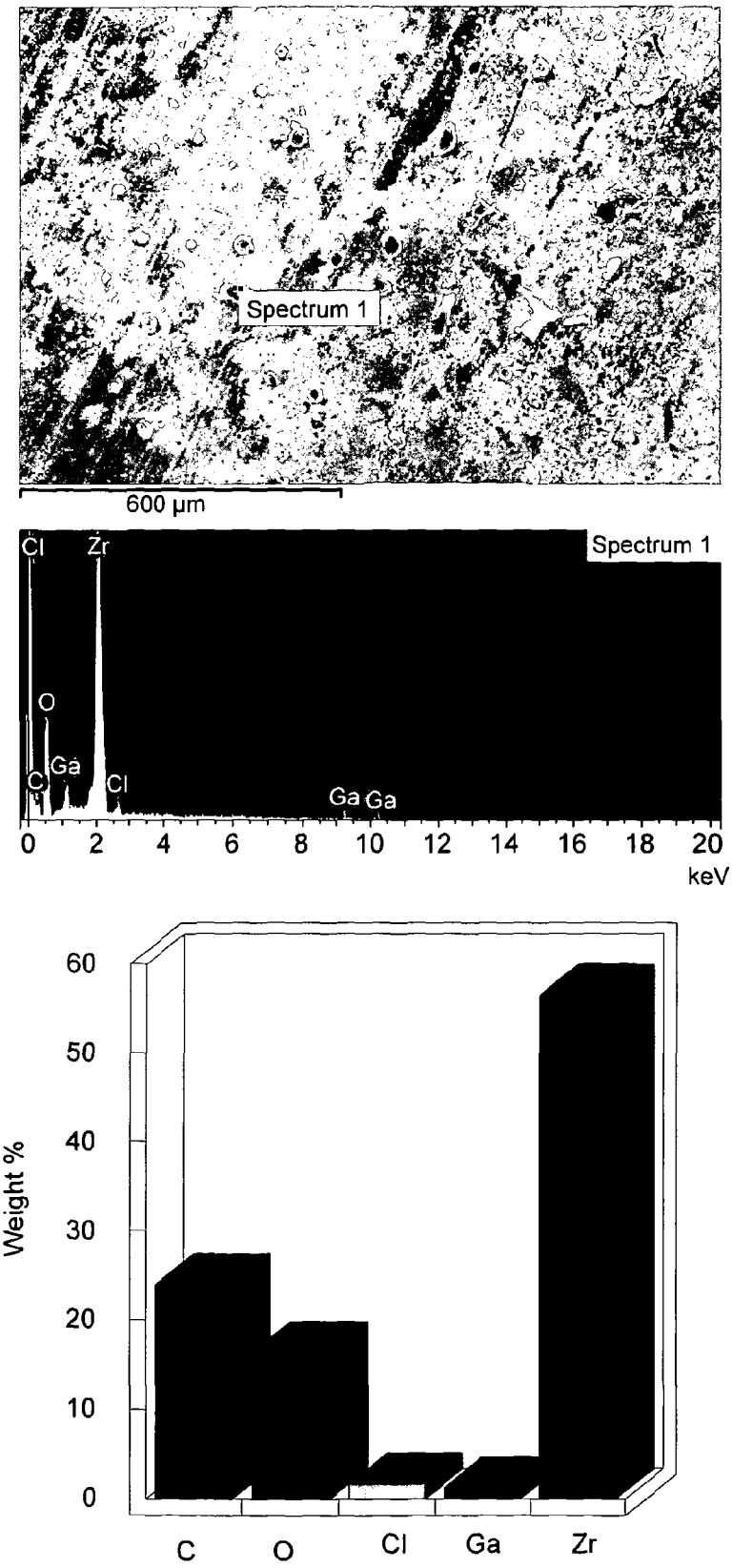
Figure 16:
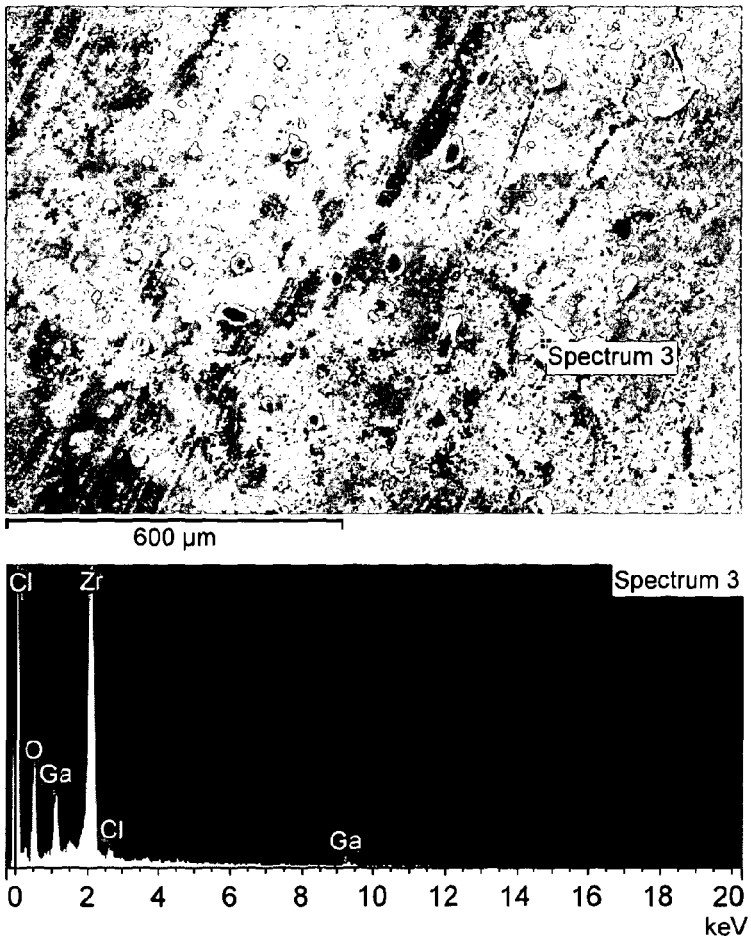
Figure 16:
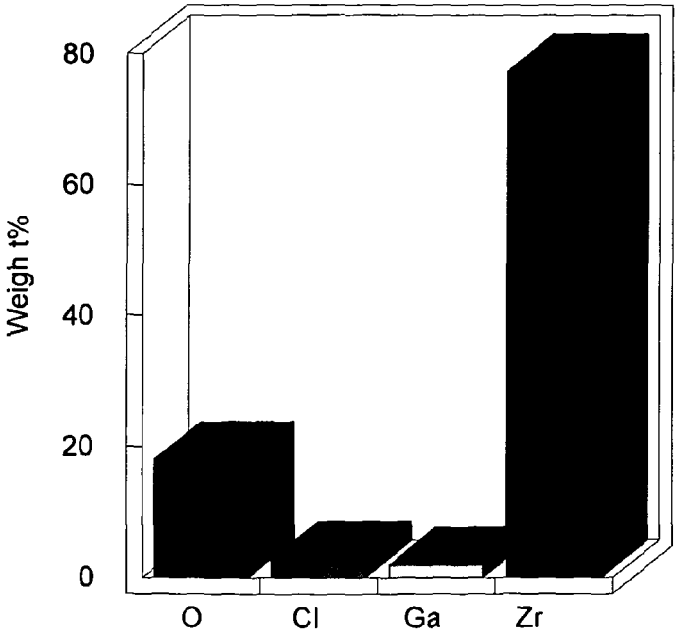
Figure 17:
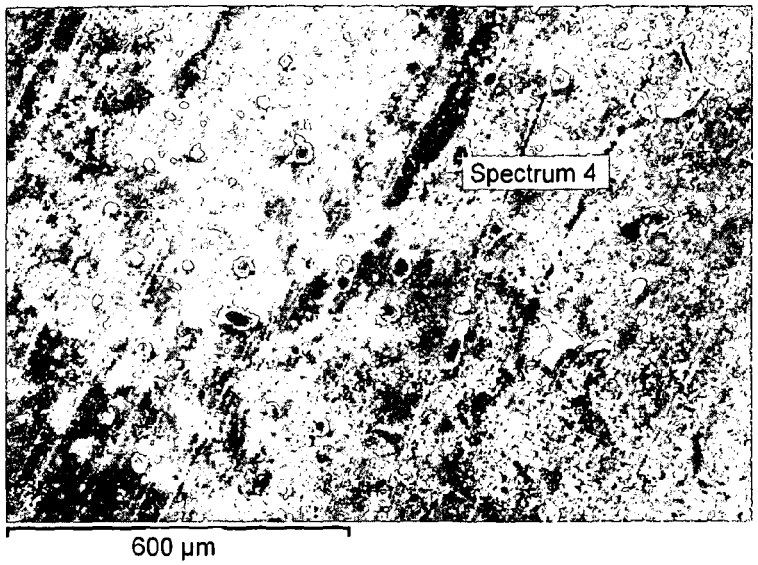
Figure 17:
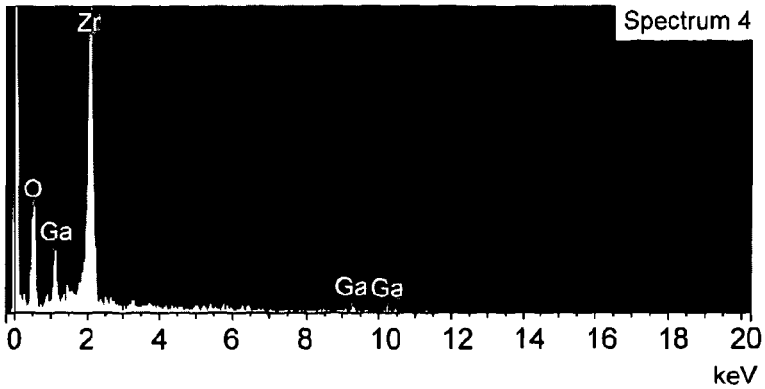
Figure 17:
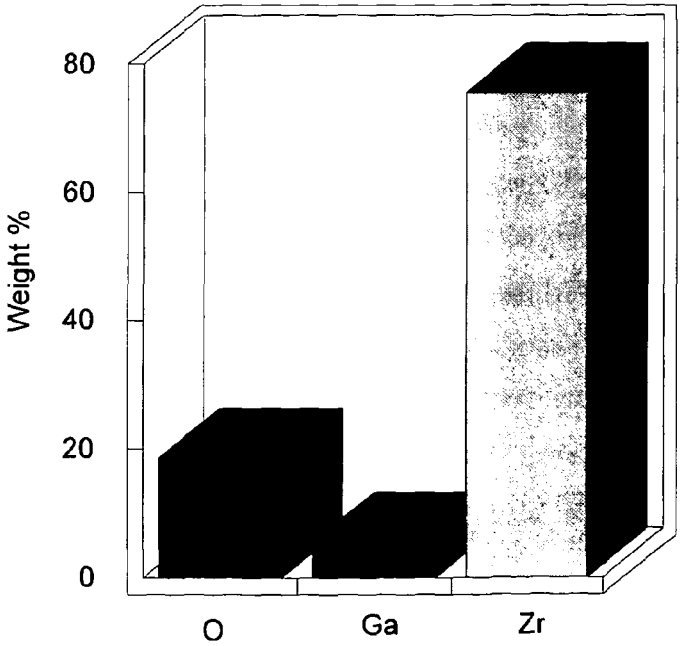
Figure 18:
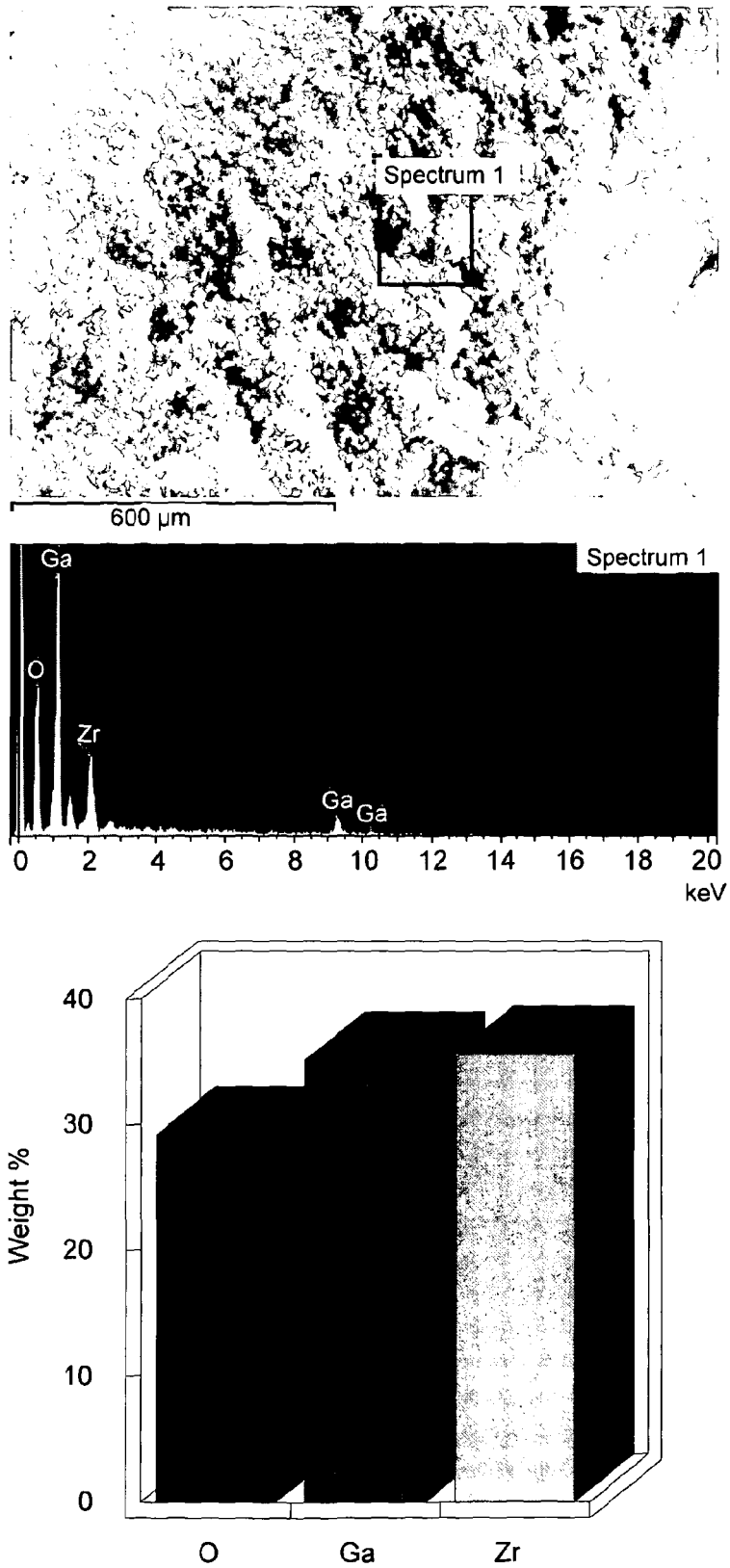
Figure 19:
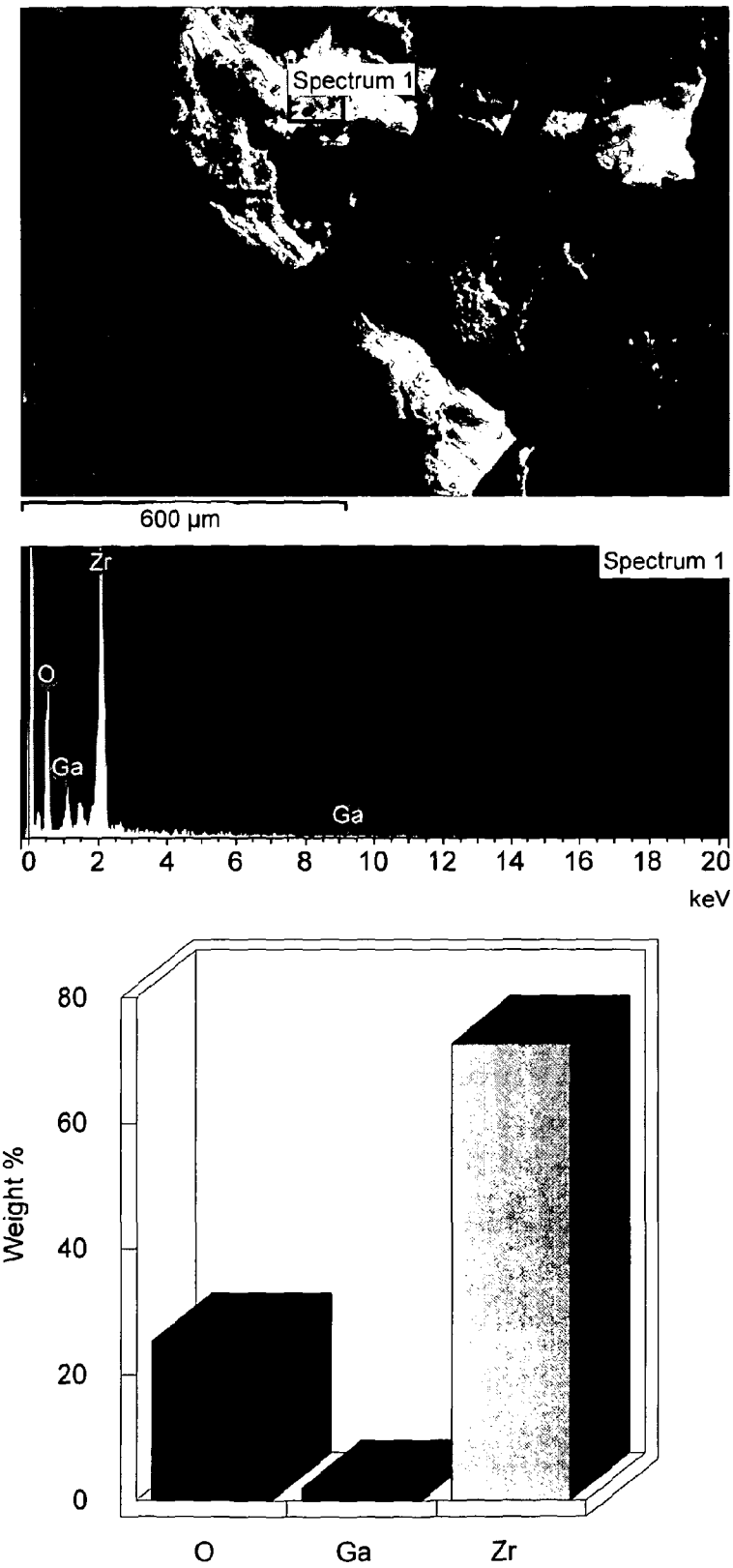
Figure 20:
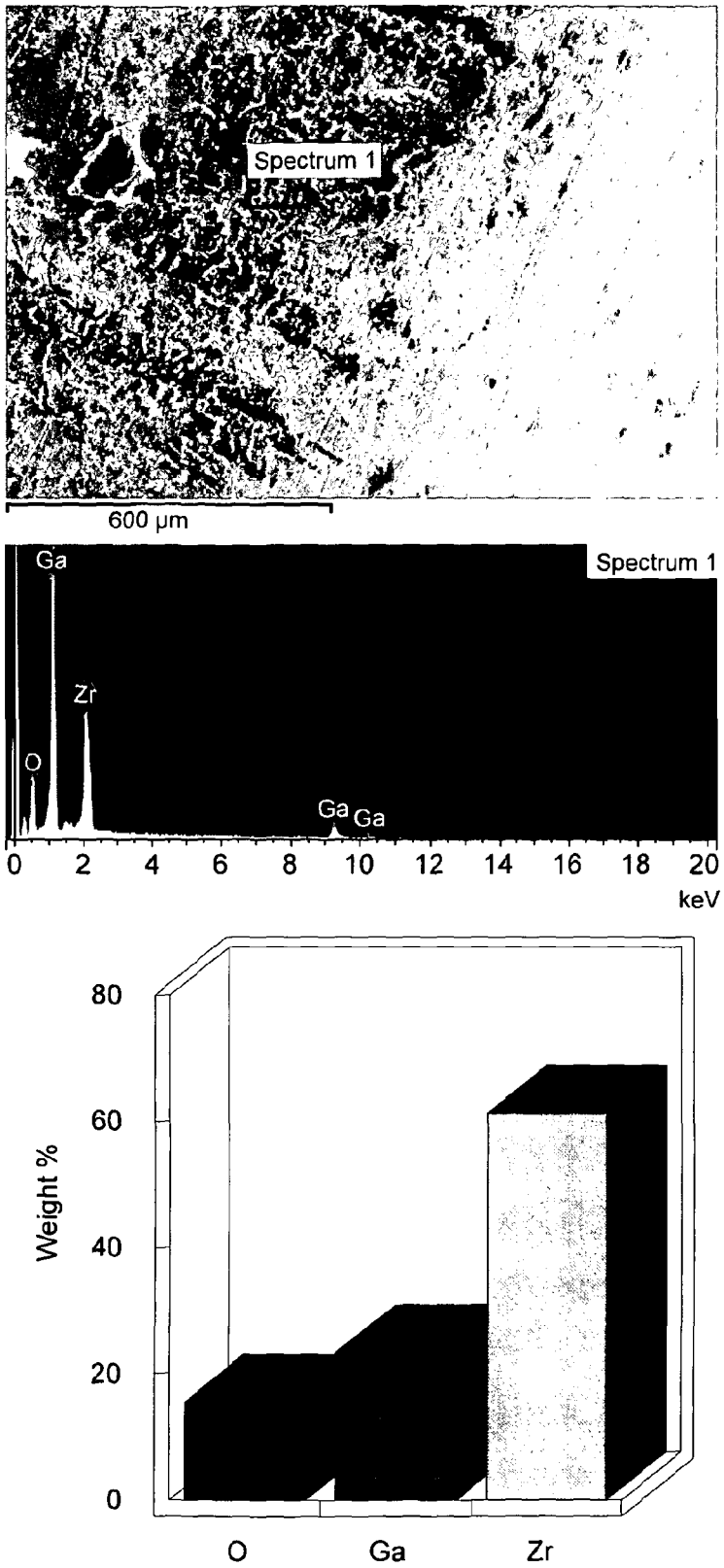
Figure 21:
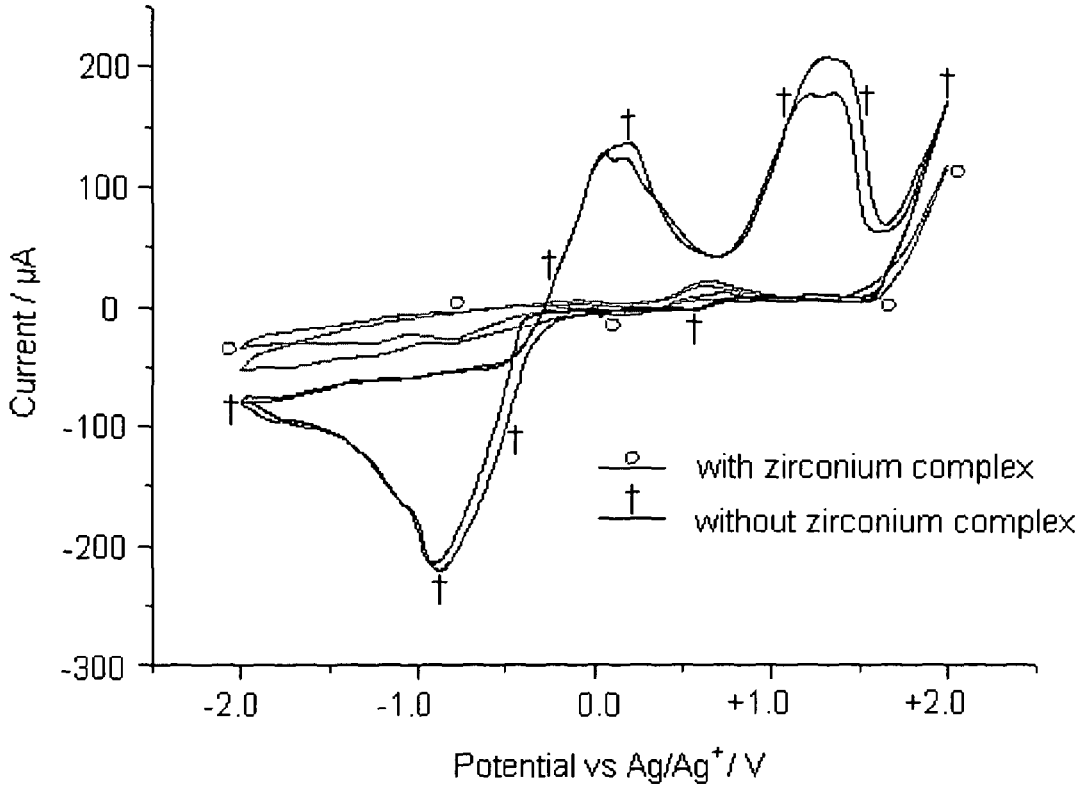
Figure 22:
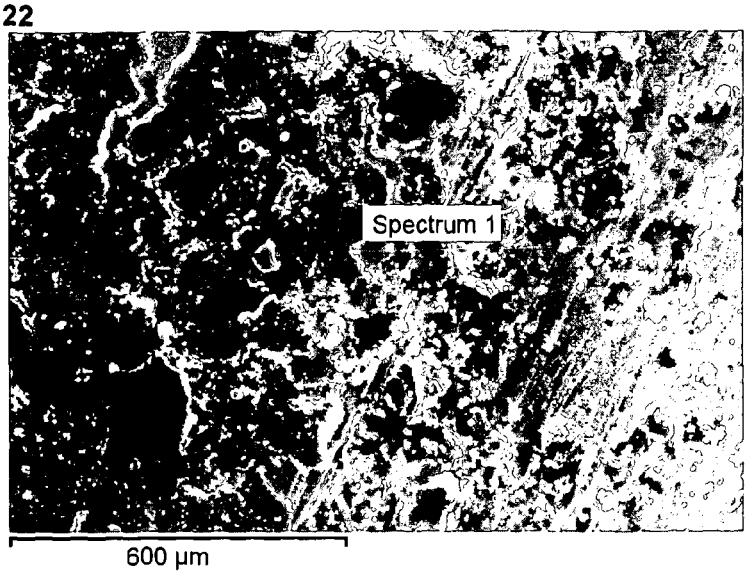
Figure 22:
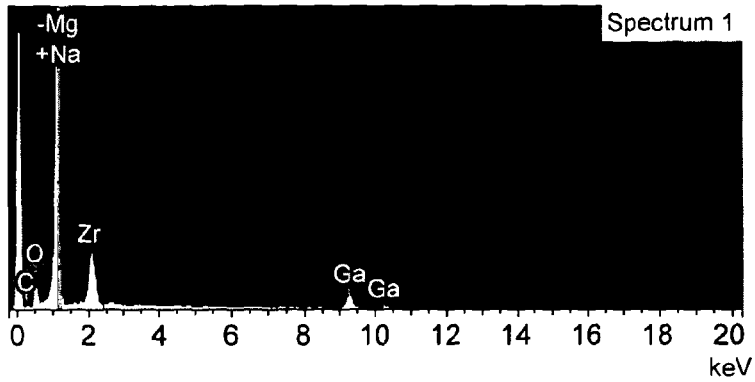
Figure 22:
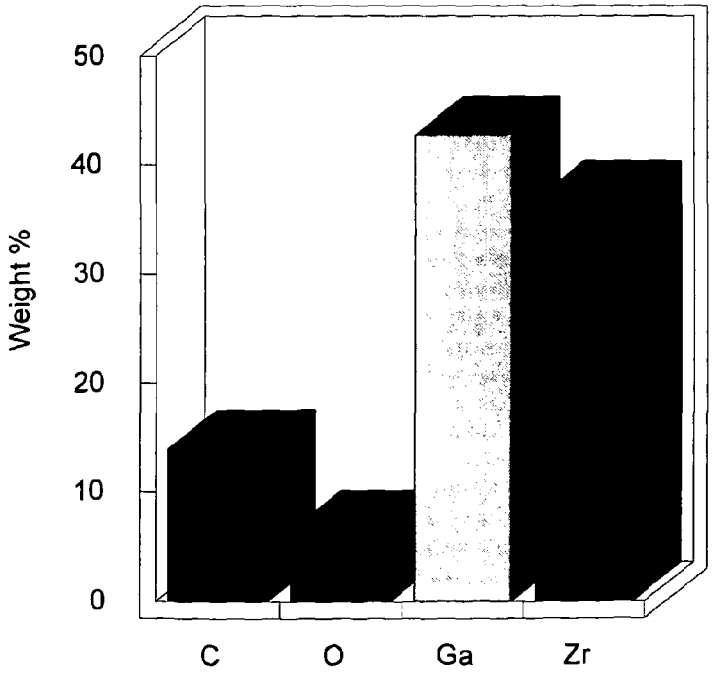
Figure 23:
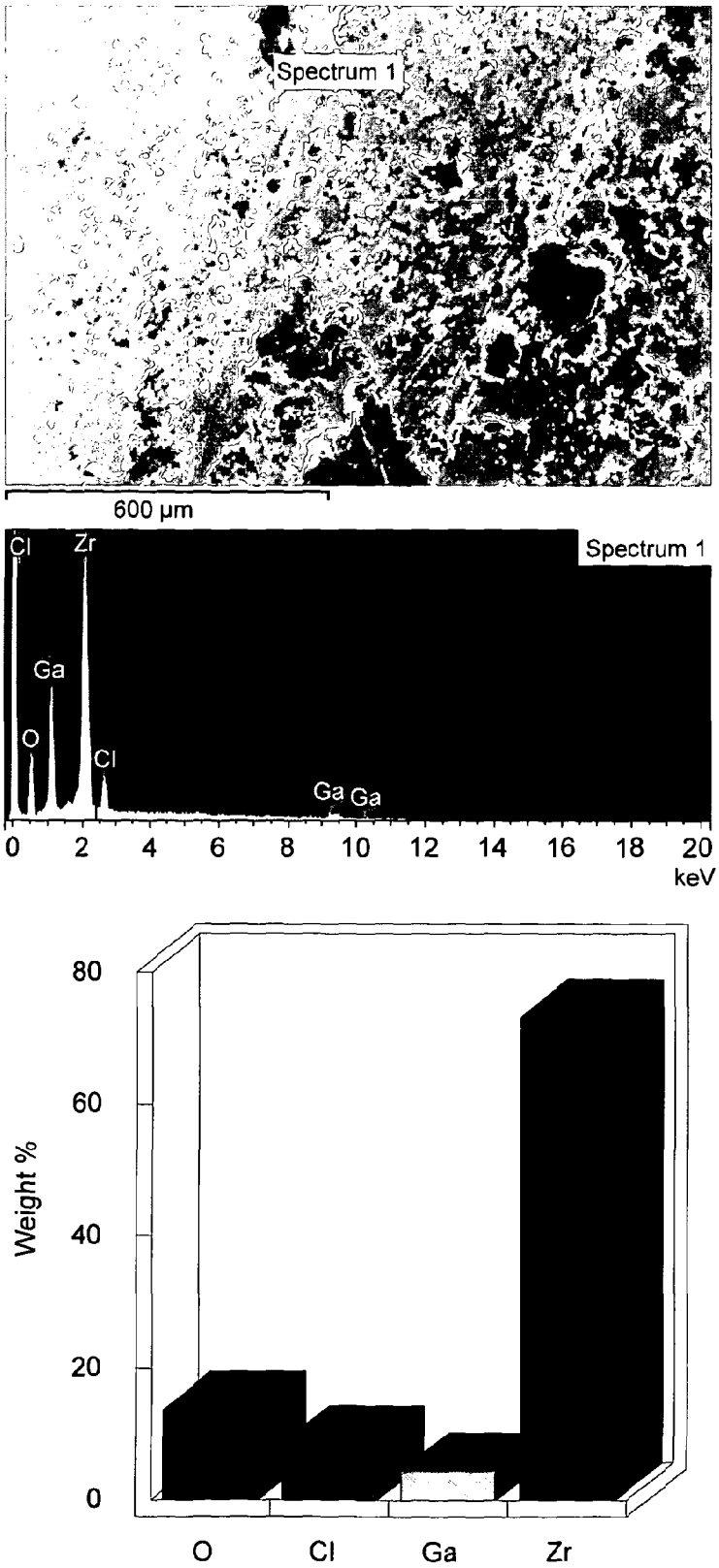
Figure 24:
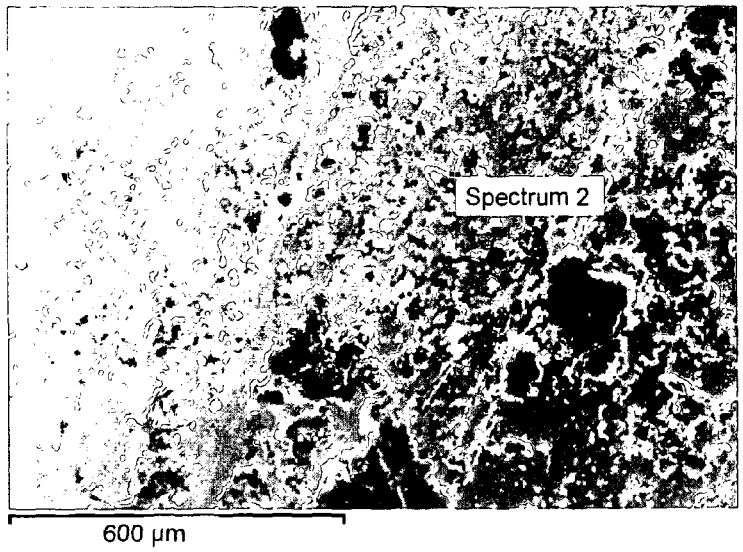
Figure 24:
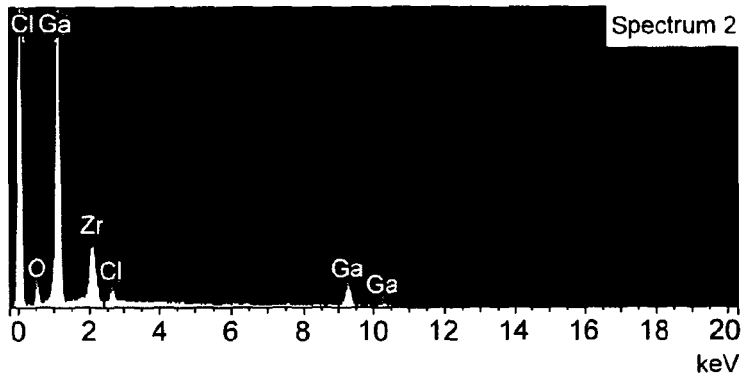
Figure 24:
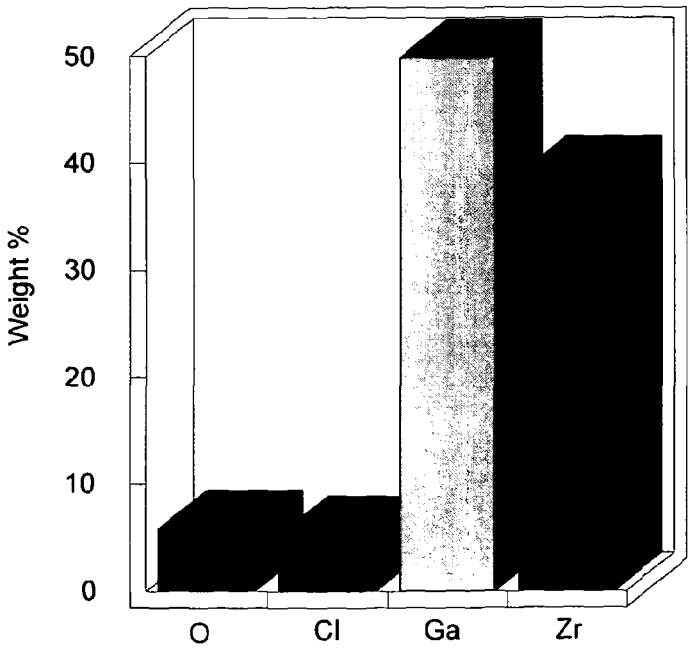
Figure 25:
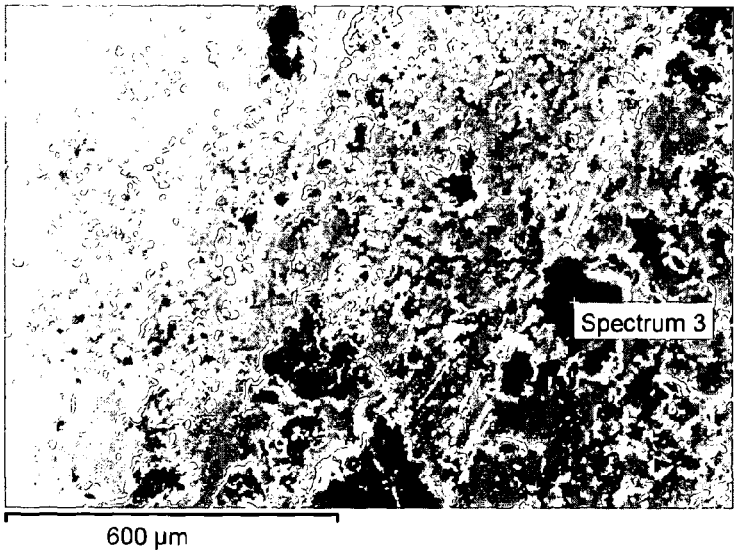
Figure 25:
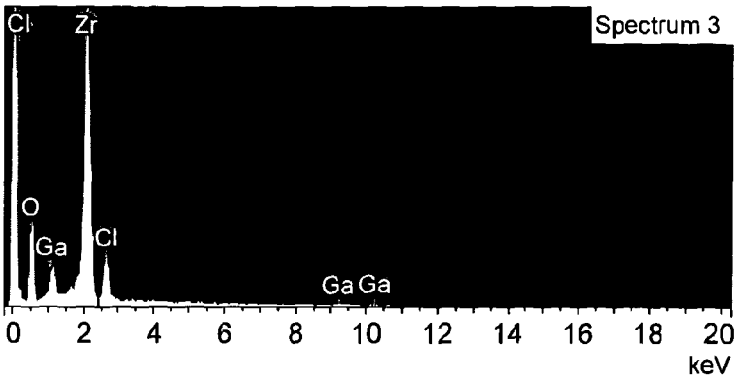
Figure 25:
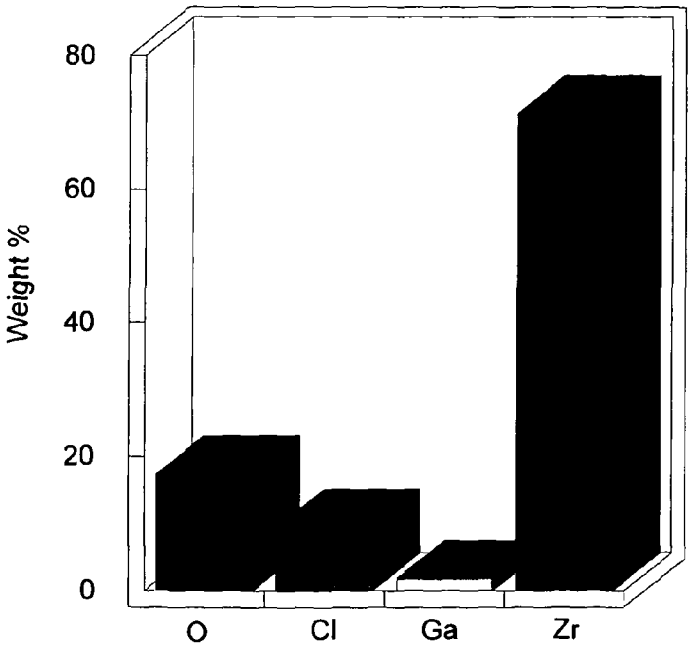
Figure 26:
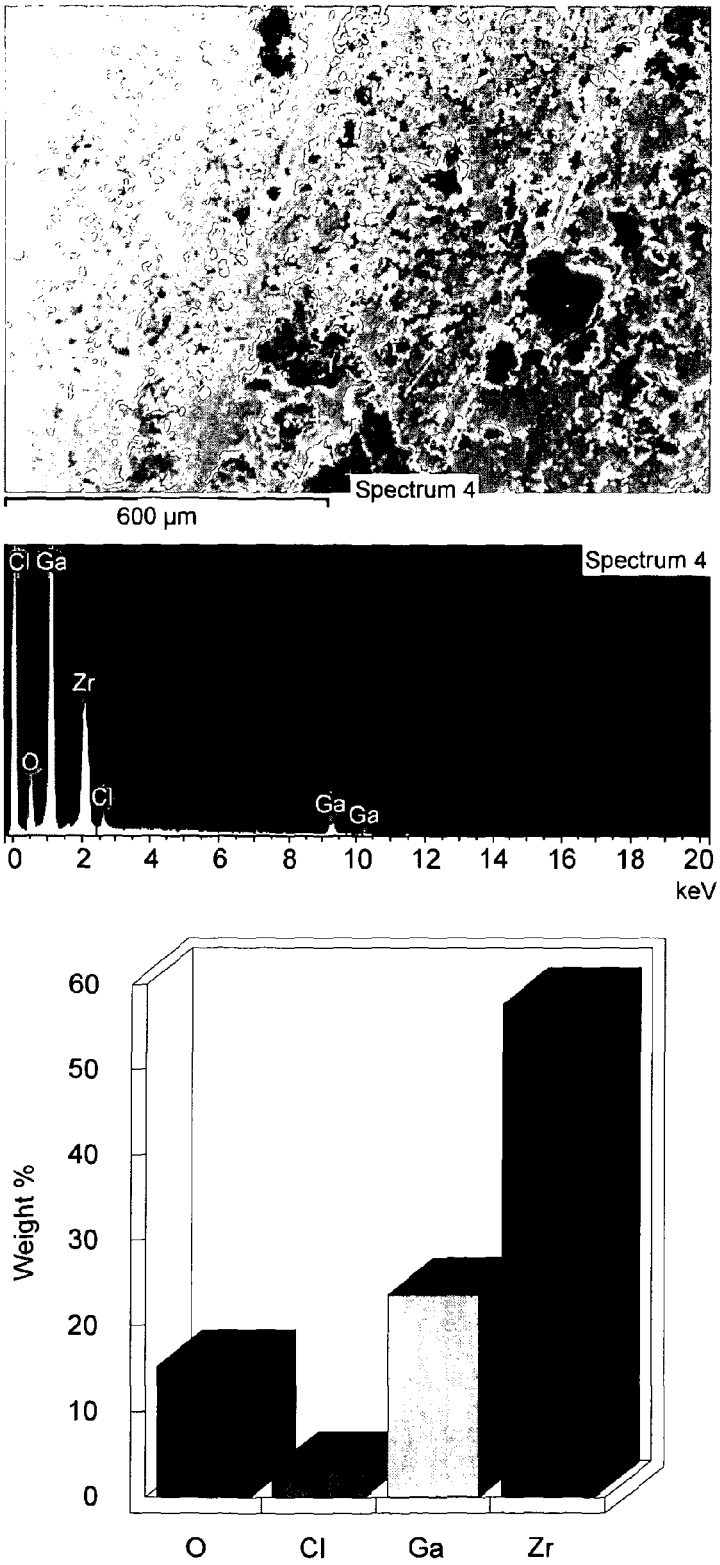
Figure 27:
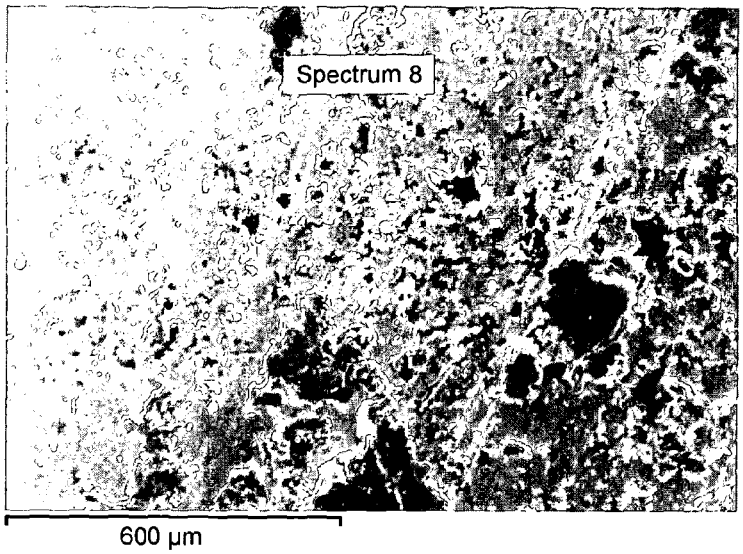
Figure 27:
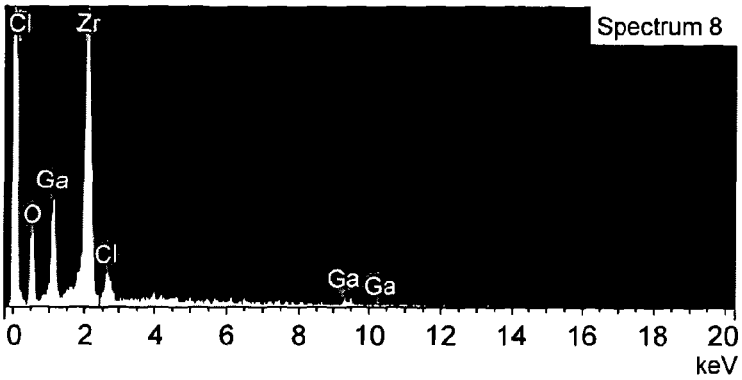
Figure 27:
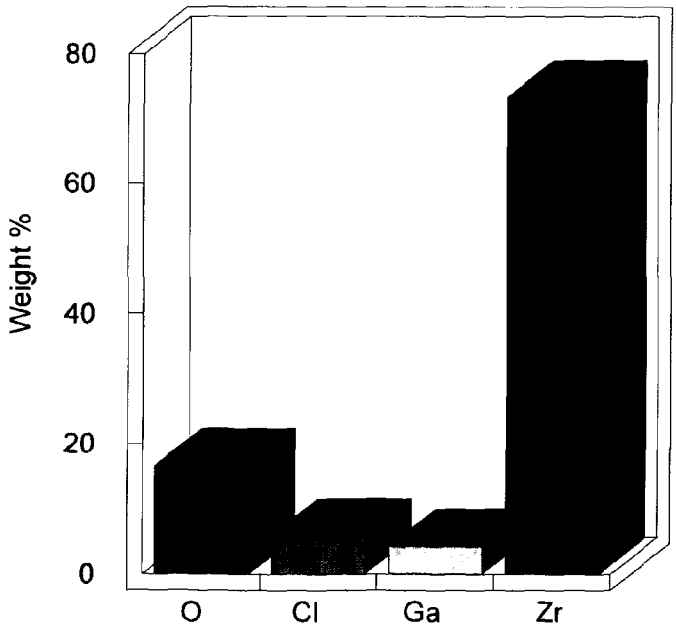
Figure 28:
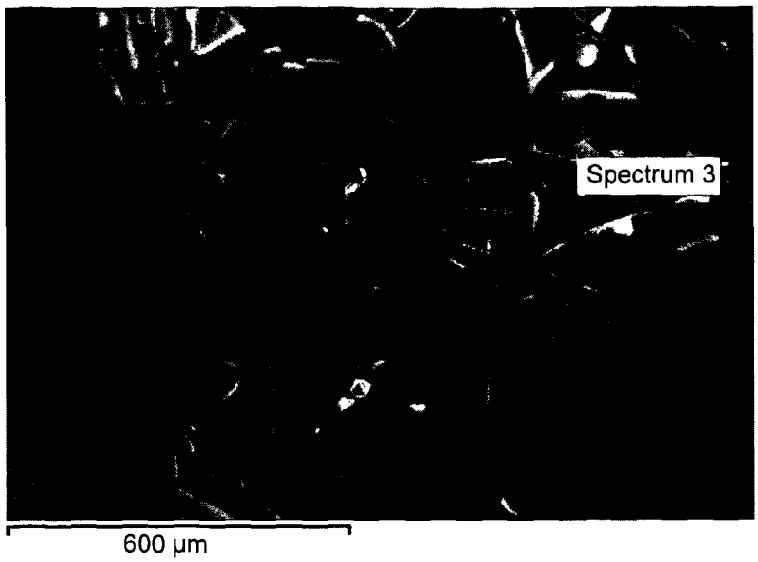
Figure 28:
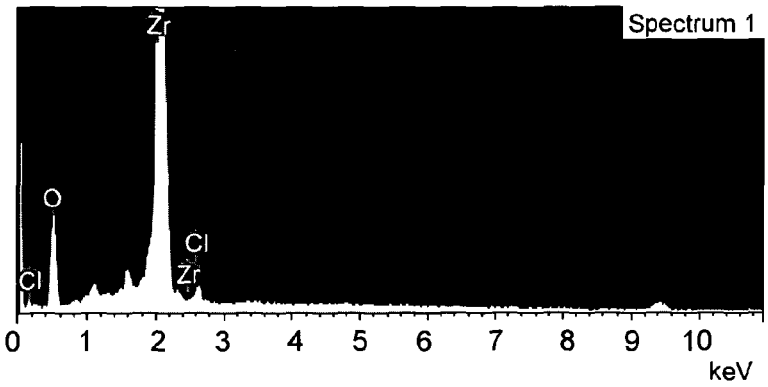
Figure 28:
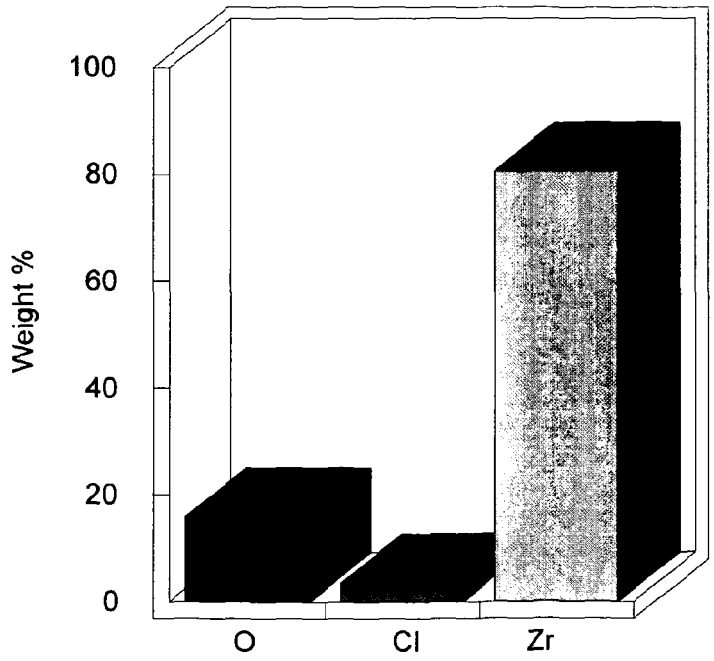
Figure 29:
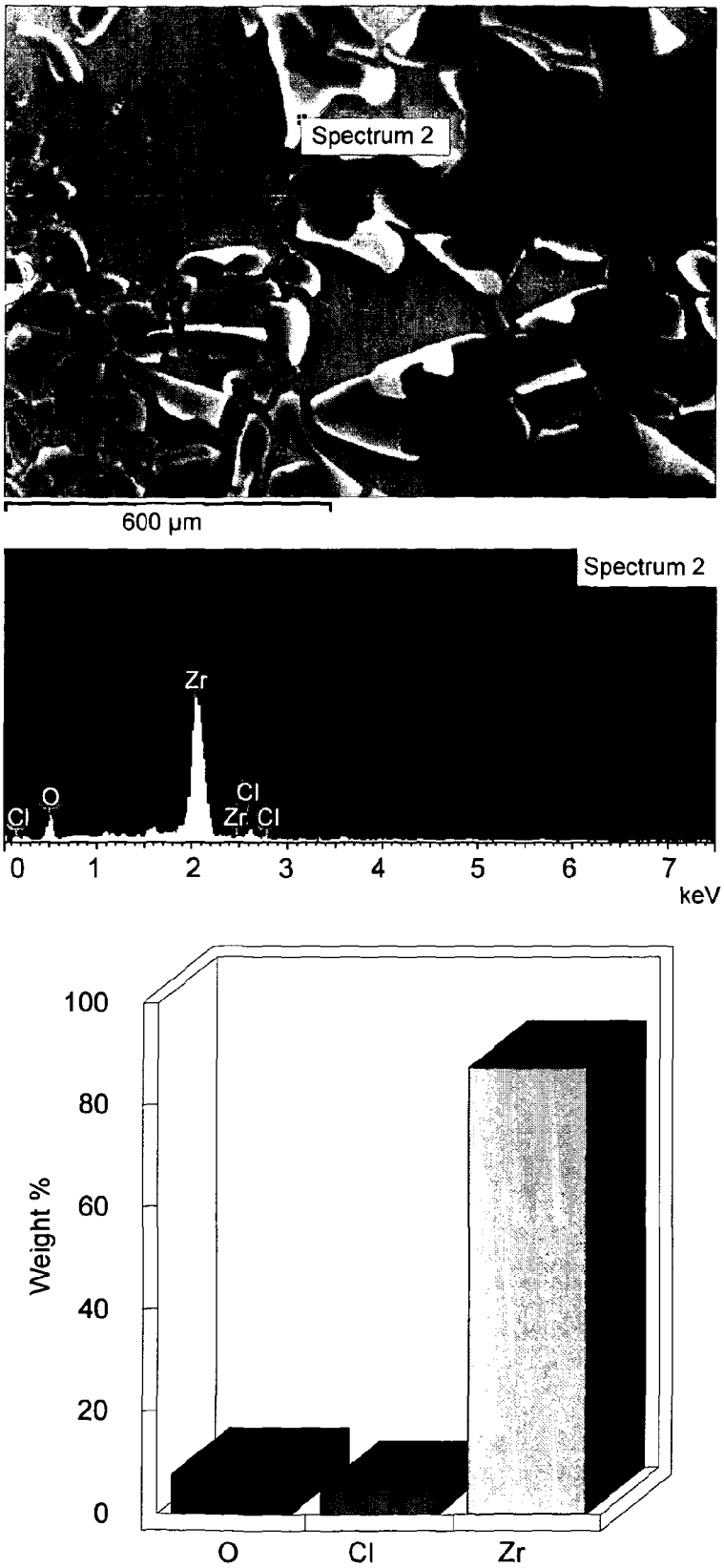
Figure 30:
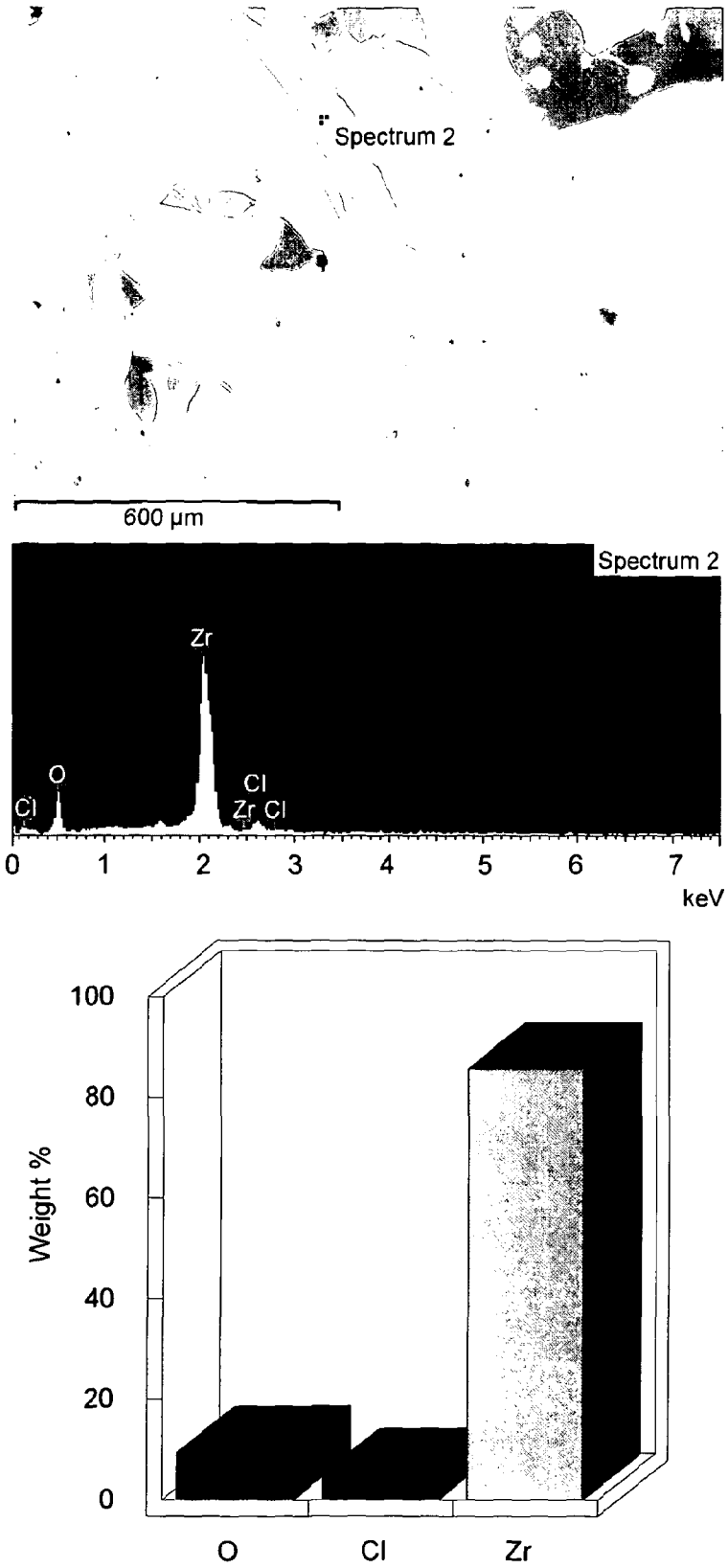
Figure 31:
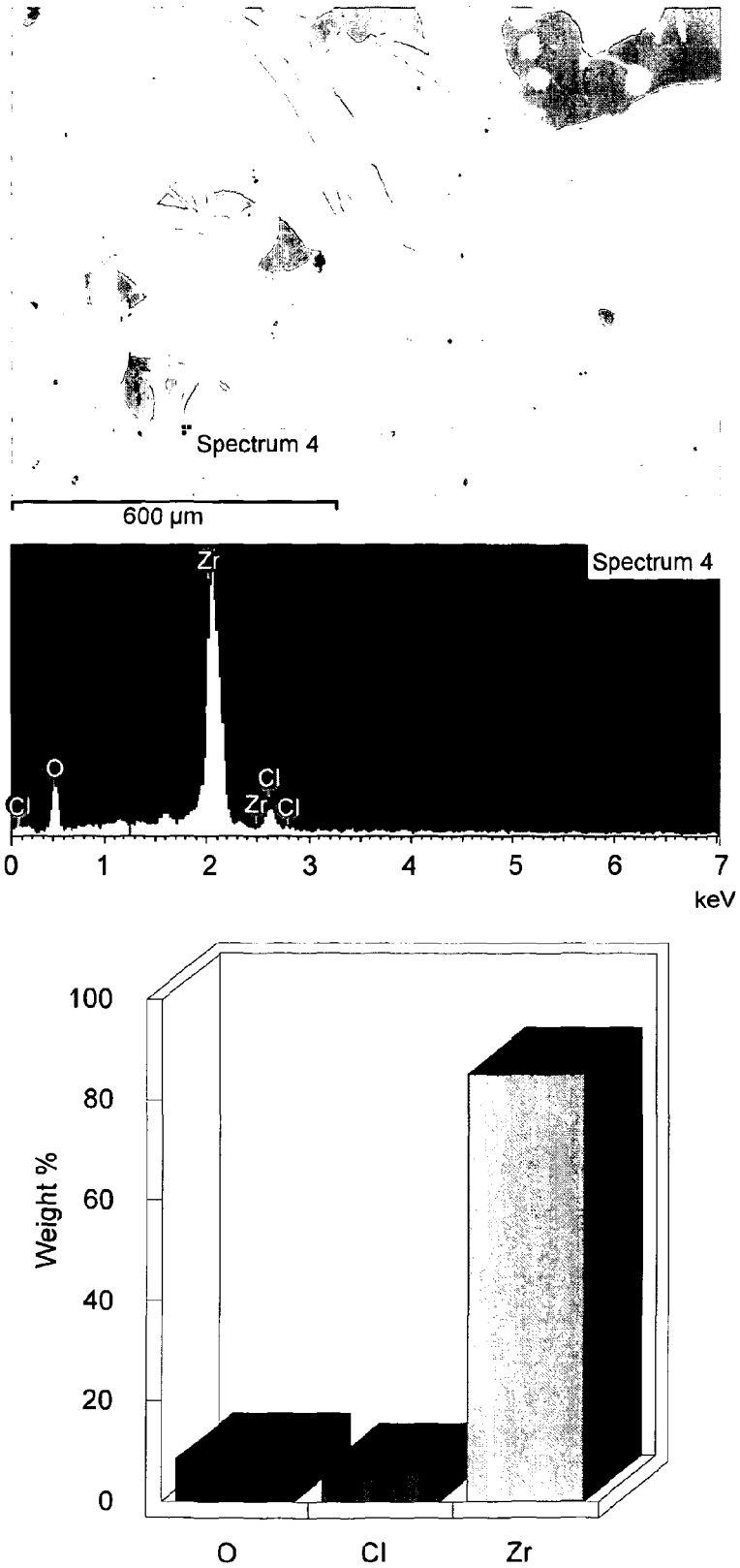
Figure 32:
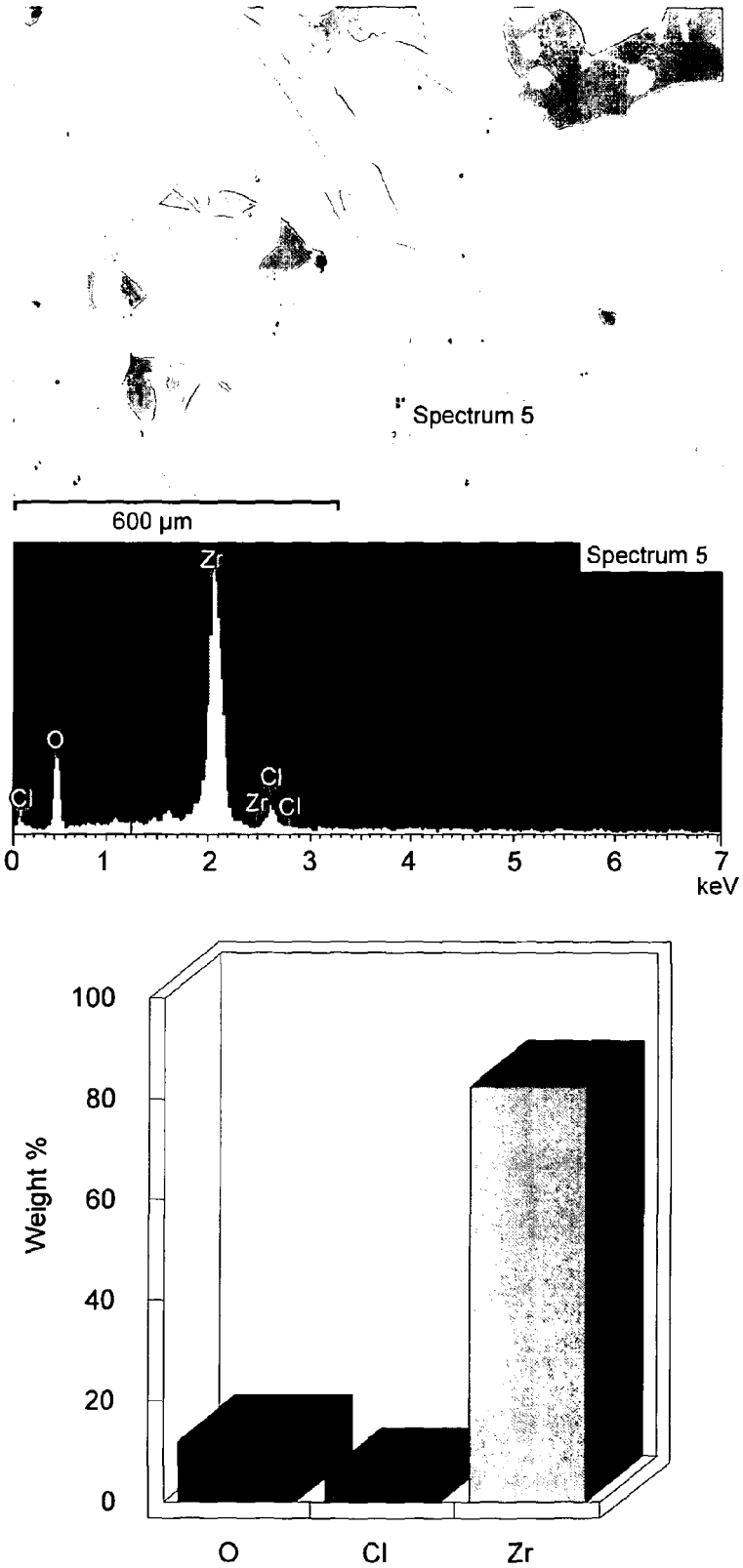
Figure 33:
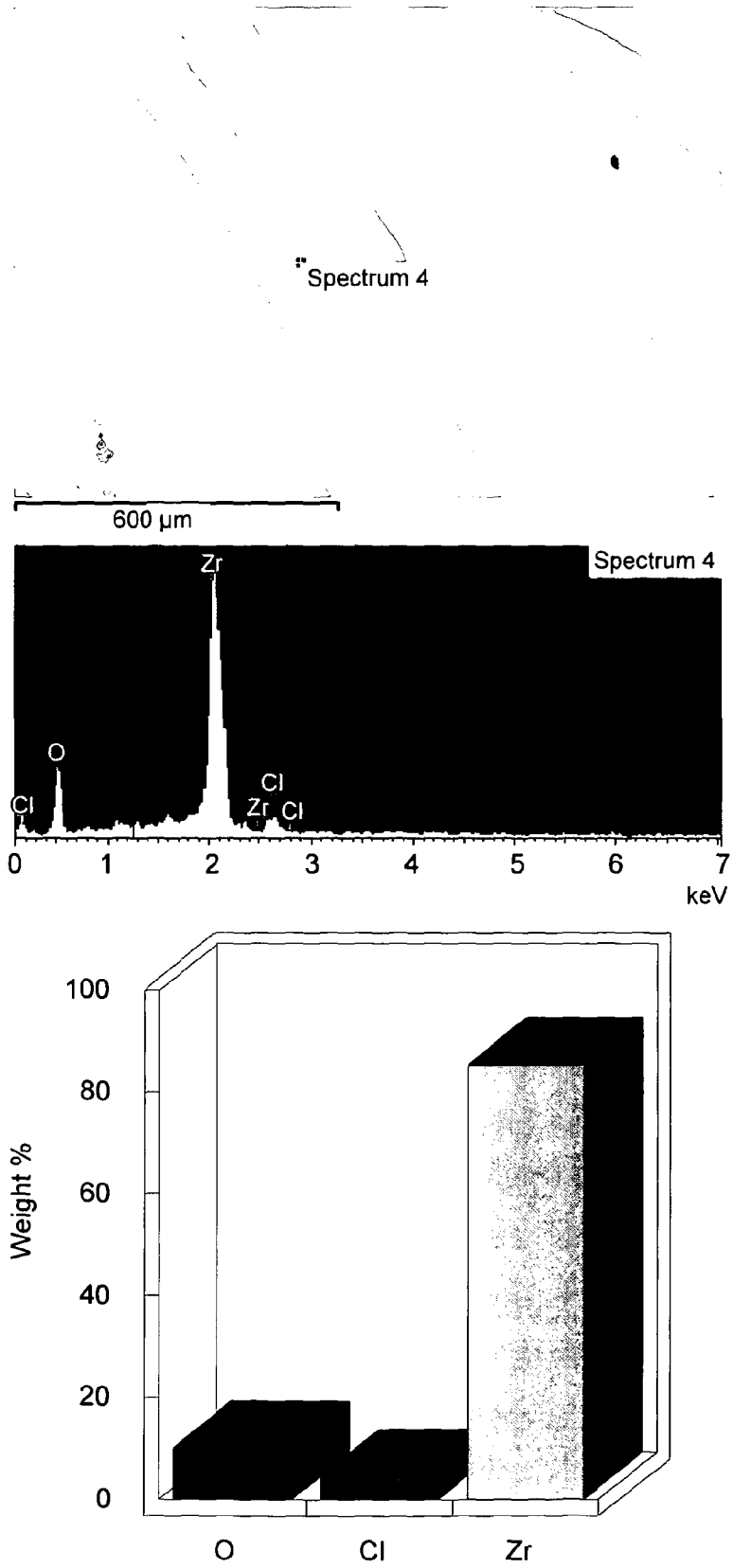
Figure 34:
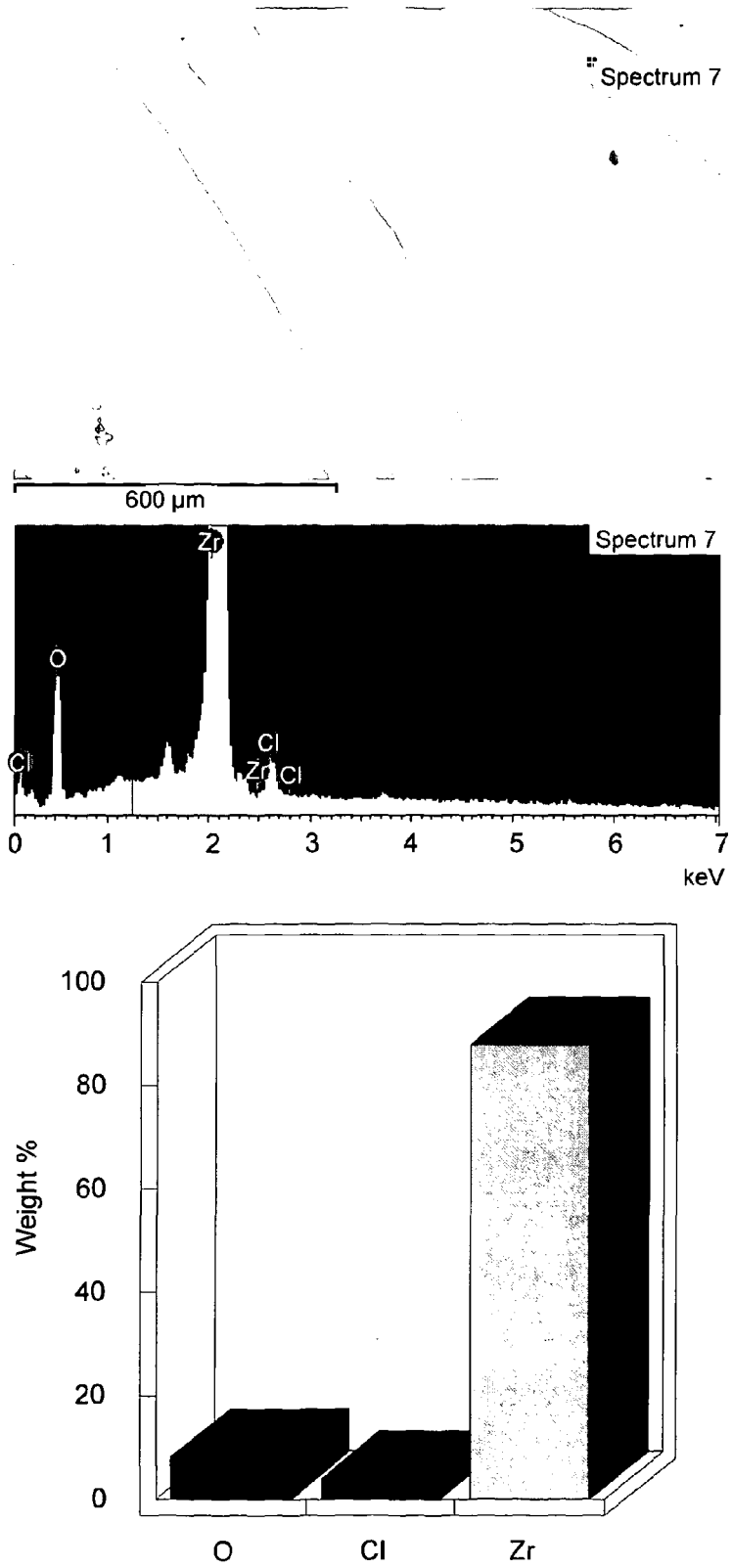
Figure 35:
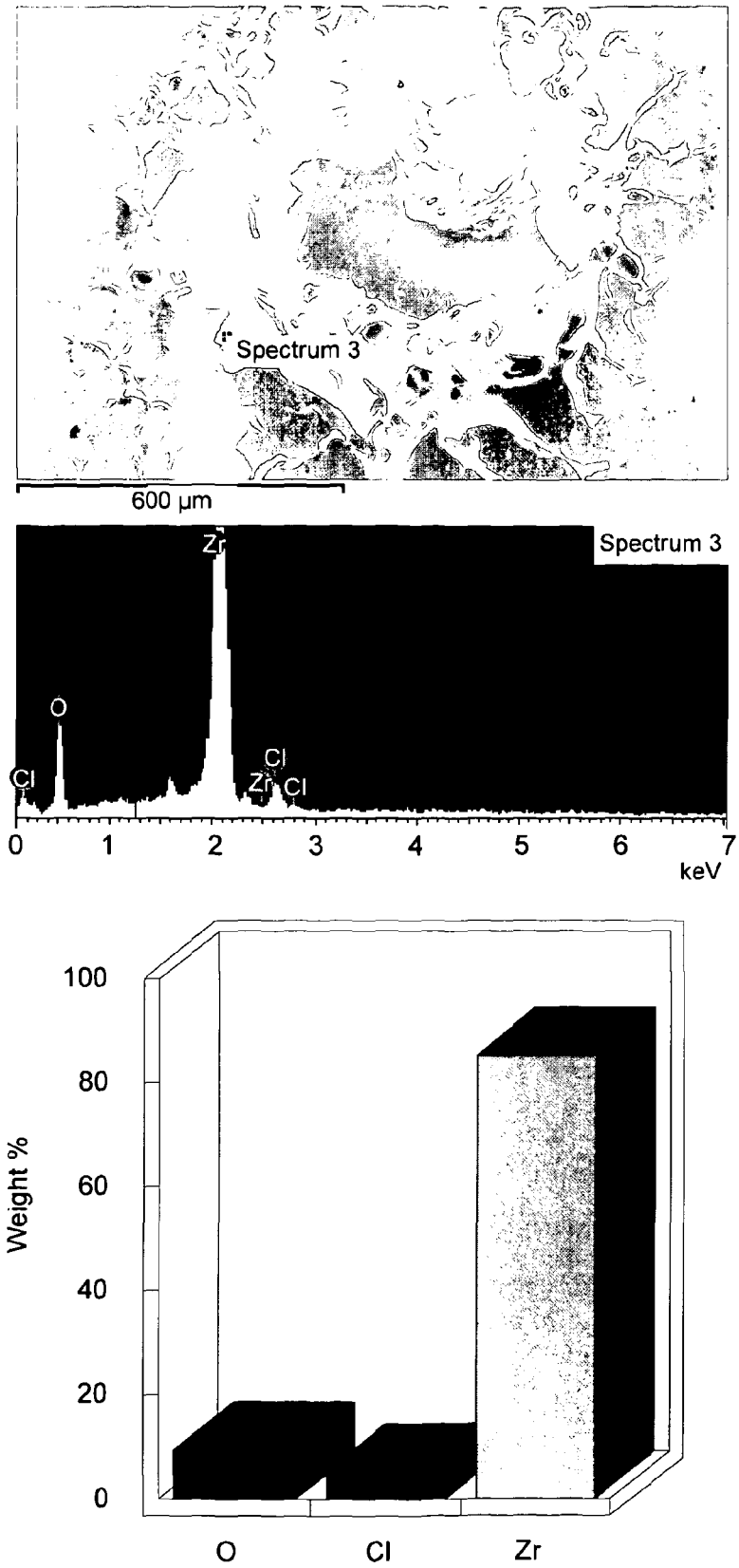
Figure 36:
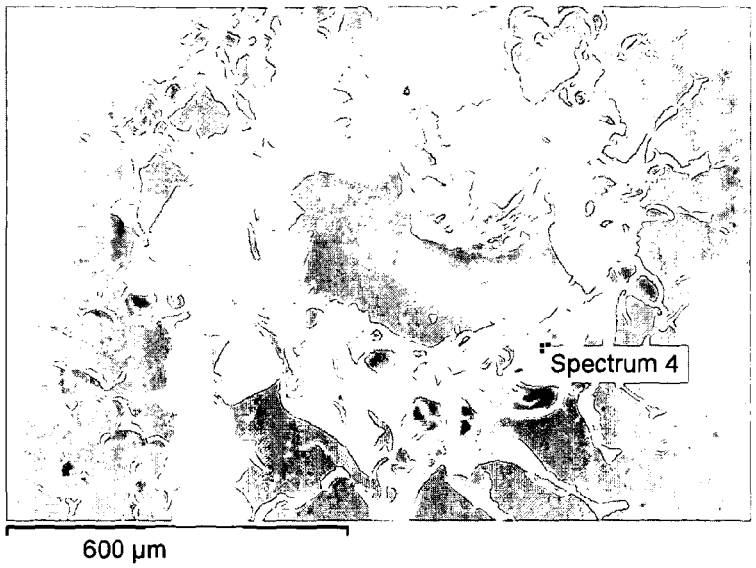
Figure 36:
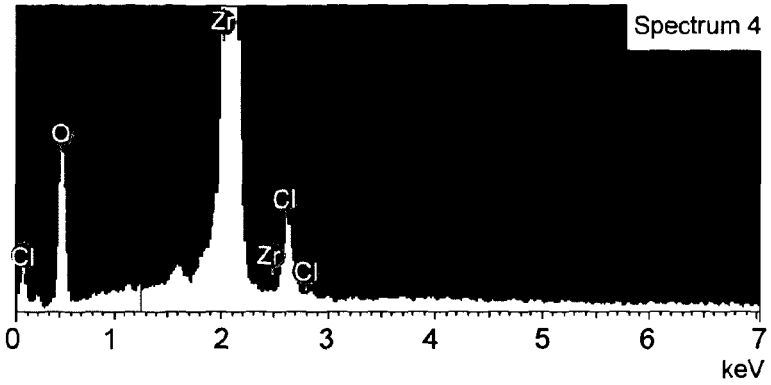
Figure 36:
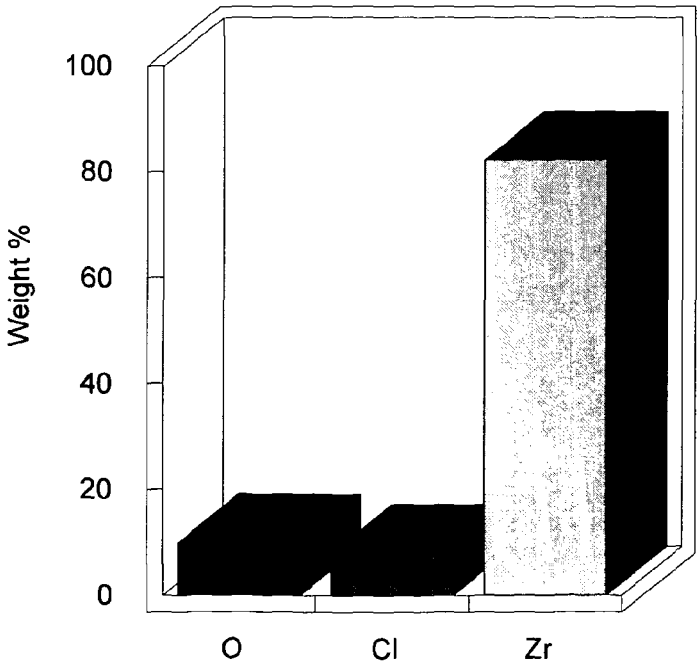
Figure 37:
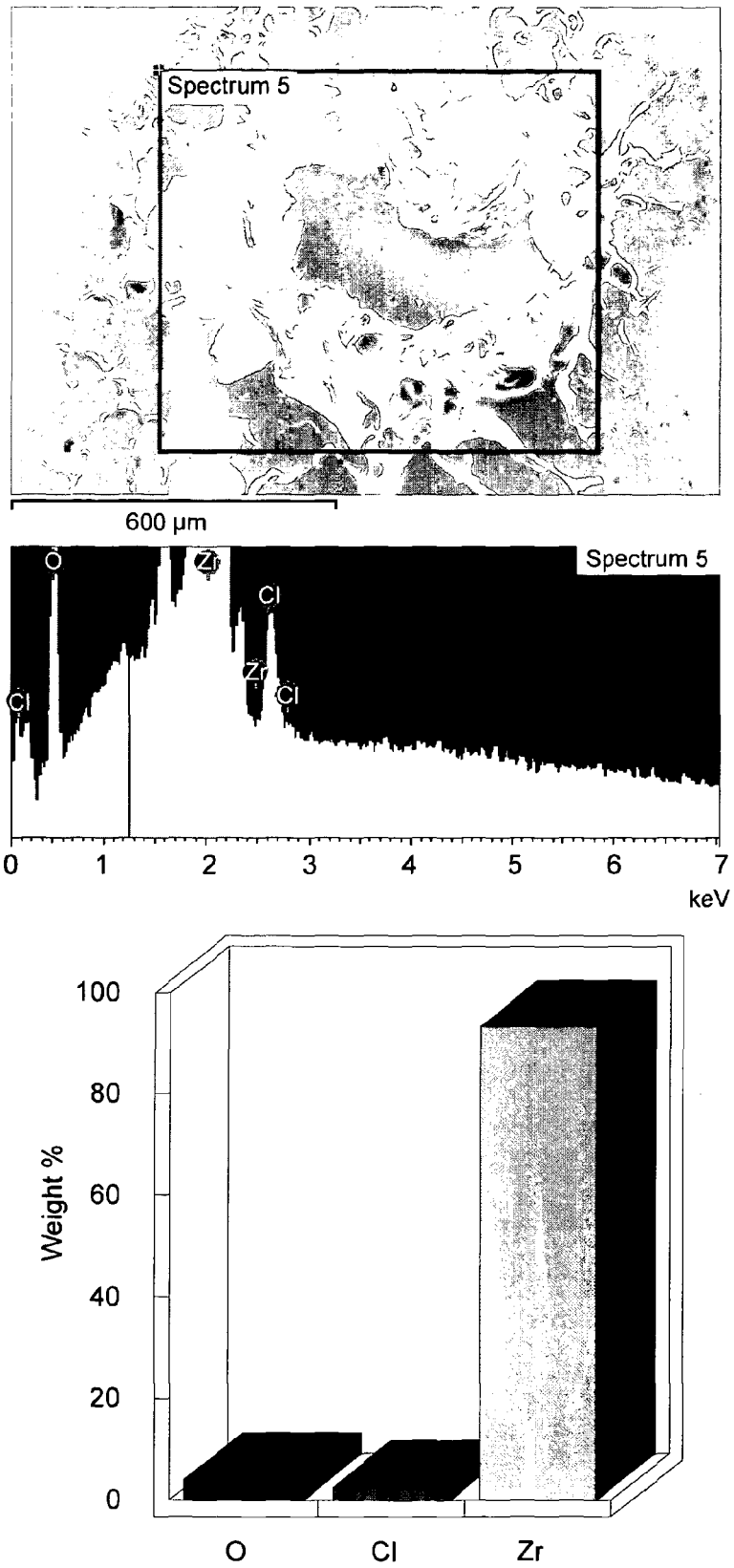
Figure 38:
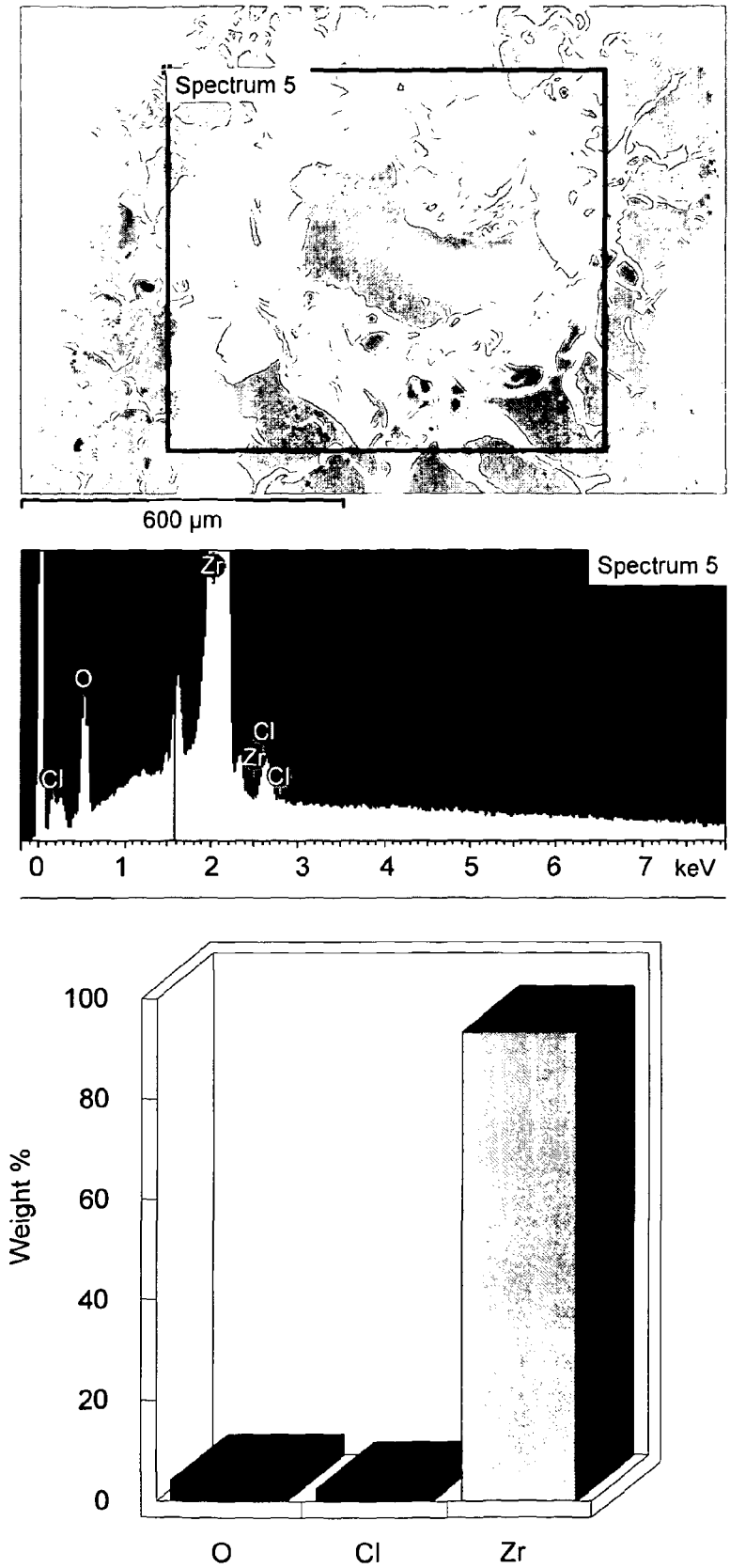
Figure 39:
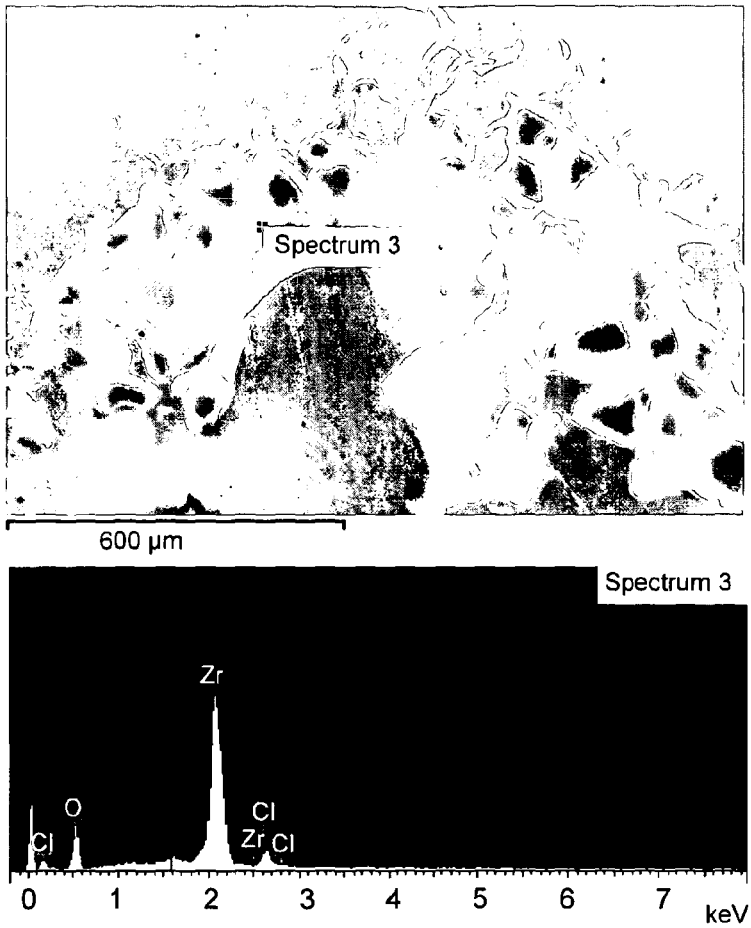
Figure 39:
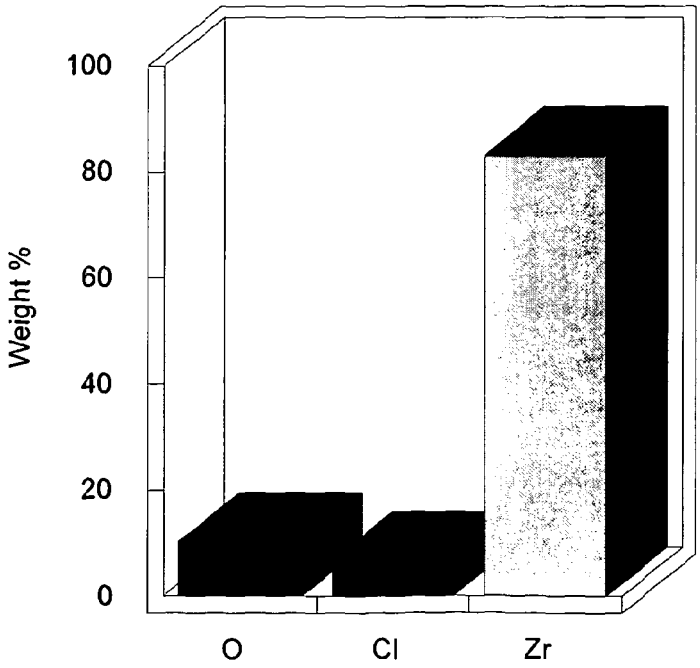
Figure 40:
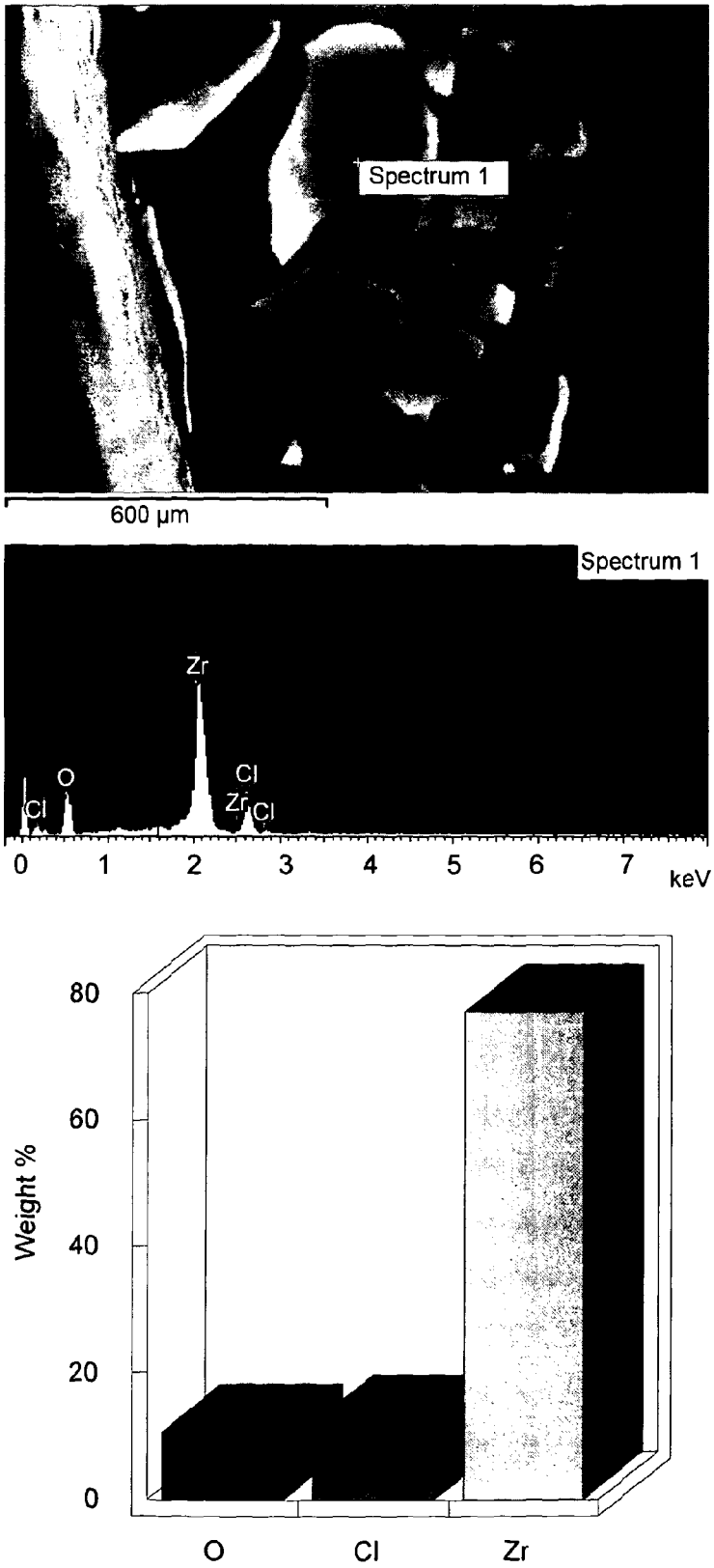
Figure 41:
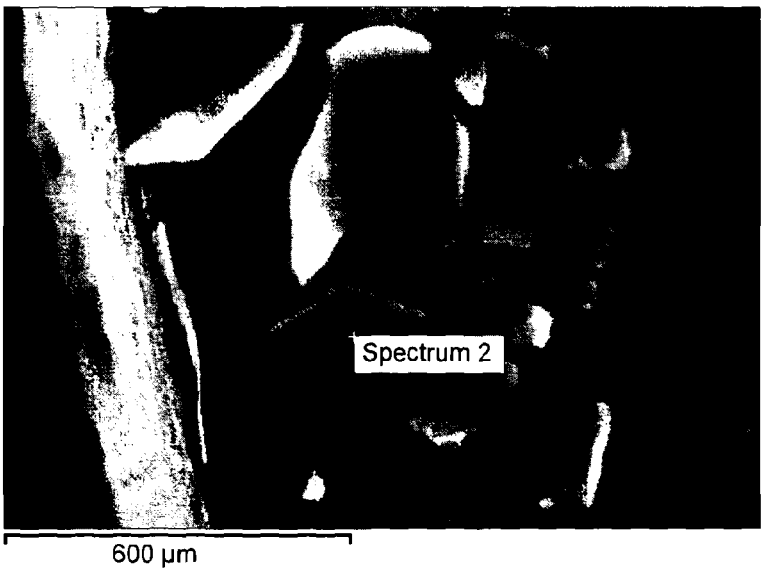
Figure 41:
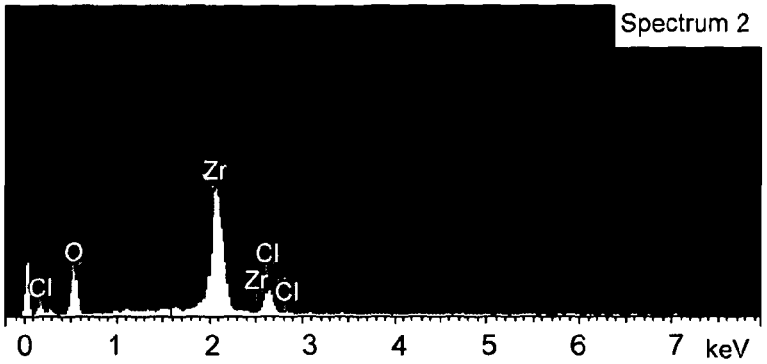
Figure 41:
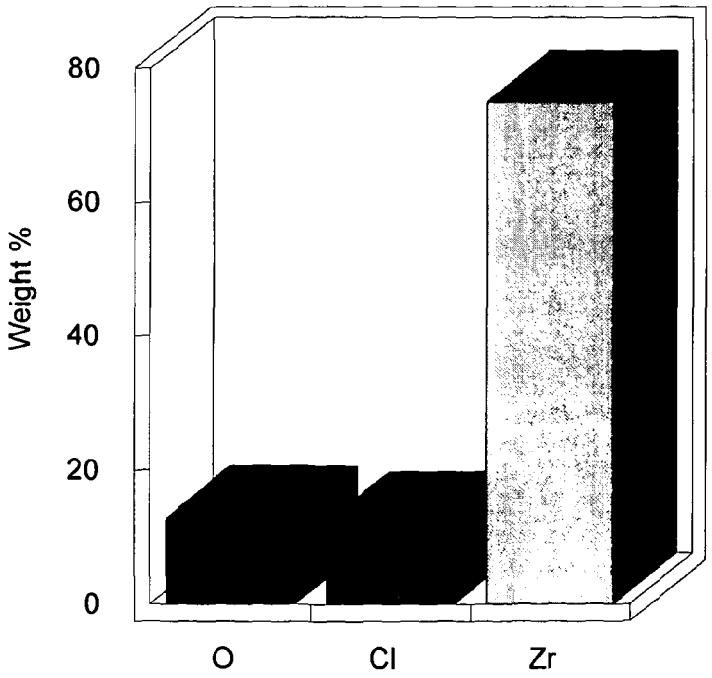
Figure 42:
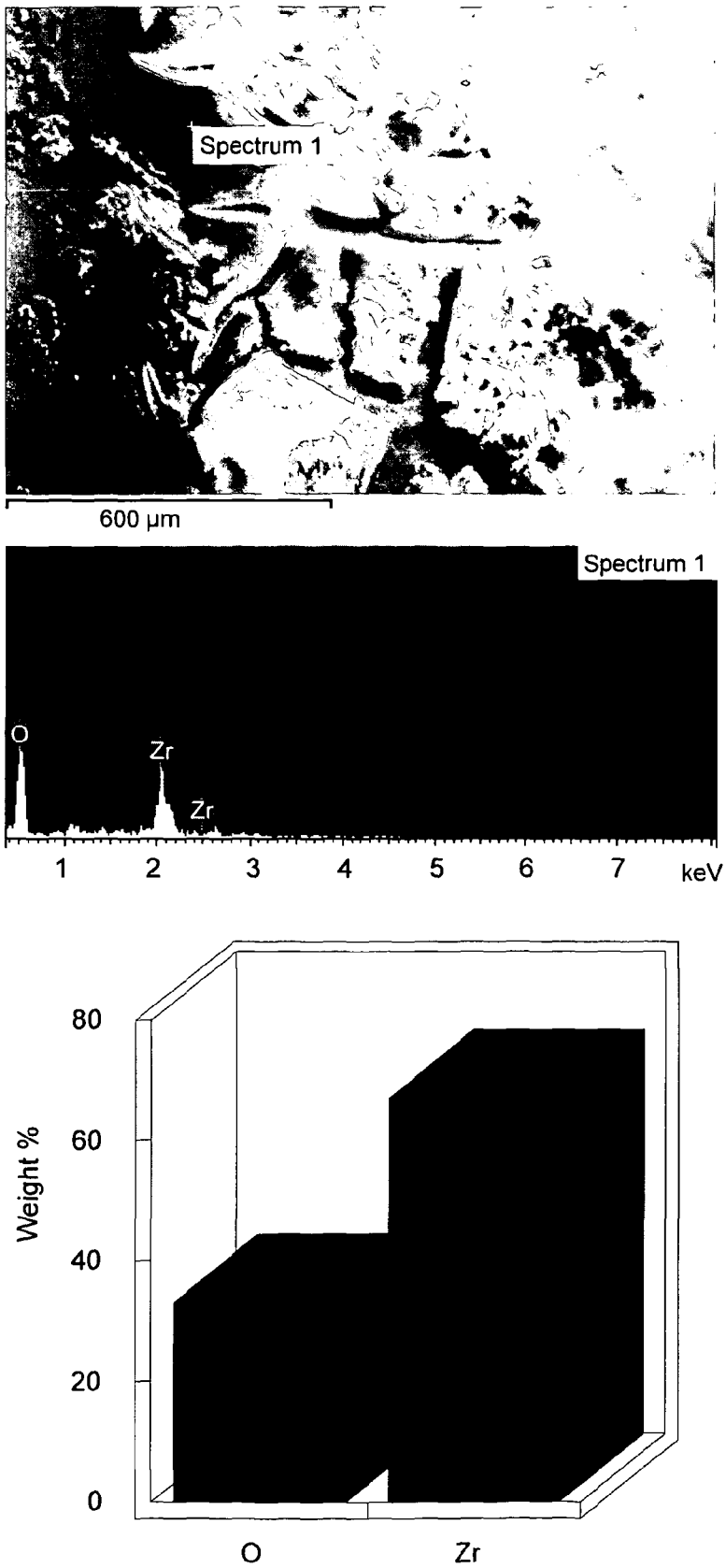
Figure 43:
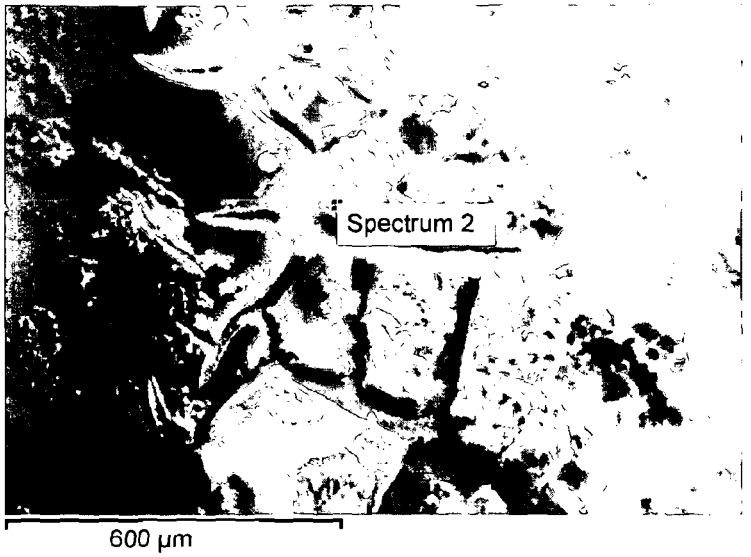
Figure 43:
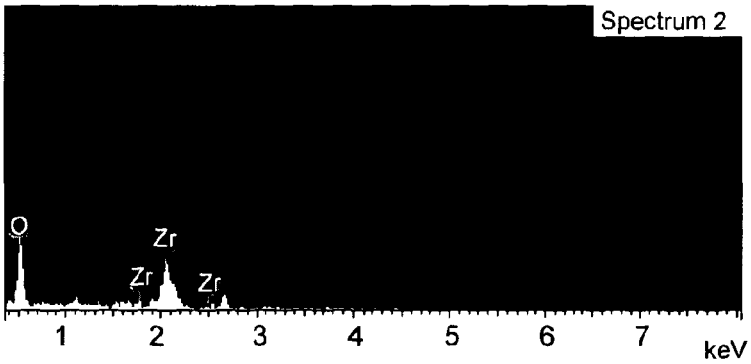
Figure 43:
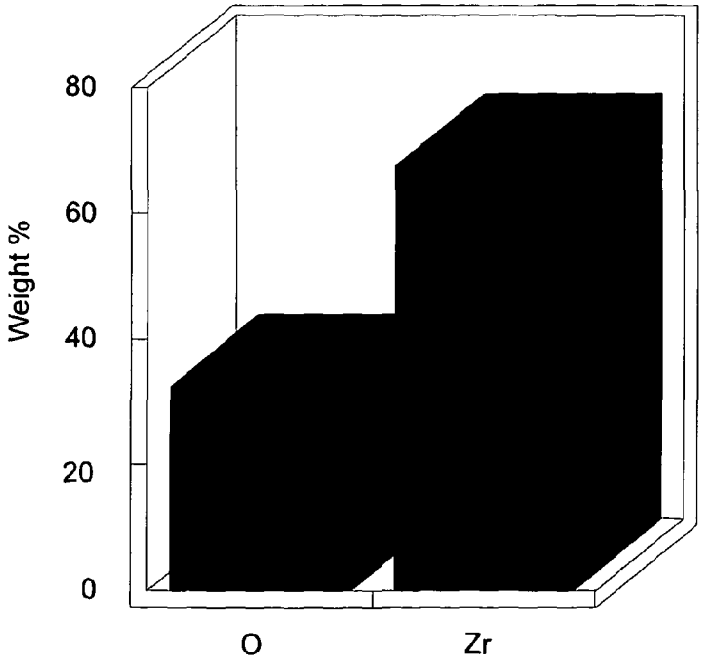
Figure 44:
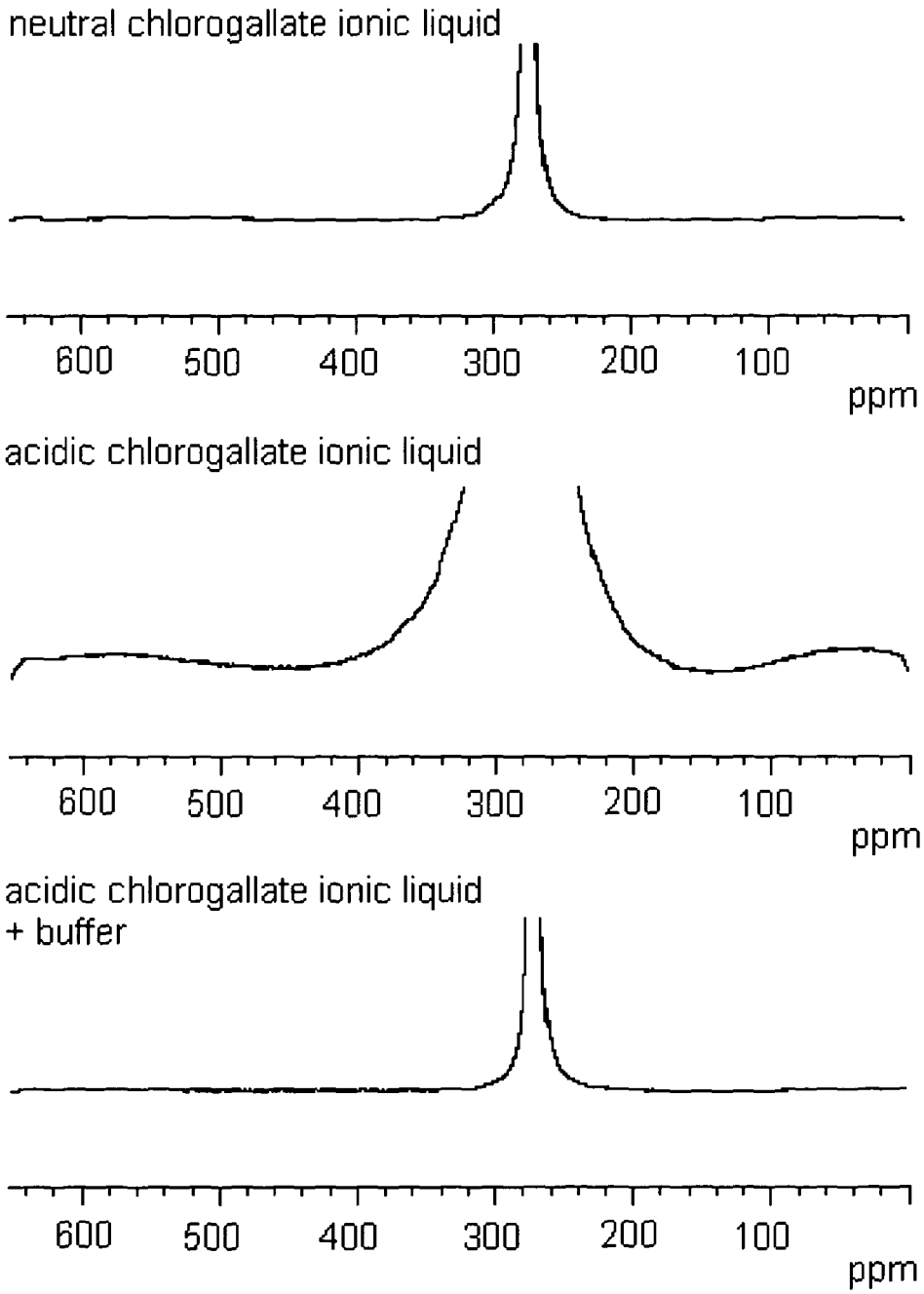
Figure 45:
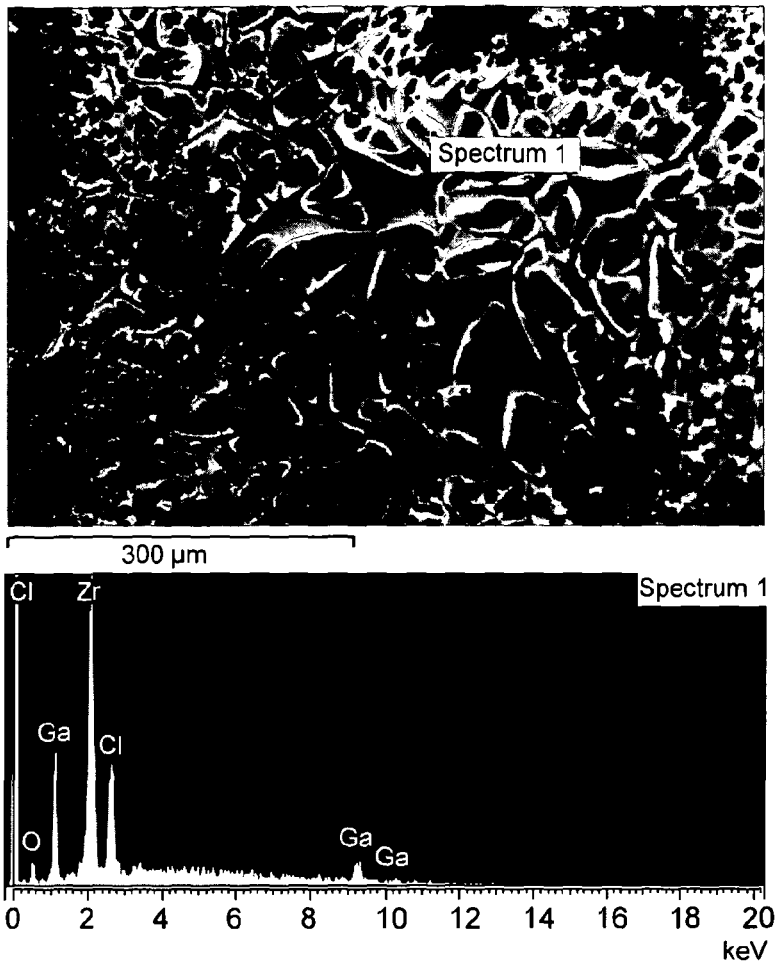
Figure 45:
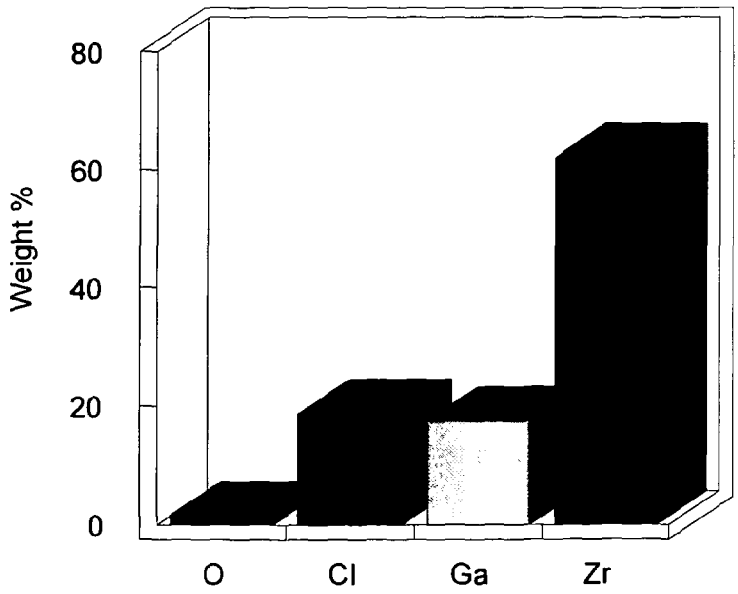
Figure 46:
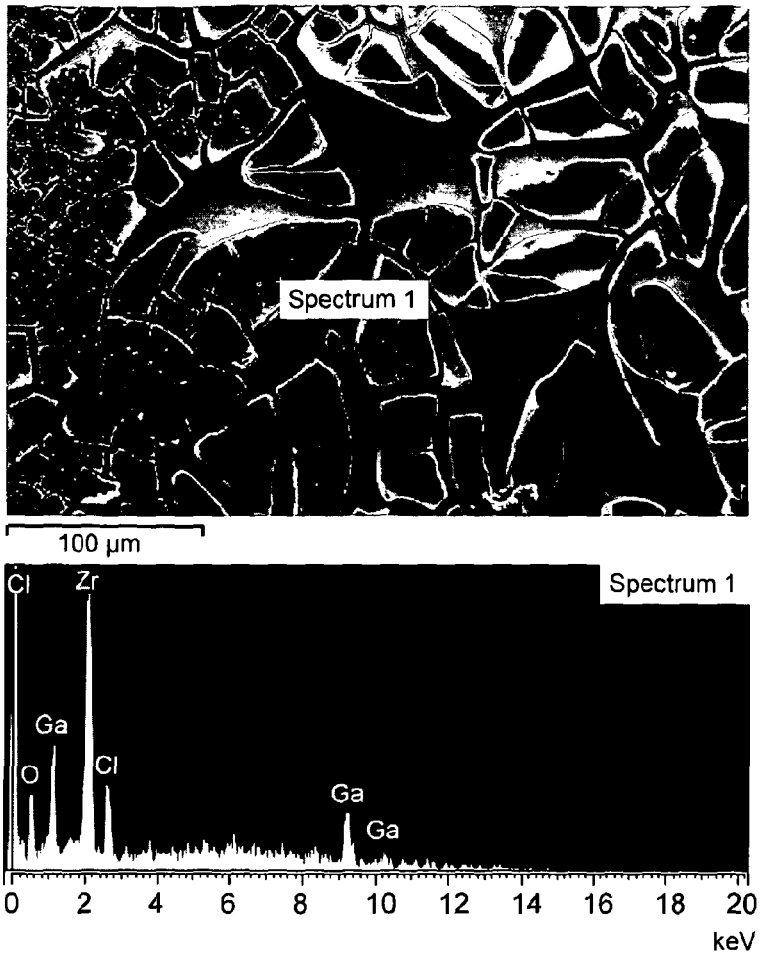
Figure 46:
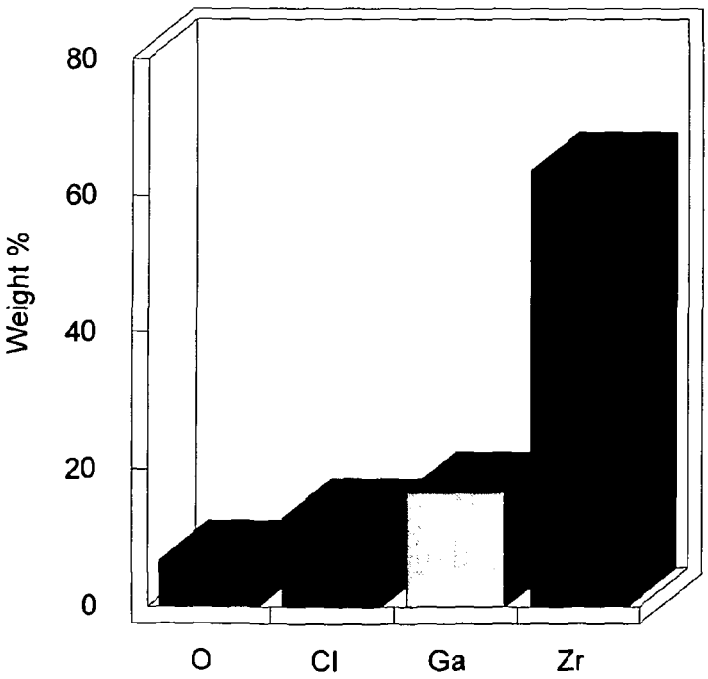
Figure 47:
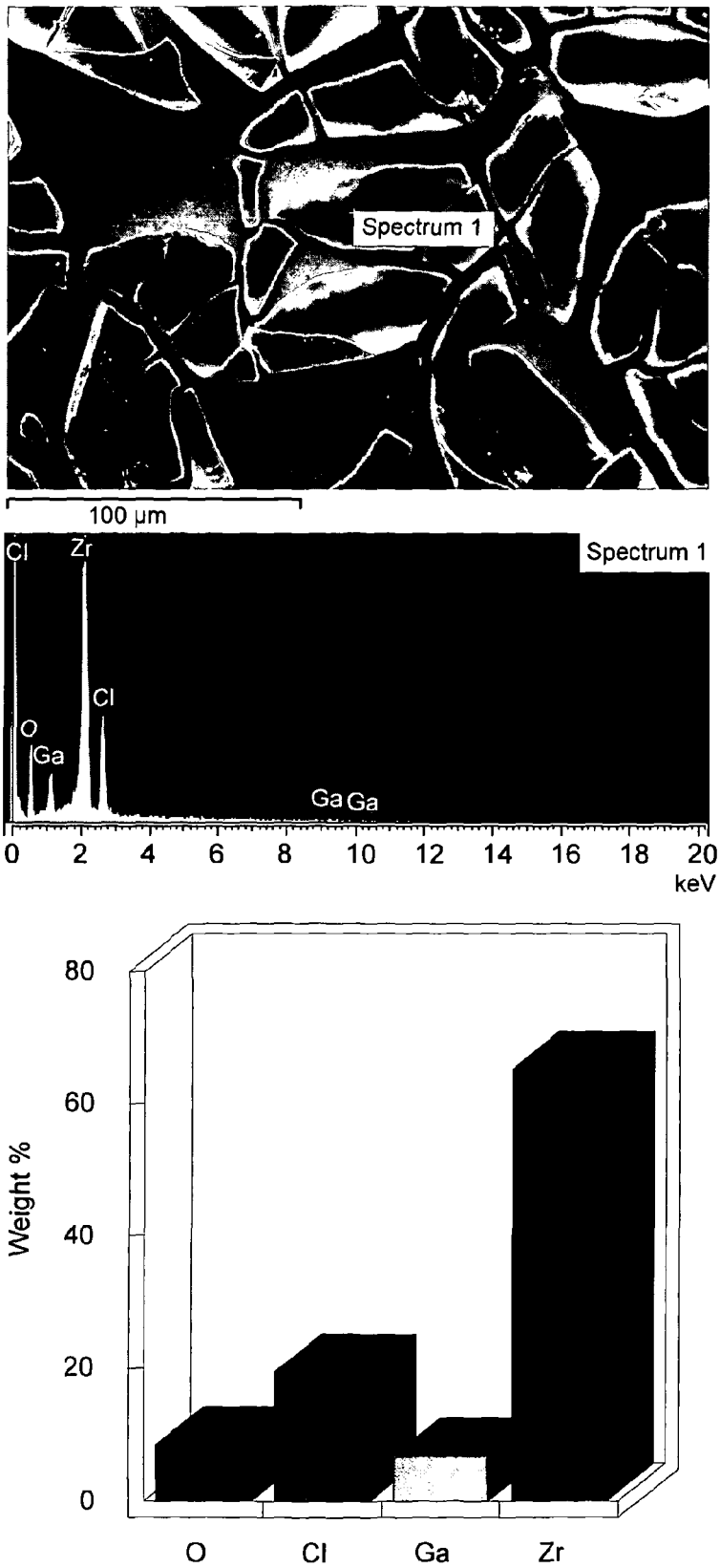
Figure 48:
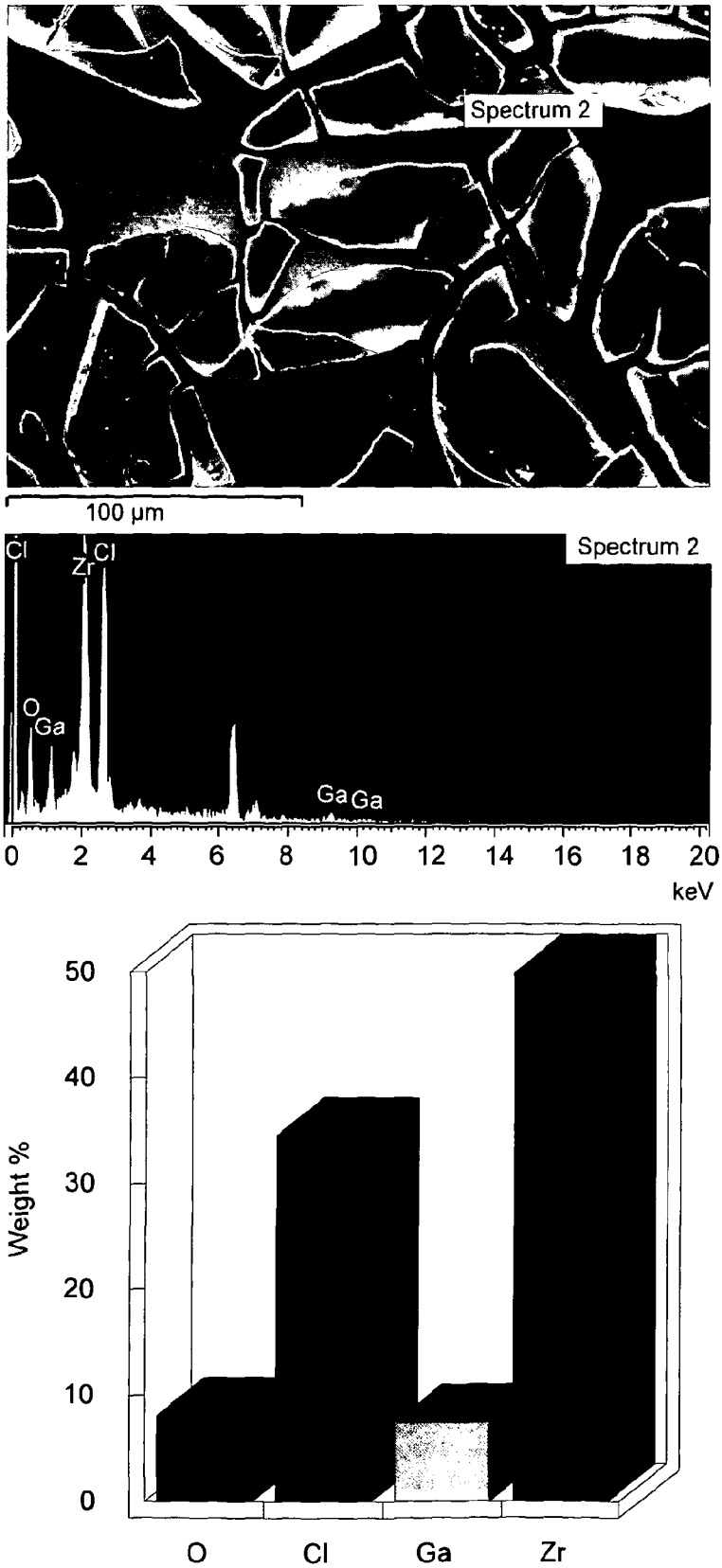
Figure 49:
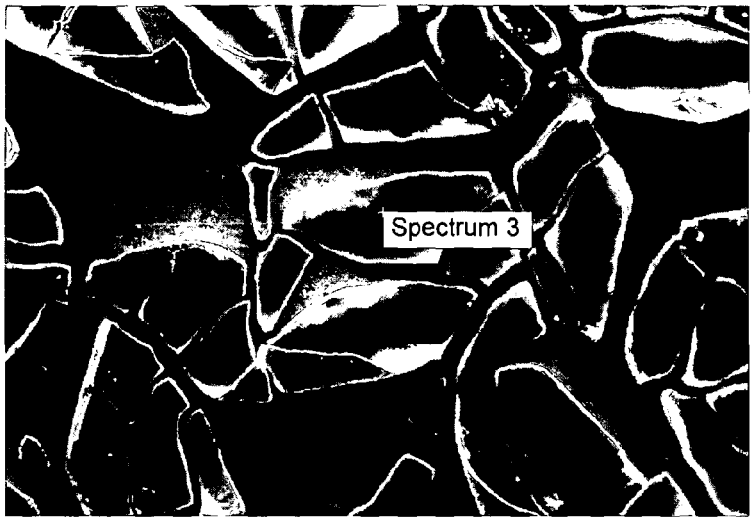
Figure 49:
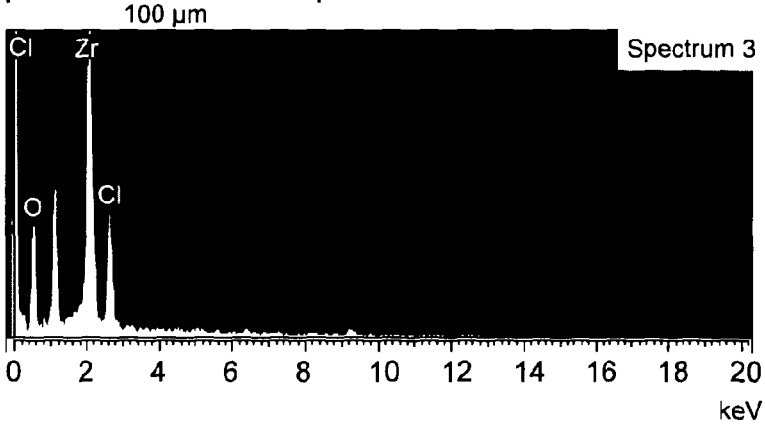
Figure 49:
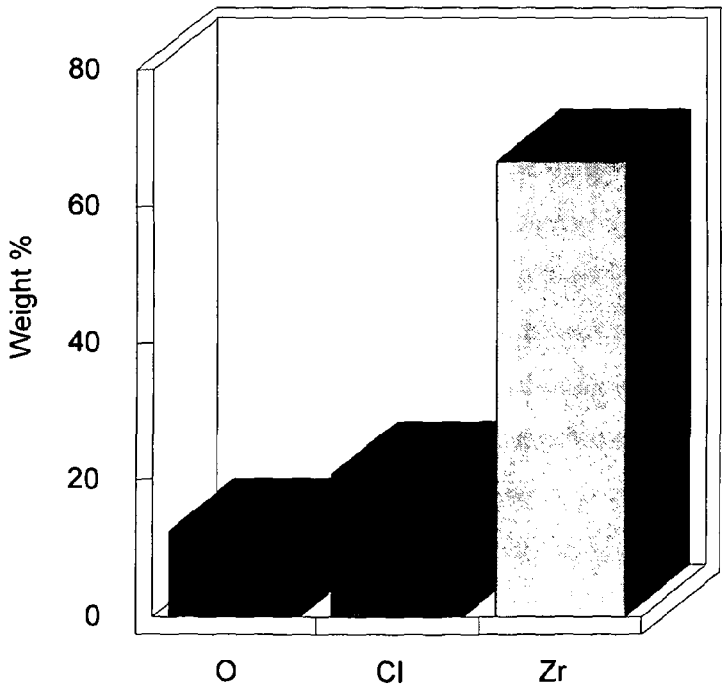
Figure 50:
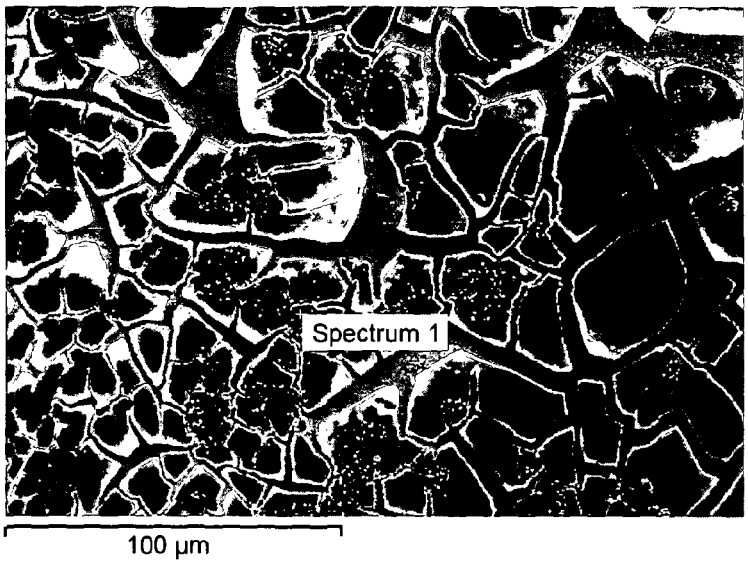
Figure 50:
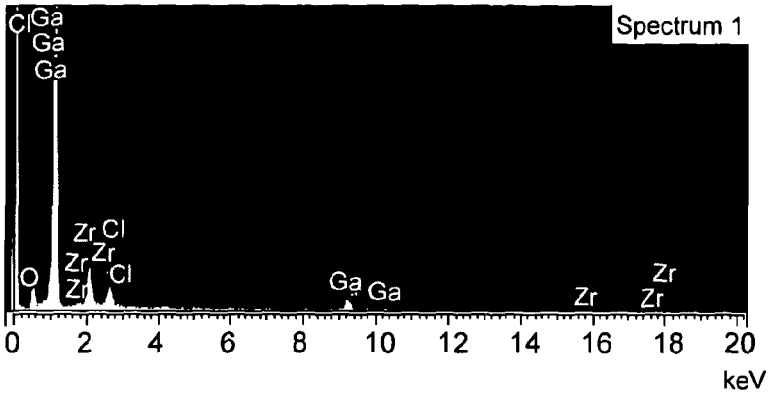
Figure 50:
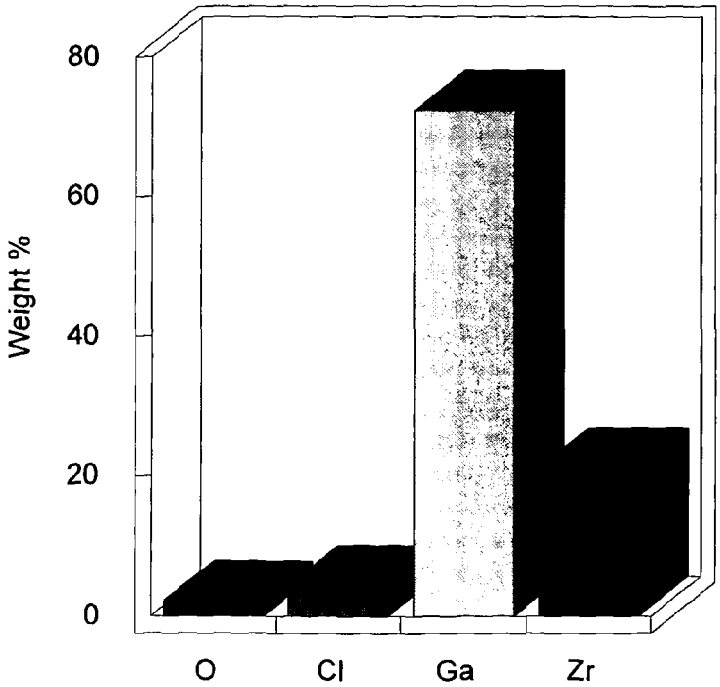
Figure 51:
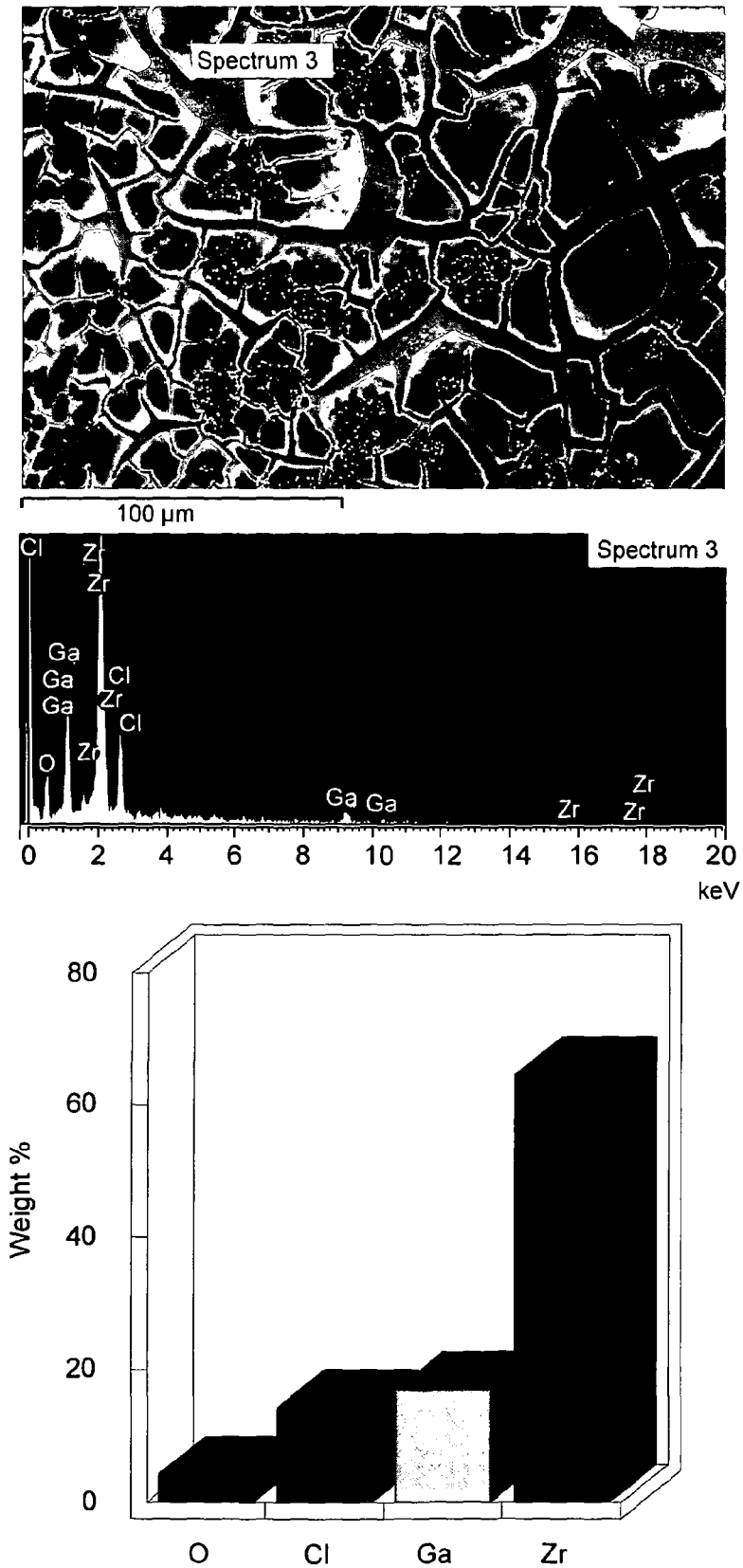
Figure 52:
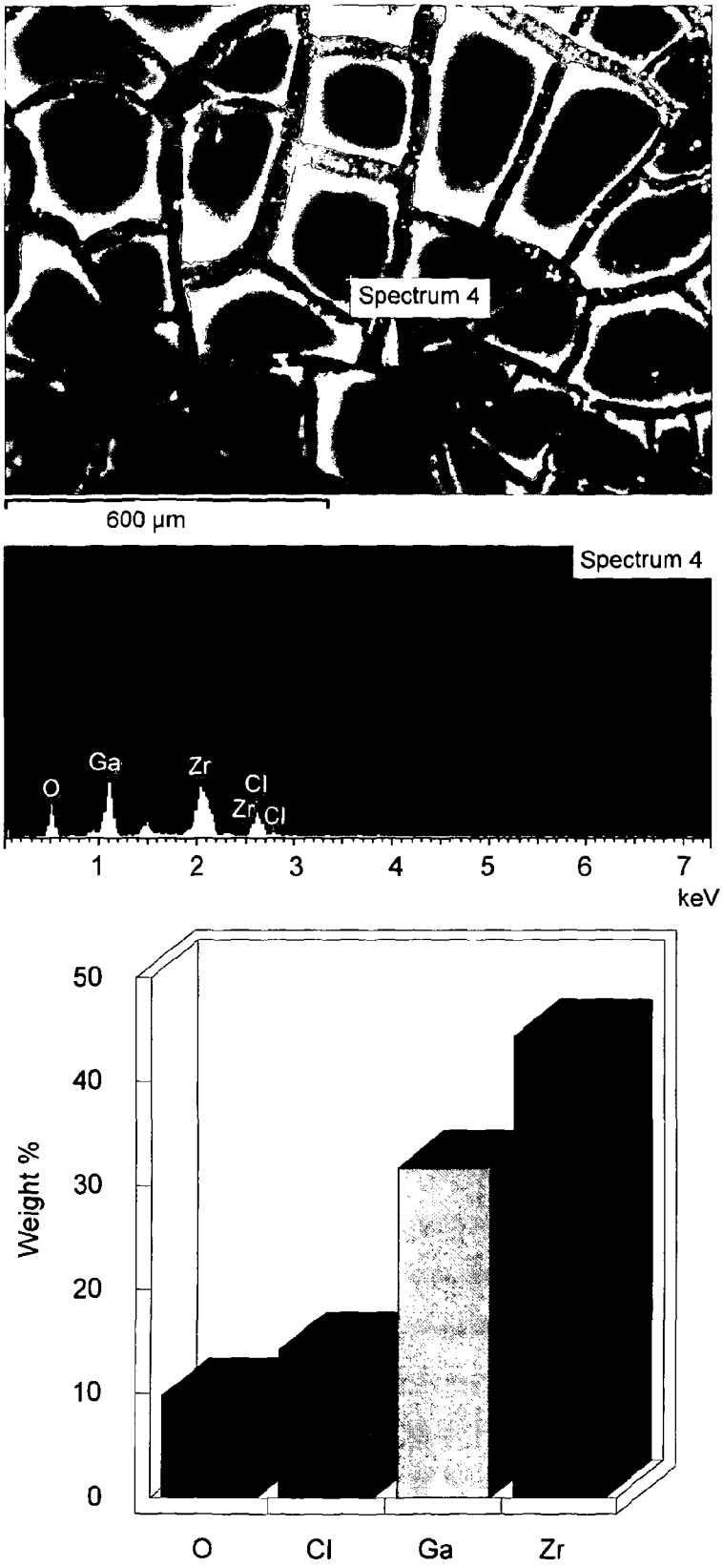
Figure 53:
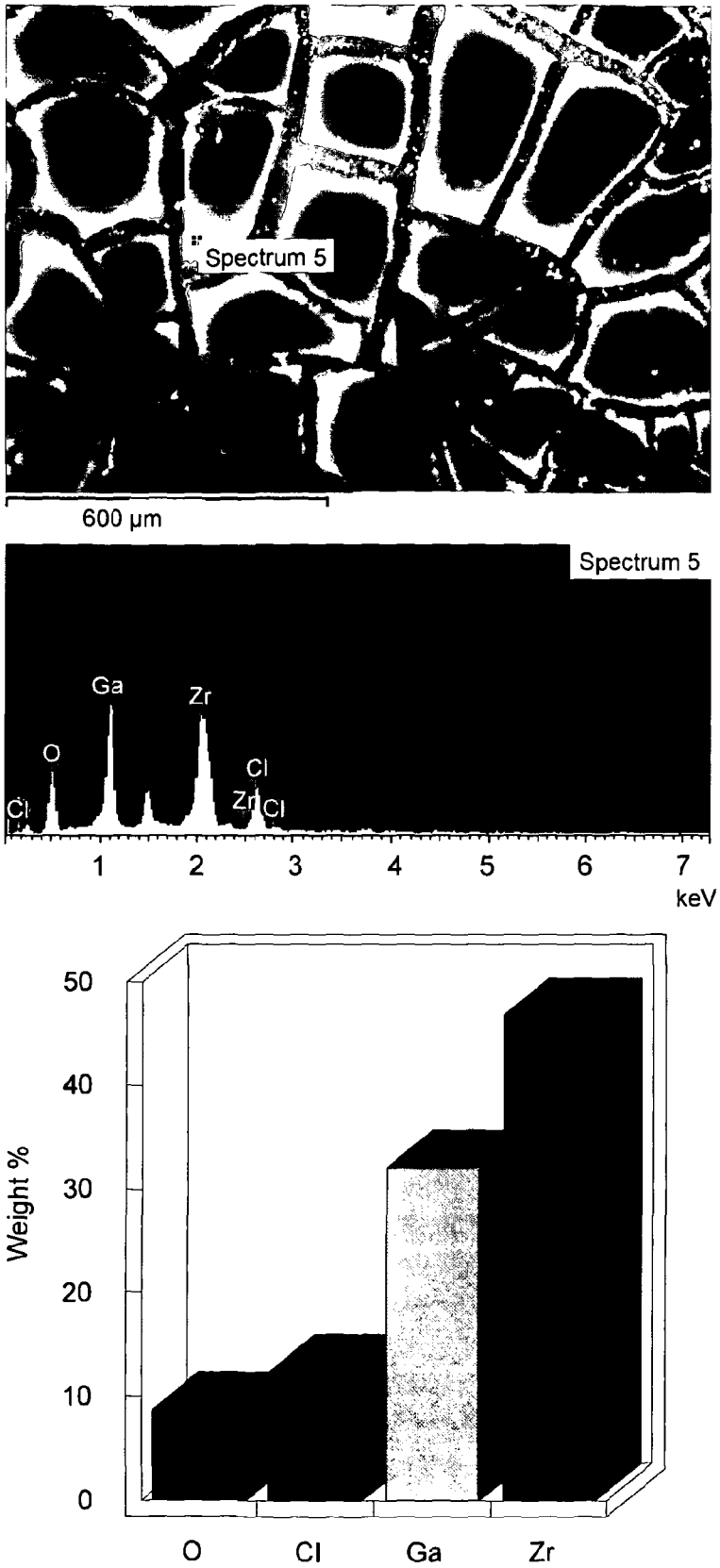
Figure 54:
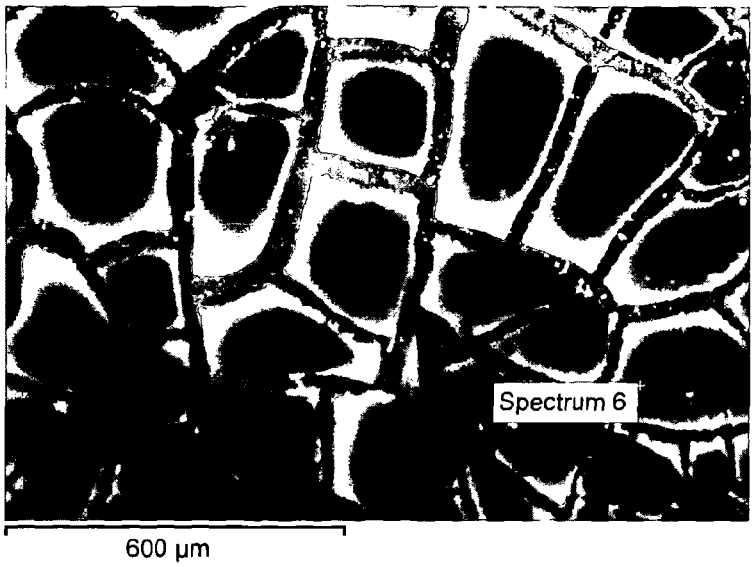
Figure 54:
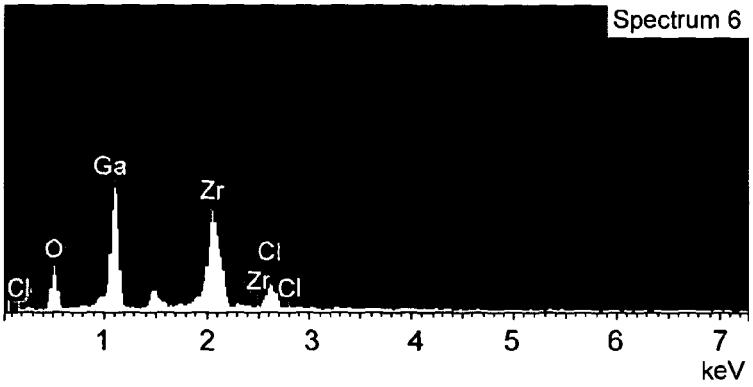
Figure 54:
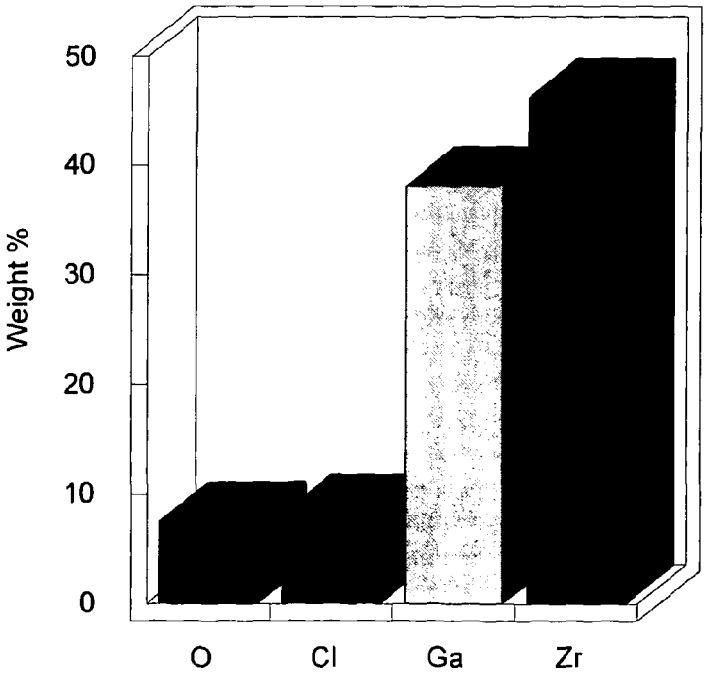
Figure 55:
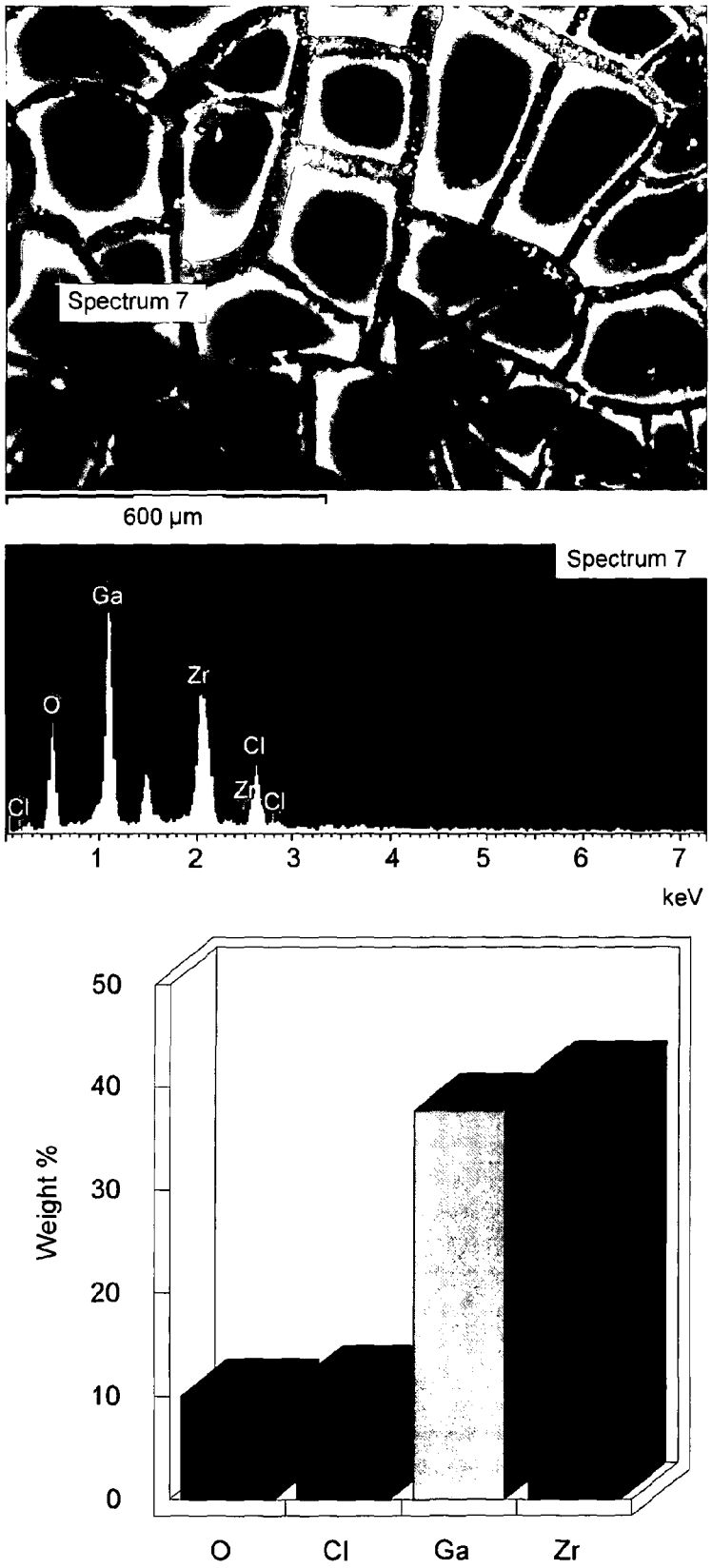
Figure 56:
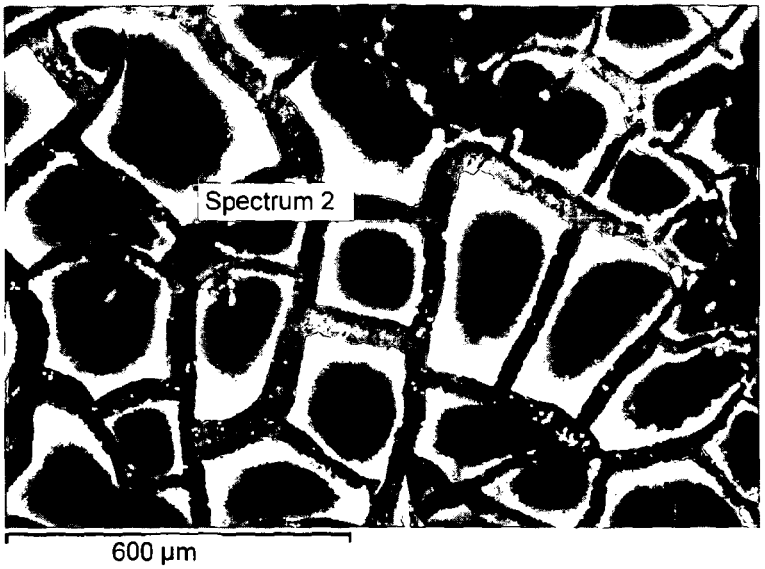
Figure 56:
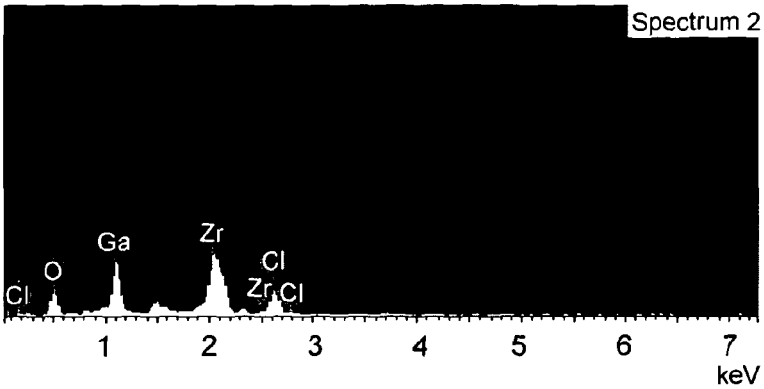
Figure 56:
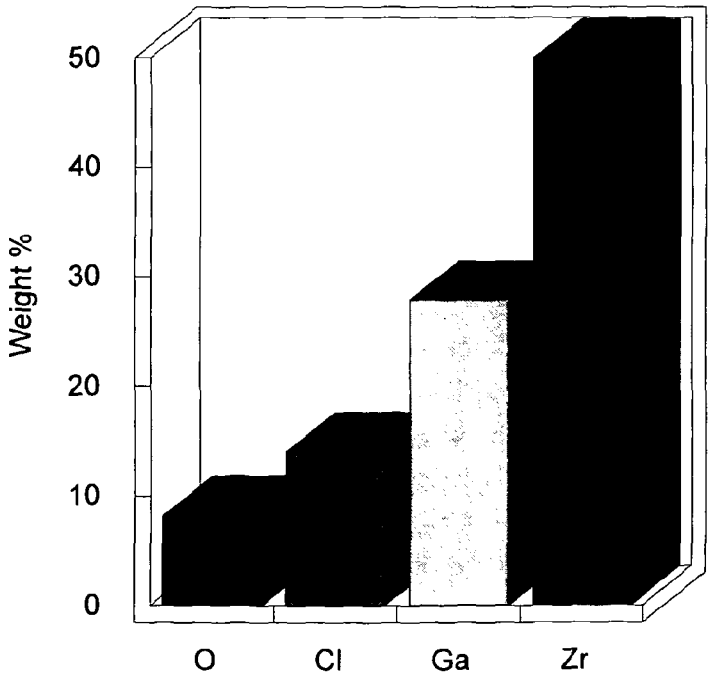
Figure 57:
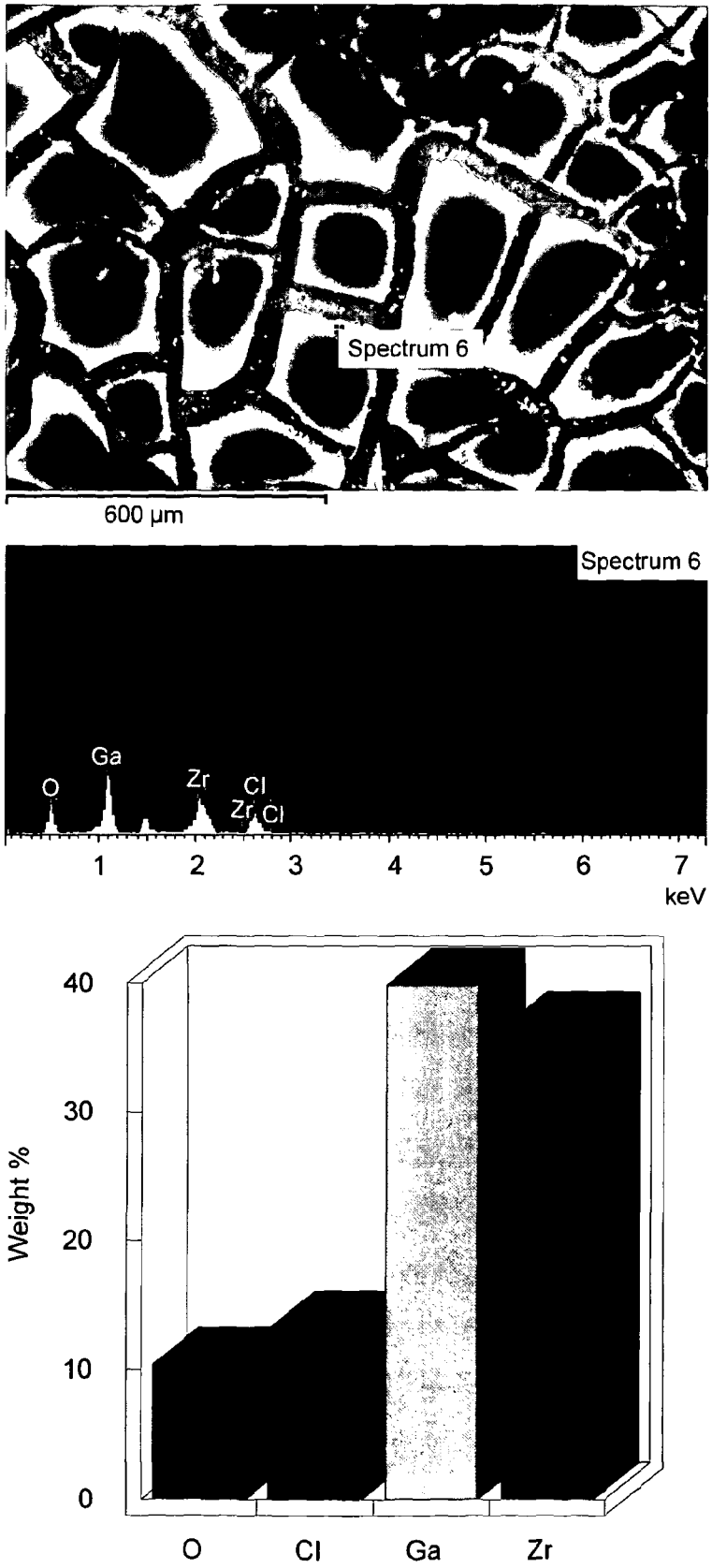
Figure 58:
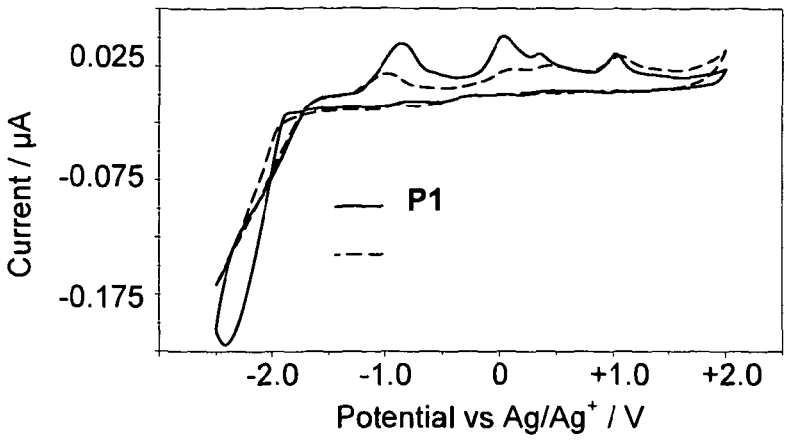
Figure 59:
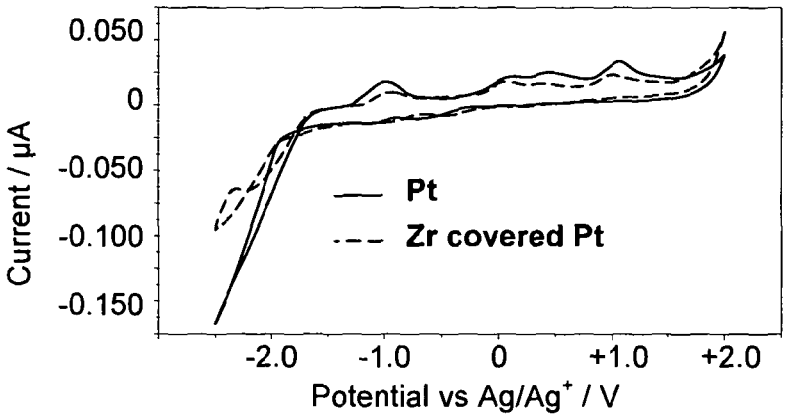
Figure 60:
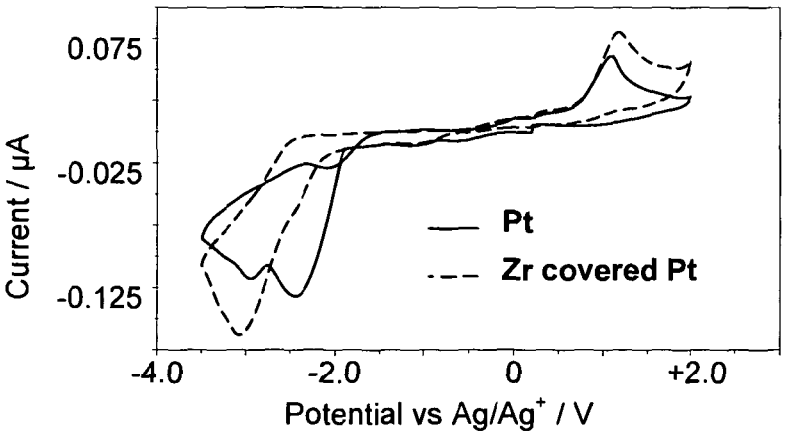
Figure 61:
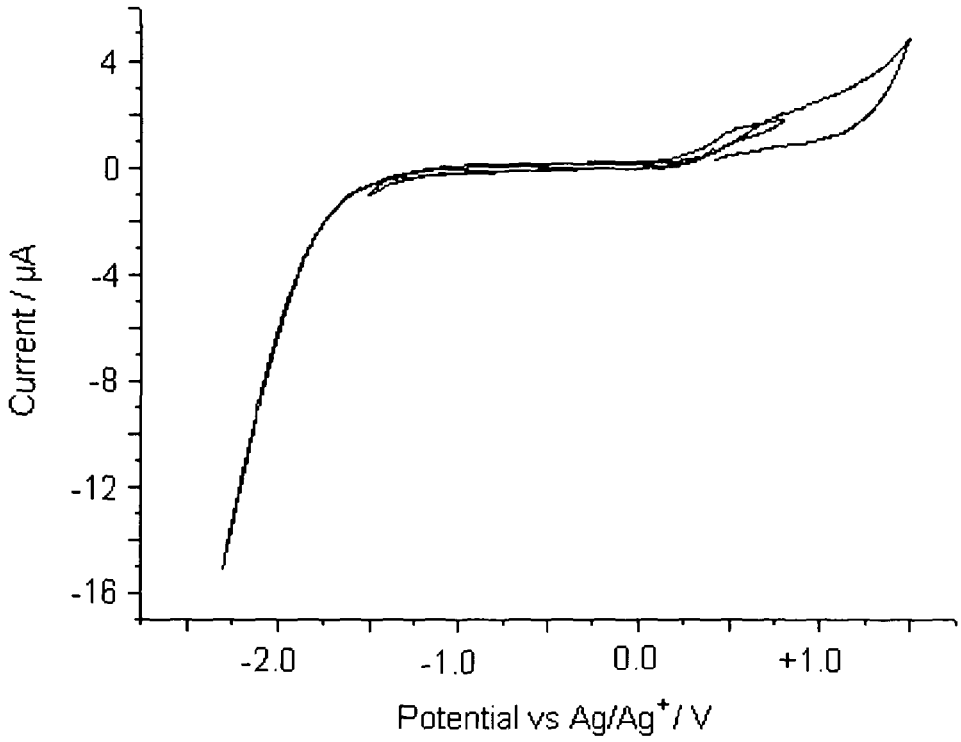
Figure 62:
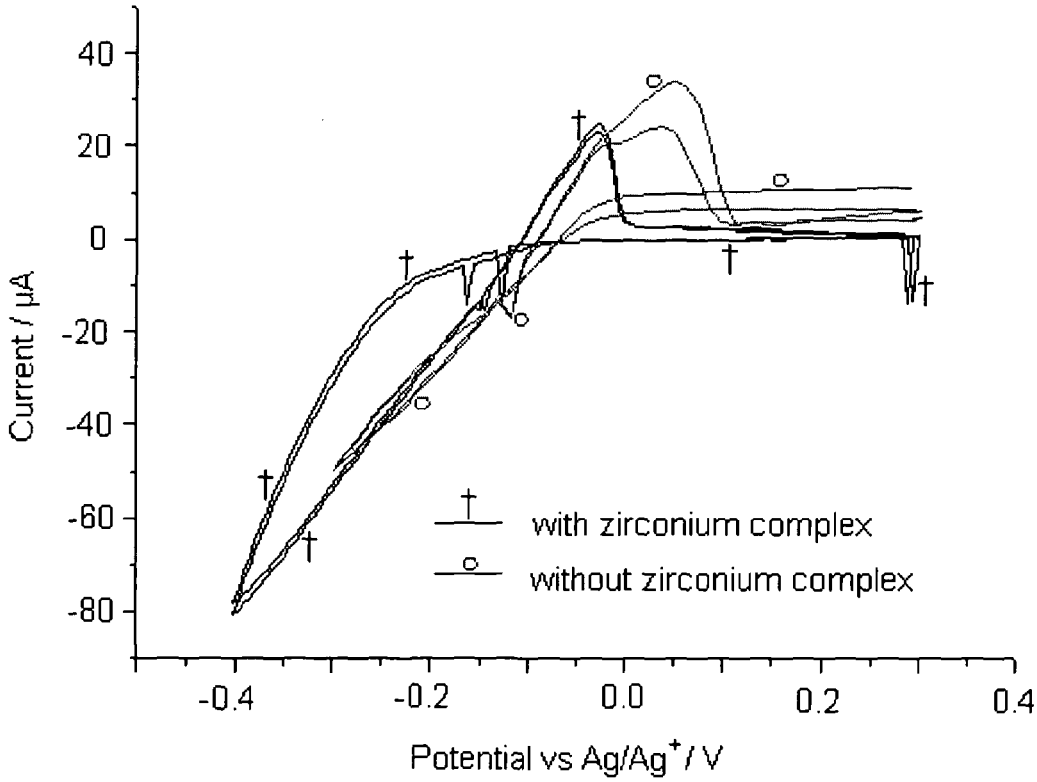

FIG. 3 compares the cyclic voltammograms of a complex containing 33 mol % of zirconium (IV) chloride and 67 mol % of 1-octyl-3-methylimidazolium chloride with clean 1-octyl-3-methylimidazolium chloride on a platinum electrode at 70° C.;

FIG. 4 compares the cyclic voltammograms of a complex containing 33 mol % of zirconium (IV) chloride and 67 mol % of 1-octyl-3-methylimidazolium chloride with clean 1-octyl-3-methylimidazolium chloride on a glassy carbon electrode at 70° C.;

FIG. 5 compares the cyclic voltammograms of a complex containing 33 mol % of zirconium (IV) chloride and 67 mol % of 1-octyl-3-methylimidazolium chloride with clean 1-octyl-3-methylimidazolium chloride on a gold electrode at 70° C.;

FIG. 6 compares the cyclic voltammograms of a chlorogallate ionic liquid comprising 50 mol % gallium (III) chloride and 50 mol % 1-octyl-3-methylimidazolium chloride with and without a zirconium precursor complex on a platinum electrode at room temperature;

FIGS. 7 to 11 show data from a scanning electron microscope and energy dispersive X-ray spectroscopy from an experiment in which elemental zirconium deposits are produced from an ionic liquid comprising 50 mol % gallium (III) chloride and 50 mol % 1-octyl-3-methylimidazolium chloride and a zirconium precursor complex on a platinum electrode, at room temperature over a period of 900 s;

FIG. 12 compares the cyclic voltammograms of neutral, acidic, and buffered acidic chlorogallate ionic liquids;

FIG. 13 compares the cyclic voltammograms of a basic chlorogallate ionic liquid comprising 47 mol % gallium (III)

chloride and 53 mol % 1-octyl-3-methylimidazolium chloride with and without a zirconium precursor complex on a platinum electrode;

FIGS. 14 to 20 show data from a scanning electron microscope and energy dispersive X-ray spectroscopy from an experiment in which elemental zirconium deposits are produced from a basic ionic liquid comprising 47 mol % gallium (III) chloride and 53 mol % 1-octyl-3-methylimidazolium chloride and a zirconium precursor complex on a platinum electrode, at room temperature over a period of 900 s;

FIG. 21 compares the cyclic voltammograms of an acidic chlorogallate ionic liquid comprising 55 mol % gallium (III) chloride and 45 mol % 1-octyl-3-methylimidazolium chloride with and without a zirconium precursor complex on a platinum electrode;

FIGS. 22 to 27 show data from a scanning electron microscope and energy dispersive X-ray spectroscopy from an experiment in which elemental zirconium deposits are produced from an acidic ionic liquid comprising 55 mol % gallium (III) chloride and 45 mol % 1-octyl-3-methylimidazolium chloride and a zirconium precursor complex on a platinum electrode, at room temperature over a period of 900 s;

FIGS. 28 to 41 show data from a scanning electron microscope and energy dispersive X-ray spectroscopy from a first experiment in which elemental zirconium deposits are produced from an ionic liquid comprising 51 mol % gallium (III) chloride and 49 mol % 1-octyl-3-methylimidazolium chloride with 10% by weight of zirconium precursor complex on a platinum electrode, at room temperature over a period of 900 s;

FIGS. 42 to 43 show data from a scanning electron microscope and energy dispersive X-ray spectroscopy from a second experiment in which elemental zirconium deposits are produced from an ionic liquid comprising 51 mol % gallium (III) chloride and 49 mol % 1-octyl-3-methylimidazolium chloride with 10% by weight of zirconium precursor complex on a platinum electrode, at room temperature over a period of 900 s;

FIG. 44 compares the $^{71}$Ga NMR of an acidic chlorogallate ionic liquid with and without a buffer;

FIGS. 45 to 51 show data from a scanning electron microscope and energy dispersive X-ray spectroscopy from an experiment in which elemental zirconium deposits are produced from an ionic liquid that has been buffered to be neutral comprising 51 mol % gallium (III) chloride and 49 mol % 1-octyl-3-methylimidazolium chloride and a zirconium precursor complex on a platinum electrode, at room temperature over a period of 3600 s;

FIGS. 52 to 57 show data from a scanning electron microscope and energy dispersive X-ray spectroscopy from an experiment in which elemental zirconium deposits and gallium deposits are produced from an ionic liquid that has been buffered to be neutral comprising 51 mol % gallium (III) chloride and 49 mol % 1-octyl-3-methylimidazolium chloride and a zirconium precursor complex on a platinum electrode, at room temperature over a period of 7200 s where the source of zirconium is replenished every 900 s;

FIG. 58 compares the cyclic voltammograms from a first and a second platinum electrode sequentially connected to a potentiostat and immersed in a chlorogallate ionic liquid that has been buffered to be neutral comprising 51 mol % gallium (III) chloride and 49 mol % 1-octyl-3-methylimidazolium chloride and a zirconium precursor complex;

FIG. 59 compares the cyclic voltammograms from a second and a first platinum electrode, where the first platinum electrode comprises an outer layer of zirconium, sequentially connected to a potentiostat and immersed in a chlorogallate ionic liquid that has been buffered to be neutral comprising 51 mol % gallium (III) chloride and 49 mol % 1-octyl-3-methylimidazolium chloride and a zirconium precursor complex;

FIG. 60 compares the cyclic voltammograms on an extended cathodic window from a second and a first platinum electrode, where the first platinum electrode comprises an outer layer of zirconium, sequentially connected to a potentiostat and immersed in a chlorogallate ionic liquid that has been buffered to be neutral comprising 51 mol % gallium (III) chloride and 49 mol % 1-octyl-3-methylimidazolium chloride and a zirconium precursor complex;

FIG. 61 shows the cyclic voltammogram of a chlorogallate ionic liquid that has been buffered to be neutral comprising 51 mol % gallium (III) chloride and 49 mol % 1-octyl-3-methylimidazolium chloride with a zirconium precursor complex on a zirconium electrode; and FIG. 62 compares the cyclic voltammogram of a chlorogallate ionic liquid comprising 67 mol % gallium (III) chloride and 33 mol % 1-octyl-3-methylimidazolium chloride with and without a zirconium precursor complex on a zirconium electrode.

EXAMPLES

Unless stated otherwise, the electrochemical cell used in the Examples consists of a three electrode system, with a platinum disc as a working electrode, a platinum coil as a counter electrode and $Ag/Ag^+$ as the reference electrode. The electrochemical cell is made of glass and fitted with an inlet for the bubbling of argon.

Comparative Example

Example 1

Figure 1:
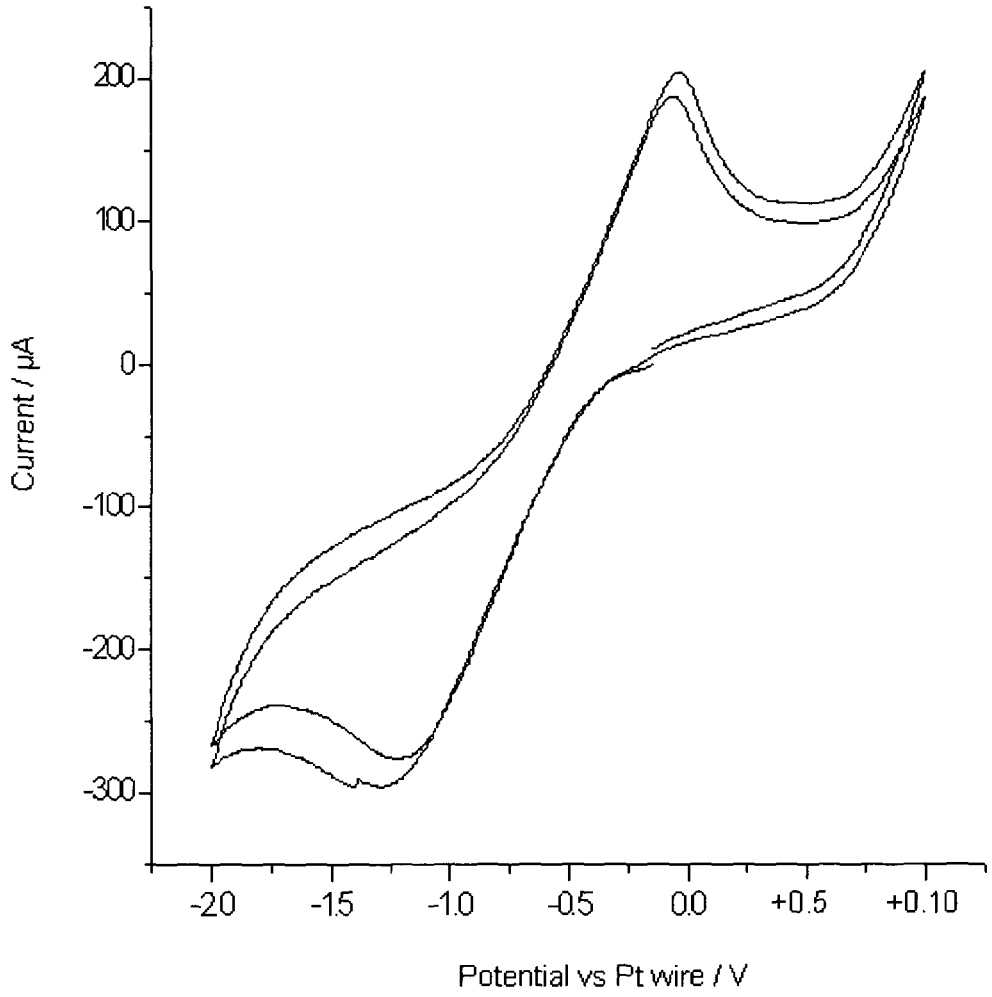
FIG. 1 is a cyclic voltammogram of a complex containing 33 mol % of zirconium (IV) chloride and 67 mol % of 1-octyl-3-methylimidazolium chloride on a platinum electrode at 110° C. Platinum wire was used as a reference electrode.

Electrochemistry of a Zirconium Complex Salt Comprising Zirconium (IV) Chloride and 1-Octyl-3-Methylimidazolium The electrochemistry of a complex containing 33 mol % of zirconium (IV) chloride and 67 mol % of 1-octyl-3-methylimidazolium chloride was investigated at 110° C. (FIG. 1). No zirconium deposits were observed on the platinum electrode, even after running the deposition for many hours.

Preferred Embodiment

Example 2

Figure 2:
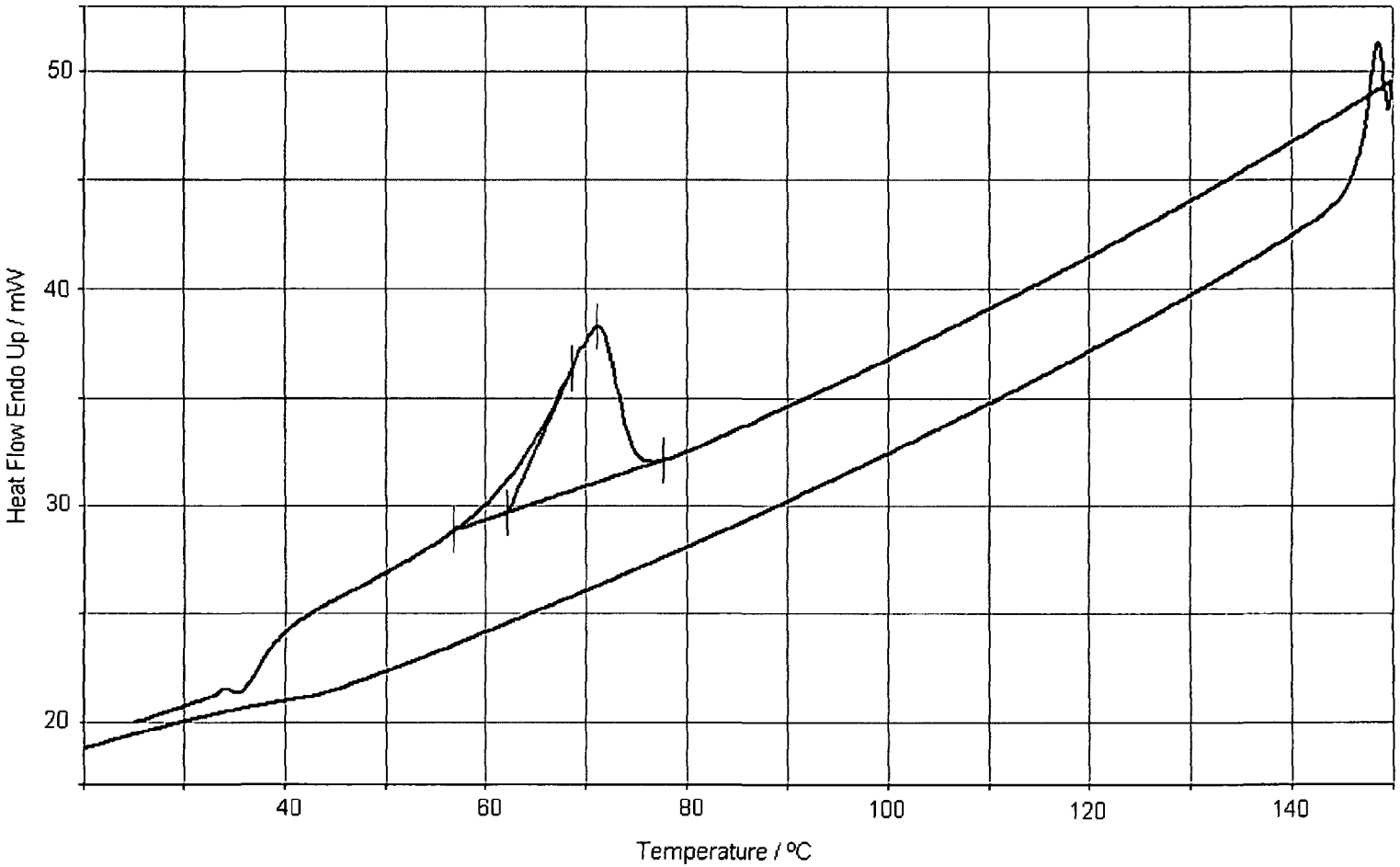
FIG. 2 is a differential scanning calorimetry graph of a complex containing 33 mol % of zirconium (IV) chloride and 67 mol % of 1-octyl-3-methylimidazolium chloride.

Formation of a Zirconium Complex Salt from Zirconium (IV) Chloride And 1-Octyl-3-Methylimidazolium Chloride for Use as a Precursor 33 mol % of zirconium (IV) chloride was mixed with 67 mol % of 1-octyl-3-methylimidazolium chloride. On heating, the mixture was cloudy between 30° C. and 70° C., then dissolved in a uniform manner to provide a clear yellow liquid. The complex was recrystallised with acetonitrile to give a white solid. The melting point of this complex was determined by differential scanning calorimetry to be 71° C. (FIG. 2). Further elemental analysis of the complex suggested the structure to be $([omim]^+)_2[ZrCl_6]^{2-}$.

The electrochemical properties of the obtained complex were investigated on platinum, gold and glassy carbon electrodes (FIGS. 3 to 5) at 70° C. With all three electrodes, the electrochemical window of the complex was extended when compared to the clean 1-octyl-3-methylimidazolium chloride, thereby demonstrating that zirconium (IV) chloride has formed an association with 1-octyl-3-methylimidazolium chloride. No zirconium deposition was observed during these experiments.

This zirconium complex salt was used as a zirconium precursor in the experiments discussed below.

Example 3

Electrodeposition of Zirconium from a Neutral Ionic Liquid Comprising 50 mol % Gallium (III) Chloride and 50 mol % 1-Octyl-3-Methylimidazolium Chloride, With the Precursor as the Zirconium Salt and the Buffer, Over a Period of 900 s A chlorogallate ionic liquid was prepared by combining 50 mol % of gallium (III) chloride with 50 mol % of 1-octyl-3-methylimidazolium chloride. This was then combined with the zirconium precursor of Example 2. The electrochemical properties of the system, compared to the chlorogallate ionic liquid without the complex, show a reduction hump around −1.2 V (FIG. 6). Deposition was run at a potential of −2 V for a duration of 900 s at room temperature. During this time, deposits were observed on the platinum electrode.

The deposits were washed several times with acetonitrile to ensure the removal of the ionic liquid electrolyte. The deposits were viewed in detail with a scanning electron microscope and had the appearance of shiny metallic flakes. Individual deposits were further analysed by energy dispersive X-ray spectroscopy. Zirconium was identified in every deposit, along some contamination from chlorine, oxygen and carbon (FIGS. 7 to 11). Neither gallium, nor platinum were identified in any of the deposits. It was therefore concluded that the deposits were of metallic zirconium.

Neutrality of the System

In a preferred embodiment of the present invention, as demonstrated in Example 3, a neutral chlorogallate ionic liquid is used. Elemental zirconium is also deposited from acidic and basic ionic liquids.

Example 4

Comparison of Electrochemical Behaviours of Neutral, Acidic, and Buffered Acidic Chlorogallate Ionic Liquids The electrochemistry of neutral (50 mol % of gallium (III) chloride with 50 mol % of 1-octyl-3-methylimidazolium chloride), acidic (51 mol % of gallium (III) chloride with 49 mol % of 1-octyl-3-methylimidazolium chloride) and buffered acidic (51 mol % of gallium (III) chloride with 49 mol % of 1-octyl-3-methylimidazolium chloride with the zirconium precursor of Example 2 acting as both a buffer and a precursor) chlorogallate ionic liquids were investigated by cyclic voltammetry (FIG. 12).

The neutral chlorogallate ionic liquid shows no nucleation and hardly any deposition of gallium on the platinum electrode.

The acidic chlorogallate ionic liquid shows a cathodic peak at −1.0 V corresponding to the under-potential deposition of gallium and another peak at −2.4 V corresponding to the over-potential deposition of gallium. The equivalent anode stripping peaks appeared at −0.25 V and 1.1 V respectively. Gallium deposition was observed on the electrode.

The buffered acidic chlorogallate ionic liquid which contains the zirconium precursor of Example 2 shows a cathodic peak at −2.0 V corresponding to deposition of zirconium and another peak at −2.4 V corresponding to deposition of gallium. This demonstrates that the use of a buffer to maintain a neutral system prevents under-potential deposition of gallium.

Example 5

Electrodeposition of Zirconium from a Basic Ionic Liquid Comprising 47 mol % Gallium (III) Chloride and 53 mol % 1-Octyl-3-Methylimidazolium Chloride, With the Zirconium Precursor Acting as the Zirconium Salt and the Buffer, Over a Period of 900 s The electrodeposition experiment of Example 3 was repeated, this time using a chlorogallate ionic liquid prepared by combining 47 mol % of gallium (III) chloride with 53 mol % of 1-octyl-3-methylimidazolium chloride.

The cyclic voltammogram of the system, compared to the chlorogallate ionic liquid without the complex, shows a reduction hump around −0.9 V (FIG. 13). Deposits were observed on the platinum electrode.

The scanning electron microscope showed that the deposits consist of shiny metallic flakes like those seen in Example 3, with spheres dispersed over them. The flakes and spheres were further analysed by energy dispersive X-ray spectroscopy. Zirconium was identified in every flake, and gallium was identified in every sphere (FIGS. 14 to 20). It was therefore concluded that the deposits were flakes of metallic zirconium, comprising spheres of gallium deposited on their surface.

Example 6

Electrodeposition of Zirconium from an Acidic Ionic Liquid Comprising 55 mol % Gallium (III) Chloride and 45 mol % 1-Octyl-3-Methylimidazolium Chloride, With the Zirconium Precursor Acting as the Zirconium Salt and the Buffer, Over a Period of 900 s The electrodeposition experiment of Example 3 was repeated, this time using a chlorogallate ionic liquid prepared by combining 55 mol % of gallium (III) chloride with 45 mol % of 1-octyl-3-methylimidazolium chloride.

The cyclic voltammogram of the system, compared to the chlorogallate ionic liquid without the complex, shows a reduction hump around −0.9 V (FIG. 21). Many more deposits were observed on the platinum electrode than in Example 5.

As with Example 5, gallium was deposited as a layer of spheres on the surface of zirconium flakes (FIGS. 22 to 27). Zirconium was predominantly deposited.

Example 7

Electrodeposition of Zirconium from an Ionic Liquid Comprising 51 mol % Gallium (III) Chloride and 49 mol % 1-Octyl-3-Methylimidazolium Chloride The electrodeposition experiment of Example 3 was repeated, this time using a chlorogallate ionic liquid prepared by combining 51 mol % of gallium (III) chloride with 49 mol % of 1-octyl-3-methylimidazolium chloride. Ten parts by weight of the chlorogallate ionic liquid were combined with 1 part by weight of the zirconium precursor of Example 2.

The scanning electron microscope showed that the deposits consist of shiny metallic flakes like those seen in Example 3. The flakes were further analysed by energy dispersive X-ray spectroscopy and identified as zirconium (FIGS. 28 to 41). The experiment was repeated, and gave similar results (FIGS. 42 to 43).

Example 8

Electrochemical Properties of Slightly Acidic Ionic Liquid Comprising of 51 mol % Gallium (III) Chloride and 49 mol % 1-Octyl-3-Methylimidazolium chloride, With the Zirconium Precursor Acting Both as the Zirconium Salt and as the Buffer An acidic chlorogallate ionic liquid (51 mol % of gallium (III) chloride and 49 mol % of 1-octyl-3-methylimidazolium chloride) was buffered with the zirconium precursor of Example 2. $^{71}$Ga NMR was used to compare the buffered ionic liquid with a non-buffered ionic liquid (FIG. 44). The $^{71}$Ga NMR of the non-buffered system showed a broad peak, corresponding to the $[GaCl_4]^-$, along with the polynuclear anions $[GaCl_4(GaCl_3)_n]^-$. However, in the buffered solution, the sharp peak for $[GaCl_4]^-$ was observed, demonstrating that the zirconium complex salt of Example 2 (the zirconium precursor) neutralises the system.

Time Period of the Deposition and Self-limiting Thickness Nature of Zirconium

In the preferred embodiment of the invention demonstrated in Example 7, the deposition process is continued for a period of 900 s. Zirconium deposition is self-limiting to a certain thickness, and running the deposition for a longer period of time results in deposition of gallium.

Example 9

Electrodeposition of Zirconium from an Ionic Liquid that has been Buffered to be Neutral Comprising 51 mol % Gallium (III) Chloride and 49 mol % 1-Octyl-3-Methylimidazolium Chloride, with the Zirconium Precursor, Over a Period of 3600 s The experiment was carried out as in Example 7, but over a time period of one hour (3600 s). Scanning electron microscopy and energy dispersive X-ray spectroscopy analysis show deposits comprising spheres of gallium on the surface of thin flakes of zirconium (FIGS. 44 to 51)

Example 10

Electrodeposition of Zirconium from an Ionic Liquid that has been Buffered to be Neutral Comprising 51 mol % Gallium (III) Chloride and 49 mol % 1-Octyl-3-Methylimidazolium Chloride, with Continuous Feeding of the Zirconium Precursor It was assumed that the deposition of gallium started when there were no more zirconium species available in the electrolyte. To test this theory, an experiment was carried out as in Example 7, but with continuous feeding of 10% by weight of the zirconium precursor of Example 2 at 900 s intervals, over a period of two hours (7200 s). The results showed that both zirconium and gallium were deposited (FIGS. 52 to 57), implying that deposition of gallium started for a reason other than the zirconium species running out.

Example 11

Electrochemical Properties of a System that has been Buffered to be Neutral Comprising Two Alternately Run Platinum Electrodes An additional working platinum electrode was immersed in the electrolyte of the system of Example 7. The first electrode was initially connected to the potentiostat, leading to zirconium deposition. The first electrode was then disconnected, and the second electrode connected to the potentiostat. Similar nucleation potentials to the first electrode were observed (FIG. 58). In switching the potentiostat back to the first electrode, however, which already comprised zirconium deposits, shifts in nucleation potentials and reduced currents are observed (FIG. 59). Furthermore, the cyclic voltammograms with extended cathodic window show dominant gallium deposition and stripping, and the nucleation potential for ziconium at −2 V doesn't exist (FIG. 60). This is evidence for the existence of a barrier that prevents zirconium from depositing on itself. A possible explanation for this is discussed above.

Example 12

Deposition of Zirconium and Gallium onto a Zirconium Wire Substrate

In another experiment, a zirconium wire was used as the substrate. It was shown that zirconium could not be deposited on this wire, but that gallium could (FIGS. 61 to 62). This is further evidence to suggest that the deposition of zirconium is self-limiting.

The invention claimed is:

1. An elemental zirconium deposition process, comprising the step of electrolysing an electrodeposition mixture at a temperature of less than 100° C., wherein the electrodeposition mixture comprises:

i. an ionic liquid, wherein the ionic liquid has the formula:

$$[Cat^+][X^-]$$

wherein: $[Cat^+]$ represents one or more cationic species selected from the group consisting of:

azaannulenium, azathiazolium, benzimidazolium, benzofuranium, benzothiophenium, benzotriazolium, borolium, cinnolinium, diazabicyclodecenium, diazabicyclononenium, 1,4-diazabicylco [2.2.2.] octanium, diazabicycloundecenium, dibenzofuranium, dibenzothiphenium, dithiazolium, furanium, guanidinium, imidazolium, indazolium, indolinium, indolium, morpholinium, oxaborolium, oxaphospholium, oxathiazolium, oxazinium, oxazolium, iso-oxazolium, oxazolinium, pentazolium, phospholium, phosphonium, phthalazinium, piperazinium, piperidinium, pyranium, pyrazinium, pyrazolium, pyridazinium, pyridinium, pyrimidinium, pyrrolium, quinazolinium, quinolinium, iso-quinolinium, quinoxalinium, selenazolium, sulfonium, tetrazolium, thiadiazolium, iso-thiadiazolium, thiazinium, thiazolium, iso-thiazolium, thiophenium, thiuronium, triazadecenium, triazinium, triazolium, iso-triazolium, and uronium; and $[X^-]$ represents one or more anionic species;

ii. a soft Lewis acid including a metal halide selected from a gallium (III) halide, an indium (III) halide or a zinc (III) halide; and iii. a zirconium salt.

2. A process according to Claim 1, wherein [Cat+] comprises a cationic species selected from the group consisting of:

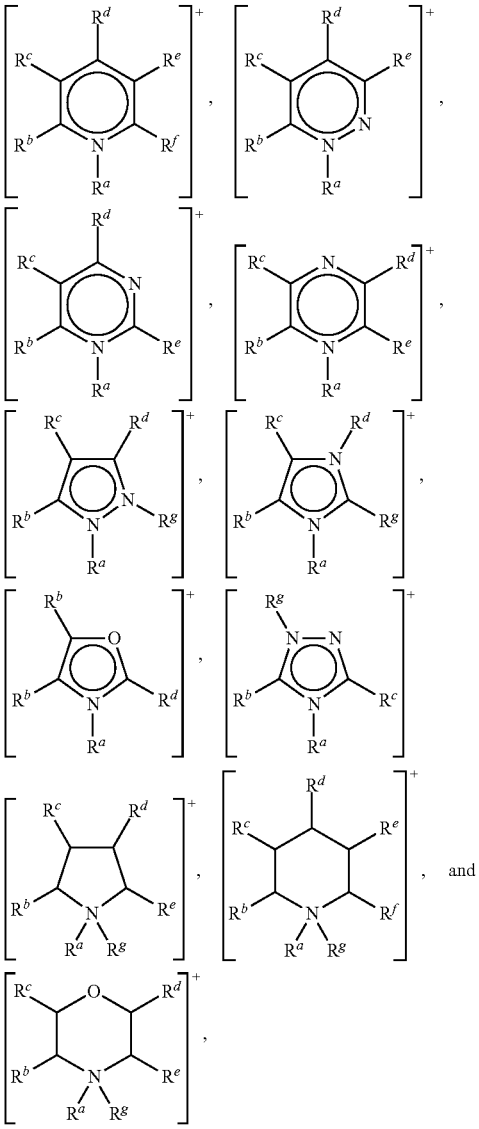

wherein: $R^a$, $R^b$, $R^c$, $R^d$, $R^e$, $R^f$ and $R^g$are each independently selected from hydrogen, a $C_1$ to $C_{30}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$—wherein q is from 3 to 6 ; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, 13 C(O)$R^x$, —C(S)$R^x$, —CS $_2R^x$, —SC(S)$R^x$, 13 S(O)($C_1$ to $C_6$)alkyl, —S(O)O($C_1$ to $C_6$)alkyl, —OS(O)($C_1$ to $C_6$)alkyl, —S($C_1$ to $C_6$)alkyl, —S—S($C_1$ to $C_6$ alkyl), —$NR^xC(O)NR^yR^z$, —$NR^xC(O)OR^y$, —OC(O)NR $^yR^z$, —$NR^xC(S)OR^y$, —OC(S)NR $NR^xC(S)SR_y$, —SC(S)$NR^YR^z$, —$NR^1C(S)NR^YR^z$, —C(O)$NR^YR^z$, —C(S)$NR^YR^z$, —$NR^YR^z$, or a heterocyclic group, wherein $R^x$, $R^y$and $R^z$ are independently selected from hydrogen or $C_1$ to $C_6$ alkyl.

3. A process according to claim 2, wherein [Cat+]comprises the cationic species:

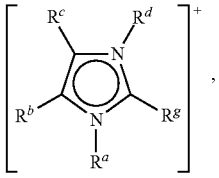

wherein: $R^a$,$R^b$, $R^c$, $R^d$ and $R^g$ are as defined in claim 2.

4. A process according to claim 2, wherein $R^b$, $R^c$ and $R^d$ are hydrogen; one of $R^a$ and $R^g$ is hydrogen or methyl; and one of $R^a$ and $R^g$ is selected from $C_1$ to $C_{10}$, linear or branched alkyl group.

5. A process according to Claim 1, wherein [Cat+] comprises a cation selected from the group consisting of:

$[N(R^a)(R^b)(R^c)(R^d)]^+$, $[P(R^a)(R^b)(R^c)(R^d)]^+$, and $[S(R^a)(R^b)(R^c)]^+$, wherein: $R^a$, $R^b$, $R^c$, and $R^d$ are each independently selected from a $C_1$ to $C_{30}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$—wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(S)$R^x$, —$CS_{-2}R^x$, —SC(S)$R^x$, —S(O)($C_1$ to $C_6$)alkyl, —S(O)O($C_1$ to $C_6$)alkyl, —OS(O)($C_1$ to $C_6$)alkyl, —S($C_1$ to $C_6$)alkyl, —S—S($C_1$ to $C_6$ alkyl), —$NR^xC(O)NR^yR^z$, —$NR^xC(O)OR^y$, —OC(O)$NR^yR^z$, —$NR^xC(S)OR^y$, —OC(S)$NR^yR^z$, —$NR^xC(S)SR^y$, —SC(S)$NR^{yRz}$, —$NR^xC(S)NR^{yRz}$, —C(O)$NR^yR^z$, —C(S)$NR^yR^z$, —NR $^yR^z$, or a heterocyclic group , wherein $R^x$, $R^y$ and $R^z$ are independently selected from hydrogen or $C_1$ to $C_6$ alkyl, and wherein one of $R^a$, $R^b$, $R^c$, and $R^d$ may also be hydrogen.

6. A process according to claim 5, wherein $R^b$, $R^c$, and $R^d$ are each the same alkyl group selected from methyl, ethyl, n-butyl, and n-octyl, and $R^a$ is selected from hydrogen, methyl, n-butyl, n-octyl, n-tetradecyl, 2-hydroxyethyl, or 4-hydroxy-n-butyl.

7. A process according to Claim 1, wherein [Cat+] comprises a basic cation represented by the formula:

$[Cat^+\text{-}(Z\text{-}Bas)_n]$ wherein: Cat+ is a cationic species;

B as is a basic moiety;

Z is a covalent bond joining Cat+ and Bas or 1, 2 or 3 aliphatic divalent linking groups each containing 1 to 10 carbon atoms and each optionally one, two or three oxygen atoms; and n is an integer from 1 to 3.

8. A process according to claim 7, wherein [Cat+—Z-Bas] is selected from the group consisting of:

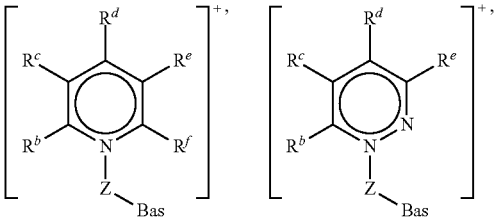

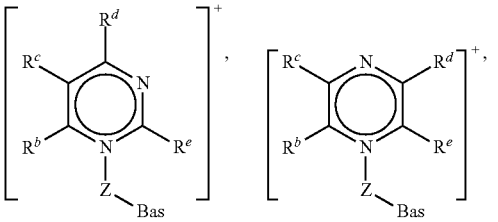

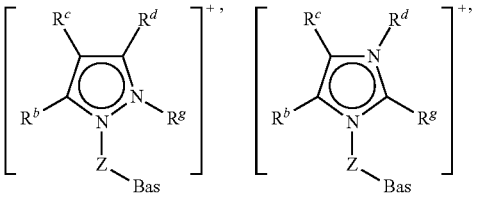

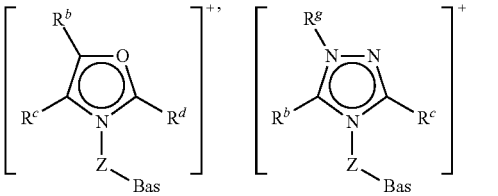

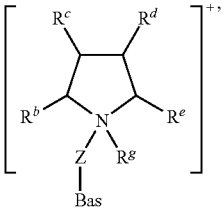

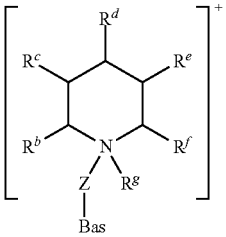

and

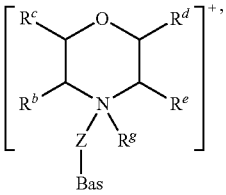

wherein: Bas and Z are as defined in claim 7; and $R^b$, $R^c$, $R^d$ $R^e$, $R^f$, and $R^g$ are as defined in claim 2.

9. A process according to claim 7, wherein Bas comprises at least one nitrogen, phosphorus, sulphur or oxygen atom.

10. A process according to claim 9, wherein Bas is selected from the group consisting of:

$$—N(R^1)(R^2),—P(R^1)(R^2),—SR^3 \text{ or } —OR^3,$$

wherein: $R^1$ and $R^2$ are independently selected from hydrogen, linear or branched alkyl, cycloalkyl, aryl and substituted aryl or, in the case of an $—(R^1)(R^2)$ group, $R^1$ and $R^2$ together with the interjacent nitrogen atom form part of a heterocyclic ring; and $R^3$ is selected from linear or branched alkyl, cycloalkyl, aryl and substituted aryl.

11. A process according to claim 10, wherein $R^1$, $R^2$ and $R^3$ are each selected from hydrogen, methyl, ethyl, isopropyl, propyl, butyl, sec-butyl, isobutyl, pentyl, hexyl, cyclohexyl, benzyl, phenyl, or, in the case of an $—N(R^1)(R^2)$ group, $R^l$ and $R^2$ together represent a tetramethylene or pentamethylene group optionally substituted by one of more $C_1$ to $C_4$ alkyl groups.

12. A process according to claim 7, wherein Z is selected from linear or branched $C_1$ to $C_{18}$ alkanediyl, substituted alkanediyl, dialkanylether or dialkanylketone, preferably $C_1$ to $C_8$ and more preferably $C_2$ to $C_6$.

13. A process according to claim 12, wherein Z is selected from:

(a) $(CH_2—CH_2)—$, $(CH_2—CH_2—CH_2)—$, $—(CH_2—CH_2—CH_2—CH_2)—$, $—(CH_2—CH_2—CH_2—CH_2—CH_2)—$, $—(CH_2—CH_2—CH_2—CH_2—CH_2—CH_2)—$, $—(CH_2—CH(CH_3))—$, and $—(CH_2—CH(CH_3)—CH_2—CH(CH_3))—$;

(b) a divalent alkyleneoxyalkylene radical selected from: $—(CH_2_CH_2—O—CH_2—CH_2)—$, $—(CH_2—CH_2—O—CH_2—CH_2—CH_2)—$, and $—(CH_2_CH(CH_3)—OCH_2—CH(CH_3))—$;

(c) a divalent polyoxyethylene radical selected from: $—(CH_2CH_2O)_n—$where n is an integer in the range 1 to 9 or $—(CH_2CH(CH_3)O)_m—$where m is an integer in the range 1 to 6 ; or (d) a divalent alkylenearylene or an alkylenearylenealkylene radical selected from: $—(CH_2—C_6H_4)—$, and $—(CH_2—C_6H_4—CH_2)—$.

14. A process according to claim 7, wherein $[X^-]$ is a basic anion selected from: $[F]^-$, $[Cl]^-$, $[OH]^-$, $[OR]^-$, $[RCO_2]^-$, $[PO_4]^{3-}$, and $[SO_4]^{2-}$, wherein R is $C_1$ to $C_6$ alkyl.

15. A process according to Claim 1, wherein $[Cat^+]$ comprises an acidic cation represented by the formula:

$$[Cat^+\text{-}(Z\text{-}Acid)_n]$$

wherein: $Cat^+$ is a cationic species;

Acid is an acidic moiety;

Z is defined in claim 12 or 13; and n is an integer from 1 to 3.

16. A process according to claim 15, wherein $[Cat^{30}\text{-}Z\text{-}Acid]$ is selected from the group consisting of:

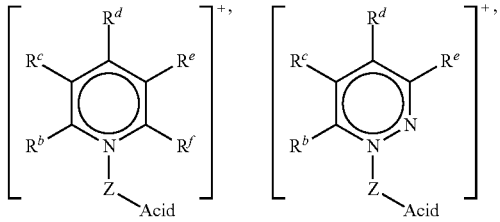

-continued

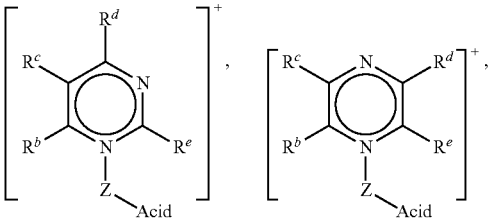

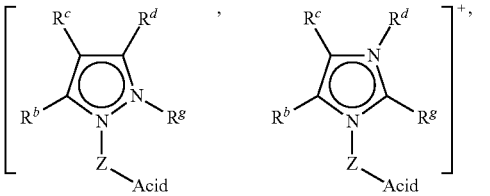

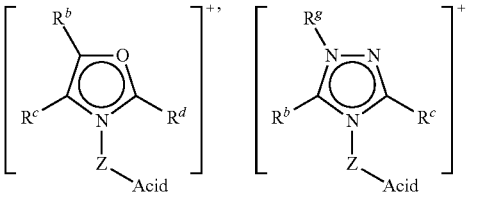

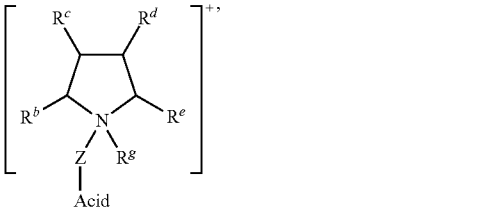

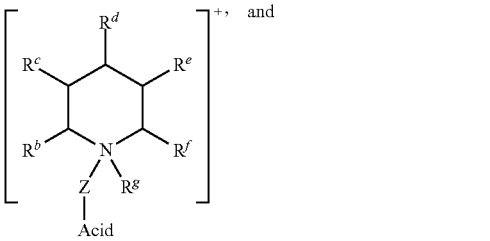

wherein: Acid is as defined in claim 15;

Z is as defined in claims 15; and $R^b$, $R^c$, $R^d$, $R^f$ and $R^g$ are defined as in claim 2.

17. A process according to claim 15, wherein Acid is selected from —$SO_3H$, —$CO_2H$, $RPO(OH)_2$ and $R_2PO(OH)$; wherein R is, for example, $C_1$ to $C_6$ alkyl.

18. A process according to claim 15, wherein $[X^-]$ is an acidic anion selected from: $[HSO_4]^-$, $[H_2PO_4]^-$, $[HPO_4]^{2-}$, $[HF_2]^-$, $[HCl_2]^-$, $[HBr_2]^-$, and $[HI_2]^-$.

19. A process according to claim 1, wherein $[X^-]$ comprises an anion selected from: $[F]^-$, $[CI]^-$, $[Br]^-$, $[I]^-$, $[OH]^-$, $[HSO_4]^-$, $[SO_4]^{2-}$, $[EtSO_4]^-$, $[H_2PO_4]^-$, $[HPO_4]^{2-}$, $[PO_4]^{3-}$, $[BF_4]^-$, $[PF_6]^-$, $[SbF_6]^-$, $[CuCl_2]^-$, $[AsF_6]^-$, $[CH_3SO_3]^-$ $[CH_3(C_6H_4)SO_3]^-$, $[CH_3OSO_3]^-$, $[C_2H_5OSO_3]^-$, $[CF_3SO_3]^-$, $[CF_3COO]^-$, $[CF_3CH_2CH_2COO]^-$, $[(CF_3SO_2)_3C]^-$, $[CF_3(CF_2)_3SO_3]^-$, $[(CF_3SO_2)_2N]^-$, $[NO_3]^-$, $[NO_2]^-$, [BBDB]$^-$, [BOB]$^-$, $[Co(CO_4)]^-$, $[(CN)_2N]^-$, $[(CF_3)_2N]^-$, $[(C_2F_5)_3PF_3]^-$, $[(C_3F_7)_3PF_3]^-$, $[(C_2F_5)_2P(O)O]^-$, $[SCN]^-$, $[C_8H_{17}OSO_3]^-$, $[TO]_5^-$, $[H_3CO(CH_2)_2O(CH_2)OSO_3]^-$, and $[H_3C(OCH_2CH_2)_nOSO_3]^-$, $[OR]^-$, $[RCO_2]^-$, $[HF_2]^-$, $[HCl_2]^-$, $[HBr_2]^-$, $[HI_2]^-$ and an inorganic metal ion, wherein R is $C_1$ to $C_6$ alkyl.

20. A process according to claim 19, wherein $[X^-]$ is selected from the group consisting of: $[F]^-$, $[CI]^-$, $[Br]^-$, $[I]^-$, $[EtSO_4]^-$, $[CH_3SO_3]^-$, $[CF_3SO_2)_2N]^-$, and $[CF_3SO_3]^-$.

21. A process according to claim 20, wherein $[X^-]$ is $[CI]^-$.

22. A process according to claim 1, wherein the soft Lewis acid is a metal halide.

23. A process according to claim 22, wherein the halide is a chloride.

24. A process according to claim 23, wherein the Lewis acid is gallium (III) chloride.

25. A process according to claim 1, wherein the zirconium salt is zirconium (IV) chloride.

26. A process according to claim 1, wherein the zirconium salt is a zirconium complex salt formed by mixing zirconium (IV) chloride and 1-octyl-3-methylimidazolium chloride.

27. A process according to claim 26, wherein the zirconium complex salt is formed by mixing 33 mol % of zirconium (IV) chloride and 67 mol % 1-octyl-3-methylimidazolium chloride.

28. A process according to claim 1, wherein the electrodeposition mixture contains a buffer.

29. A process according to claim 28, wherein the buffer is a zirconium salt.

30. A process according to claim 29, wherein the buffer is the same as the zirconium salt.

31. A process according to claim 1, wherein an outer layer of elemental zirconium is deposited on a substrate.

32. A process according to claim 31, wherein the substrate further comprises a layer of a second material between the substrate and the outer layer of elemental zirconium.

33. A process according to claim 32, wherein the second material is a metal.

34. A process according to claim 31 wherein the thickness of the layer of zirconium deposited on a substrate is less than 10 μm.

35. A process according to claim 1, wherein the process takes place at room temperature, wherein room temperature is between 20° C. and 25° C.

36. A process according to claim 1, wherein the electrochemical deposition is run for a period of between 60s and 3600 s.

37. A process according to claim 1, wherein the electrodeposition mixture is made by combining:

i. a Lewis acid premixed with a first amount of ionic liquid; and ii. a zirconium salt premixed with a second amount of ionic liquid.

38. A process according to claim 37, wherein the Lewis acid is premixed with a first amount of ionic liquid in a molar ratio from 2:1 to 1:1.

39. A process according to claim 38, wherein the Lewis acid is premixed with a first amount of ionic liquid in a molar ratio of 1:1.

40. A process according to claim 37, wherein the zirconium salt is premixed with a second amount of ionic liquid in a molar ratio from 1:1 to 1:10 to form a zirconium complex salt.

41. A process according to claim 37, wherein the electrodeposition mixture is made by combining:

i. ten parts by weight of: gallium (III) chloride premixed with a first amount of 1-octyl-3-methylimidazolium chloride in a molar ratio of 1:1; and ii. one part by weight of: zirconium (IV) chloride premixed with a second amount of 1-octyl-3-methylimidazolium chloride in a molar ratio of 1:2.

* * * * *